US012604966B2

(12) United States Patent
Yamashita et al.

(10) Patent No.: US 12,604,966 B2
(45) Date of Patent: Apr. 21, 2026

(54) COSMETIC PRODUCT MOLDING APPARATUS AND METHOD OF MOLDING ROD-SHAPED COSMETIC PRODUCT IN COSMETIC PRODUCT MOLDING APPARATUS

(71) Applicant: SHISEIDO COMPANY, LTD., Tokyo (JP)

(72) Inventors: Hisayoshi Yamashita, Tokyo (JP); Toshifumi Urashima, Tokyo (JP); Yurie Nishiumi, Tokyo (JP)

(73) Assignee: SHISEIDO COMPANY, LTD., Tokyo (JP)

( * ) Notice: Subject to any disclaimer, the term of this patent is extended or adjusted under 35 U.S.C. 154(b) by 126 days.

(21) Appl. No.: 18/254,012

(22) PCT Filed: Dec. 9, 2021

(86) PCT No.: PCT/JP2021/045372
§ 371 (c)(1),
(2) Date: May 23, 2023

(87) PCT Pub. No.: WO2022/138210
PCT Pub. Date: Jun. 30, 2022

(65) Prior Publication Data

US 2023/0404241 A1 Dec. 21, 2023

(30) Foreign Application Priority Data

Dec. 23, 2020 (JP) ..... 2020-213983

(51) Int. Cl.
*A45D 40/16* (2006.01)

(52) U.S. Cl.
CPC ..... *A45D 40/16* (2013.01)

(58) Field of Classification Search
CPC ..... B29C 33/0022; B29C 33/02; B29C 2045/2683; A45D 40/16
See application file for complete search history.

(56) References Cited

U.S. PATENT DOCUMENTS

2008/0315460 A1* 12/2008 Kusano ..... B29C 33/06 264/346
2011/0056650 A1 3/2011 Ito
(Continued)

FOREIGN PATENT DOCUMENTS

JP S62-290405 12/1987
JP H08-031997 2/1996
(Continued)

OTHER PUBLICATIONS

English Translation of IT201900004843 (Year: 2019).*
(Continued)

*Primary Examiner* — Michael A Tolin
*Assistant Examiner* — Hana C Page
(74) *Attorney, Agent, or Firm* — IPUSA, PLLC

(57) ABSTRACT

A cosmetic product molding apparatus 100 includes a plurality of molds 1, each mold 1 having a bottomed cylindrical shape and including a cylindrical recessed portion, the cylindrical recessed portion being configured to be filled with a cosmetic composition L for a rod-shaped cosmetic product, an outer cylinder 2 surrounding side surfaces of the plurality of molds, a plurality of Peltier elements 3 configured to heat or cool the plurality of molds 1, and a controller 5 configured to control each Peltier element of the plurality of Peltier elements 3 to adjust a temperature of each mold of the plurality of molds. The outer cylinder 2 is provided so as to prevent the plurality of molds 1 from affecting respective temperatures of fillings of one another.

23 Claims, 51 Drawing Sheets

(56) References Cited

U.S. PATENT DOCUMENTS

| | | | | |
|---|---|---|---|---|
| 2018/0255906 | A1* | 9/2018 | Delia | A45D 40/00 |
| 2019/0082556 | A1 | 3/2019 | Inano et al. | |
| 2020/0163440 | A1* | 5/2020 | Chartier | B29C 39/026 |

FOREIGN PATENT DOCUMENTS

| | | |
|---|---|---|
| JP | 2000-317938 | 11/2000 |
| JP | 2005-087619 | 4/2005 |
| JP | 2006-158513 | 6/2006 |
| JP | 2008-023113 | 2/2008 |
| JP | 2009-119149 | 6/2009 |
| JP | 2011-054883 | 3/2011 |
| JP | 2019-050306 | 3/2019 |
| WO | 2017/077587 | 5/2017 |

OTHER PUBLICATIONS

English Translation of JP2009119149 (Year: 2009).*
Itaya (Machine Translation of JP2006158513) (Year: 2006).*
Cassalino (Machine Translation of IT 201900004843) (Year: 2019).*
Kinoshita (Machine Translation of JP2008023113). (Year: 2008).*
International Search Report for PCT/JP2021/045372 mailed on Jan. 11, 2022.

* cited by examiner

Related Art

FIG.15

LIPSTICK MOLDING BY COMPARATIVE EXAMPLE (AIR BLOWING)

| | TYPICAL BOTTOM COOLING | | | LATERAL COOLING | | |
|---|---|---|---|---|---|---|
| | No.1 | No.2 | No.3 | No.4 | No.5 | No.6 |
| INTERNAL TEMPERATURE DURING FILLING | 85°C | | | | | |
| SET TEMPERATURE DURING BOTTOM COOLING | 10°C | | | | | |
| REHEATING TEMPERATURE | HIGH | MEDIUM | LOW | HIGH | MEDIUM | LOW |
| DEGREE OF SHRINK HOLE | ○ | △ | × | ○ | ○ | △ |

FIG.16

LIPSTICK MOLDING BY COMPARATIVE EXAMPLE (AIR BLOWING)

| | TYPICAL BOTTOM COOLING | | | LATERAL COOLING | | |
|---|---|---|---|---|---|---|
| | No.7 | No.8 | No.9 | No.10 | No.11 | No.12 |
| INTERNAL TEMPERATURE DURING FILLING | 82°C | | | | | |
| SET TEMPERATURE DURING BOTTOM COOLING | 10°C | | | | | |
| REHEATING TEMPERATURE | HIGH | MEDIUM | LOW | HIGH | MEDIUM | LOW |
| HARDNESS OF TIP PORTION/ HARDNESS OF BASE PORTION | 1.29 | 1.24 | 1.35 | 1.2 | 1.05 | 1.07 |
| RESISTANCE TO BREAKAGE | ○ | ○ | × | ○ | ○ | ○ |

FIG.17

| | STRAIN | SIZE OF CRYSTALS |
|---|---|---|
| RAPID COOLING | LARGE<br>⇒ LOW SOLID HARDNESS | SMALL<br>⇒ HIGH CRYSTAL HARDNESS |
| SLOW COOLING | SMALL<br>⇒ HIGH SOLID HARDNESS | LARGE<br>⇒ LOW CRYSTAL HARDNESS |

FIG.25

LIPSTICK MOLDING ACCORDING TO EMBODIMENT (PELTIER ELEMENT) OF PRESENT INVENTION

| | SHRINK HOLE | HARDNESS OF BASE PORTION (N) | RESISTANCE TO BREAKAGE (N) |
|---|---|---|---|
| INDEPENDENT MOLDING UNIT β1 | SMALL AND UNPROBLEMATIC | 24 | 23 |
| INDEPENDENT MOLDING UNIT β2 | SMALL AND UNPROBLEMATIC | 24 | 24 |
| INDEPENDENT MOLDING UNIT β3 | SMALL AND UNPROBLEMATIC | 28 | 25 |

BULLET TYPE

SLIM TYPE
(INNER CYLINDER TYPE)

CRAYON TYPE

SPATULA TIP TYPE

COSMETIC PRODUCT MOLDING APPARATUS AND METHOD OF MOLDING ROD-SHAPED COSMETIC PRODUCT IN COSMETIC PRODUCT MOLDING APPARATUS

TECHNICAL FIELD

The present disclosure relates to cosmetic product molding apparatuses and methods of molding rod-shaped cosmetic products in cosmetic product molding apparatuses.

BACKGROUND ART

As illustrated in FIG. 1, in a conventional manufacturing process of general rod-shaped cosmetic products such as lipsticks, eyeliners, and the like, materials are heated and melted (preheated), the cosmetic composition is poured into a mold and is cooled and solidified using cold air, and the molded cosmetic composition is removed from the mold. During the cooling and solidification process, defects such as a shrink hole caused by strain generated in the cooling and solidification process are eliminated by applying heat (reheating) to the cosmetic composition from above through warm air and by performing a slow cooling process in which the cosmetic composition is kept at room temperature.

When cold air is applied from below and warm air is applied from above with respect to a mold that is filled with cosmetic materials, the tip portion (the lower end) is rapidly cooled and the base portion (upper end) is slowly cooled in the mold. Hence, the application of warm air and cold air to the mold needs to be adjusted to avoid causing uneven temperature. Thus, in this adjustment, a narrow range of molding conditions is used so as to avoid unevenness in the appearance of the cosmetic composition and insufficiency in the strength of the cosmetic composition after solidification.

In addition, since the manufacturing process is also affected by the external environmental factors such as outside air temperature and humidity as well as factors such as the conveyance speed, the number of products present on the manufacturing line, and the like, some skill is required to set the molding conditions. In particular, while molds can be cooled easily during trial production since only a small number of products are produced for trial, molds are harder to cool during mass production since a large number of products are produced.

Patent Document 1 discloses a manufacturing apparatus that uses a Peltier element for temperature control to flexibly control the temperature of a metal mold so that accurate molding can be performed without requiring some skill. As illustrated in FIG. 2, in the manufacturing apparatus according to Patent Document 1, a plurality of filling holes X2 (X2-1 to X2-5) are formed along the lengthwise direction with respect to a single metal mold X1, and two Peltier elements X3 are provided on the two side surfaces of the metal mold X1 such that the metal mold X1 is interposed between the two Peltier elements X3 in the lengthwise direction.

RELATED-ART DOCUMENTS

Patent Documents

Patent Document 1: Japanese Patent Application Publication No. 2006-158513

SUMMARY OF THE INVENTION

Problem to be Solved by the Invention

In the manufacturing apparatus disclosed in Patent Document 1, however, in each filling hole X2, a temperature difference occurs between the side surfaces close to the Peltier elements X3 and the side surfaces adjacent to of the neighboring filling hole X2. Further, in the plurality of filling holes X2-1 to X2-5, due to the thermal conductivity of the metal mold X1, the temperature of the filling holes X2-1 and X2-5 at the respective ends in the lengthwise direction can be lower than the temperature of the other filling holes X2-2, X2-3, and X2-4 that are in the middle and are affected by adjacent filling holes. In other words, uniform temperature adjustment is not possible within one metal mold and in between the multiple metal molds.

Therefore, in consideration of the above-described matters, the present disclosure aims to provide a cosmetic product molding apparatus that can independently control the temperature of each mold filled with a cosmetic material and can mitigate temperature unevenness of each of a plurality of molds as well as in within each mold regardless of the number of cosmetic products that are to be molded.

Means to Solve the Problem

To solve the above-described problem, a cosmetic molding apparatus according to one aspect of the disclosure includes a plurality of molds, each mold having a bottomed cylindrical shape and including a cylindrical recessed portion, the cylindrical recessed portion being configured to be filled with a cosmetic composition for a rod-shaped cosmetic product; an outer cylinder surrounding side surfaces of the plurality of molds; a plurality of Peltier elements configured to heat or cool the plurality of molds; and a controller configured to control each Peltier element of the plurality of Peltier elements to adjust a temperature of each mold of the plurality of molds. The outer cylinder is provided so as to prevent the plurality of molds from affecting respective temperatures of fillings of one another.

Effects of the Invention

In a cosmetic product molding apparatus according to one aspect, the temperature of each mold filled with a cosmetic material can be independently controlled, and temperature unevenness can be mitigated in each of a plurality of molds as well as in within each mold regardless of the number of cosmetic products that are to be molded.

BRIEF DESCRIPTION OF THE DRAWINGS

FIG. 15 is a table illustrating the results of experiments with respect to shrink holes in lipstick molding with bottom cooling and lateral cooling by air blowing;

FIG. 16 is a table illustrating the results of experiments on the hardness and breakage resistance in lipstick molding with bottom cooling and lateral cooling by air blowing;

FIG. 17 is a table illustrating the characteristics in the case of rapid cooling and the characteristics in the case of slow cooling;

FIG. 25 is a table illustrating the results of experiments on shrink hole size and breakage resistance of respective lipsticks molded by the independent molding units according to the first configuration example, the second configuration example, and the third configuration example;

MODE FOR CARRYING OUT THE INVENTION

Figure 1:
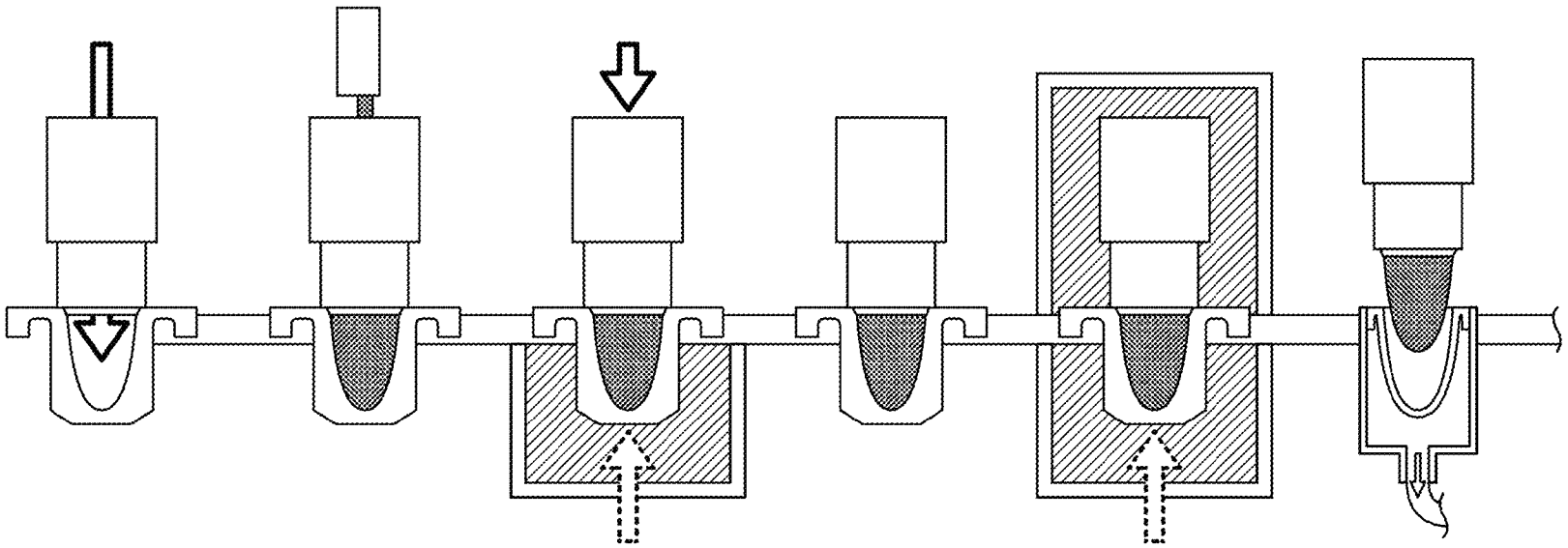
FIG. 1 is a view for explaining the molding process of a rod-shaped cosmetic product by a general back filling method according to Related Art Example 1.
Figure 2:
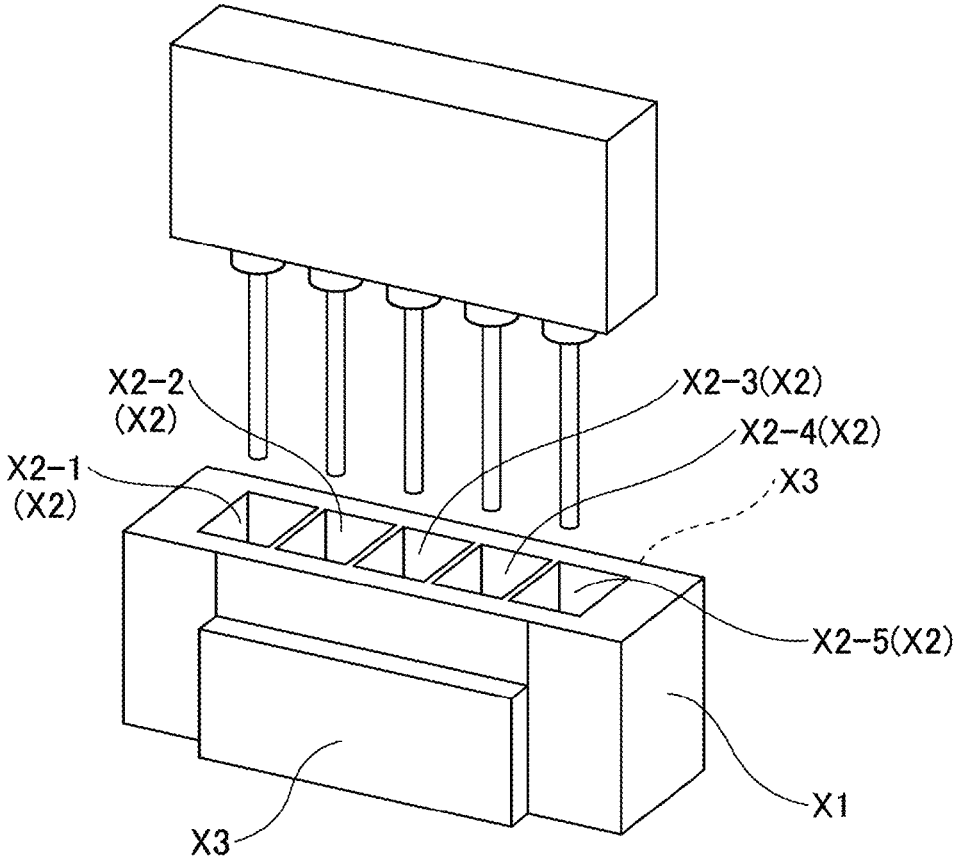
FIG.2 Related Art
FIG. 2 is a top perspective view of a molding apparatus for rod-shaped cosmetic products according to Related Art Example 2.

Embodiments of the disclosure will be described hereinafter with reference to the accompanying drawings. Note that the same reference numerals denote the same components in the drawings, and a repetitive description thereof may be omitted.

The disclosure relates to a cosmetic product molding apparatus, and a method of manufacturing a rod-shaped cosmetic product in the cosmetic product molding apparatus.

Examples of rod-shaped cosmetic products include oil-based solid products such as lipsticks, lip balms, concealers, stick eyeshadows, stick foundations, serum sticks, moisturizing sticks, and the like.

Furthermore, in addition to solids formed into a predetermined shape, rod-shaped cosmetic products may include a composition such as a viscoelastic composition that has a predetermined viscosity or more and can maintain a predetermined shape. A lipstick will be described as an example of a rod-shaped cosmetic product hereinafter.

First Embodiment

Figure 3A:
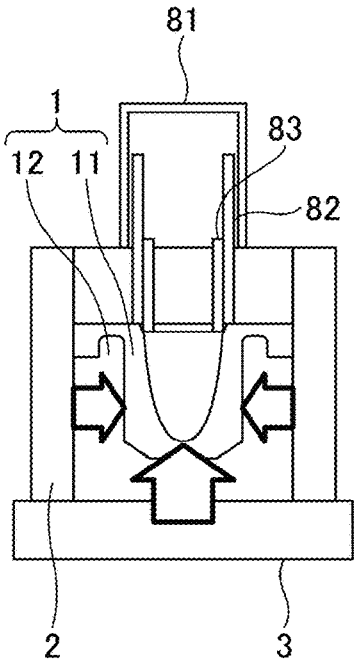
FIG. 3A is a view illustrating a state during preheating in a rod-shaped cosmetic product molding process based on a back filling method of the disclosure.
Figure 3B:
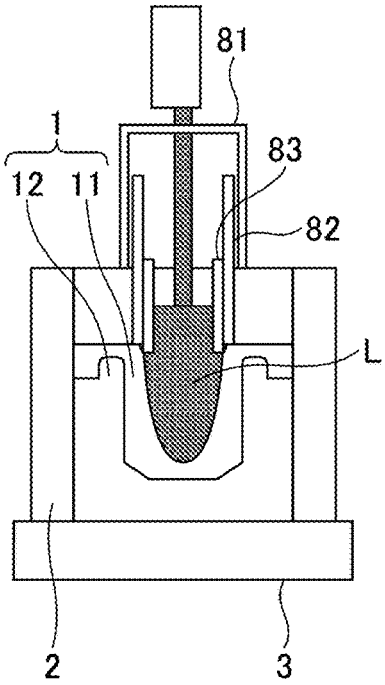
FIG. 3B is a view illustrating a state during filling in the rod-shaped cosmetic product molding process based on the back filling method of the disclosure.
Figure 3C:
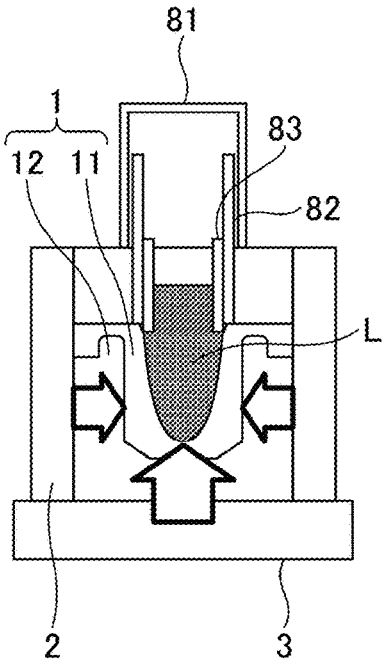
FIG. 3C is a view illustrating a state in which reheating using warm air from a reheated Peltier element is performed in the rod-shaped cosmetic product molding process based on the back filling method of the disclosure.
Figure 3D:
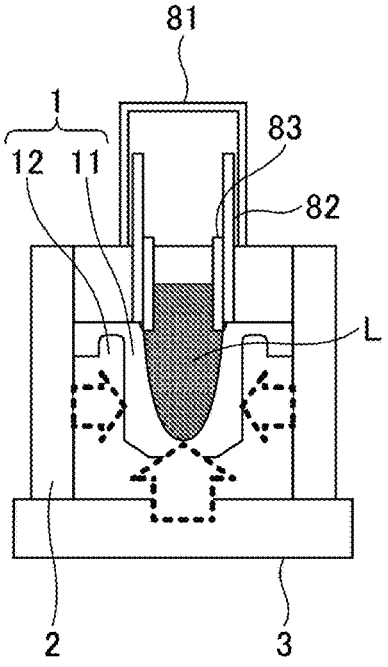
FIG. 3D is a view illustrating a state during cooling by the Peltier element in the rod-shaped cosmetic product molding process based on the back filling method of the disclosure.
Figure 3E:
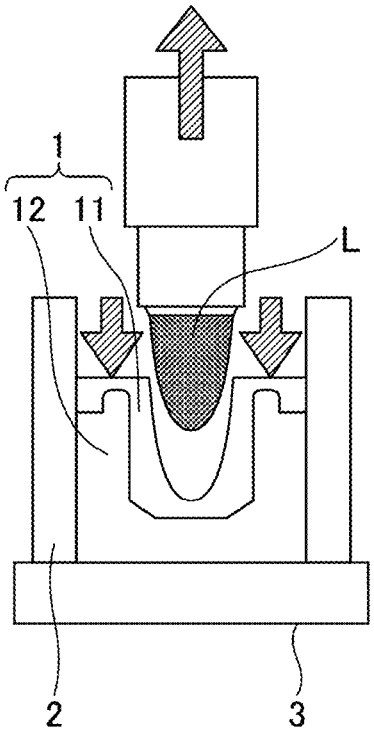
FIG. 3E is a view illustrating a state during removal in the rod-shaped cosmetic product molding process by the back filling method of the disclosure.

FIGS. 3A to 3E are views for explaining a molding process of a rod-shaped cosmetic product based on a back filling method of the disclosure. FIG. 3A illustrates the state during preheating in the molding process, FIG. 3B illustrates a state during filling, FIG. 3C illustrates a state during reheating by a Peltier element, FIG. 3D illustrates a state during cooling, and FIG. 3E illustrates a state during removal in the molding process of a rod-shaped cosmetic product based on the back filling method of the disclosure.

As illustrated in FIGS. 3A to 3E, a mold 1, which includes a rubber mold 11 and a metal mold 12, an outer cylinder 2, and a Peltier element 3 are provided near a cosmetic composition L in a lipstick molding apparatus of the disclosure.

The mold 1 is cylindrical and includes a bottom and a cylindrical recessed portion to which a cosmetic composition for the rod-shaped cosmetic product is to be filled. The outer cylinder 2 surrounds the side surface of the mold 1. The Peltier element 3 can heat or cool the mold 1 by changing the temperature.

In the case of the back filling method, molding is performed in a state where an elevating cylinder (middle tray cylinder) 83 and a spiral cylinder (extending cylinder, sleeve) 82 are fitted on the upper side of the cosmetic composition L.

In the manufacturing process of a rod-shaped cosmetic product of the disclosure, after a mold is preheated (FIG. 3A), a cosmetic composition that has been heated and melted is poured into the mold (FIG. 3B), a Peltier element is used to reheat the cosmetic composition (FIG. 3C) and to cool and solidify the cosmetic composition (FIG. 3D), and the molded cosmetic composition is subsequently removed from the mold (FIG. 3E).

In contrast to the example of the related art illustrated in FIG. 1, slow cooling in which reheating and cyclic cooling are directly performed using a Peltier element instead of airflow is executed during the cooling and solidification process of the disclosure.

The configuration for implementing the temperature adjustment in the lipstick molding apparatus according to the first embodiment based on the back filling method of the disclosure will be described next with reference to FIGS. 4 to 7.

Figure 4:
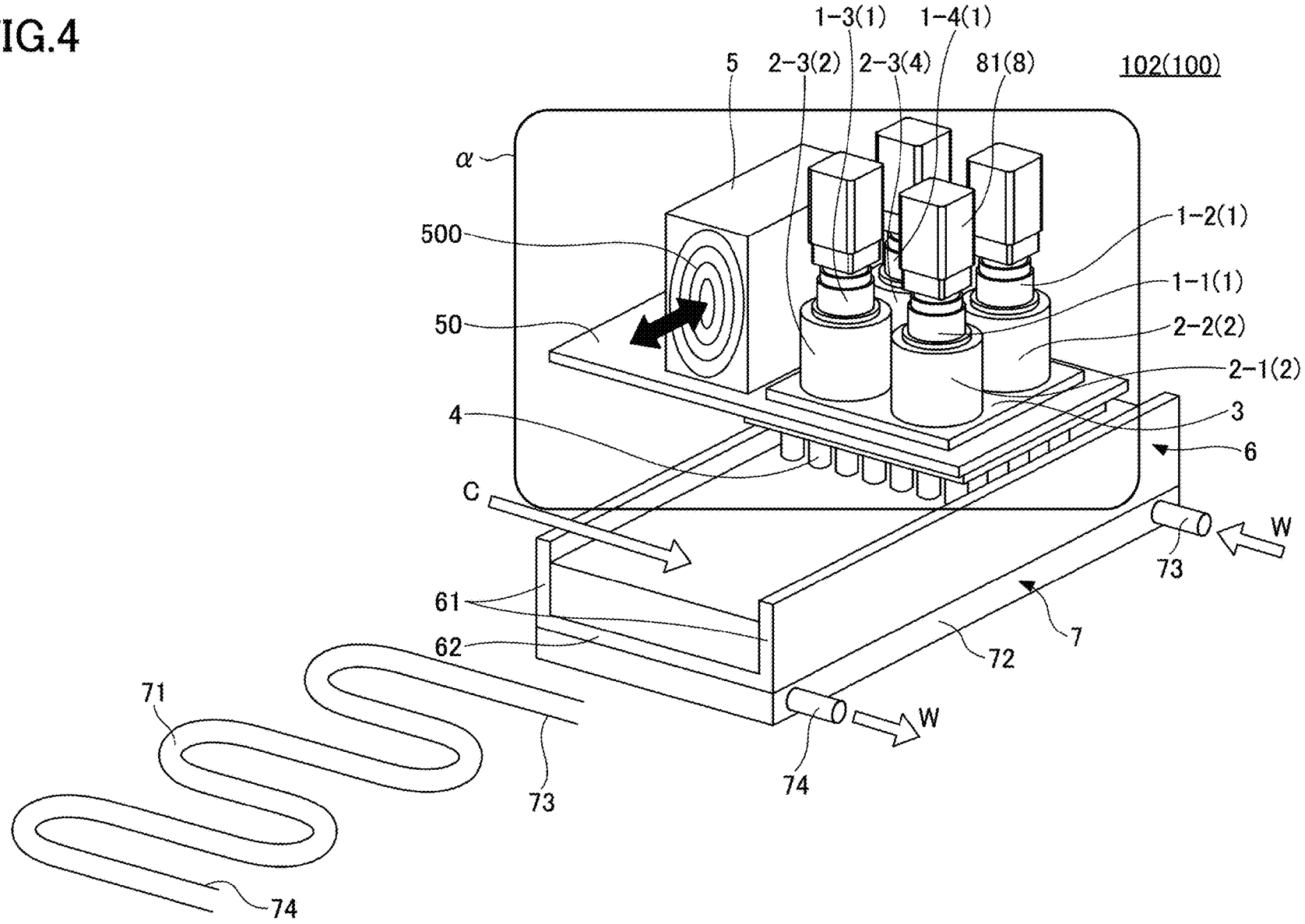
FIG. 4 is a perspective view of a temperature adjustment device of a lipstick molding apparatus according to the first embodiment of the disclosure.
Figure 5A:
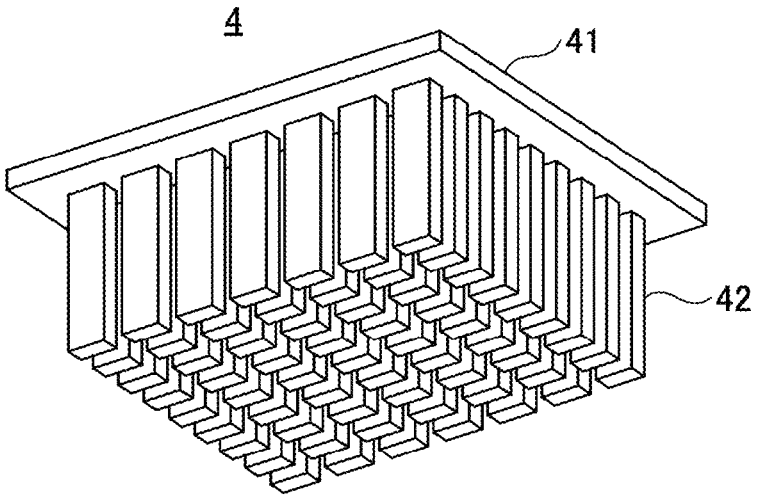
FIG. 5A is a view illustrating a heat sink according to the first configuration example.
Figure 5B:
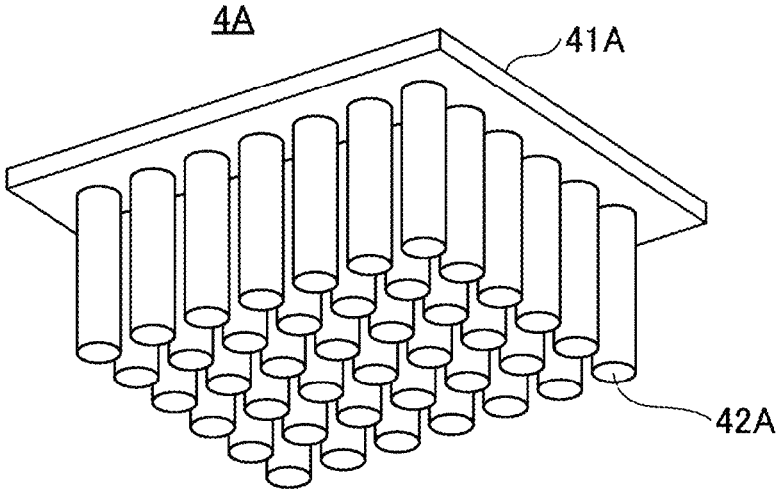
FIG. 5B is a view illustrating a heat sink according to the second configuration example.
Figure 5C:
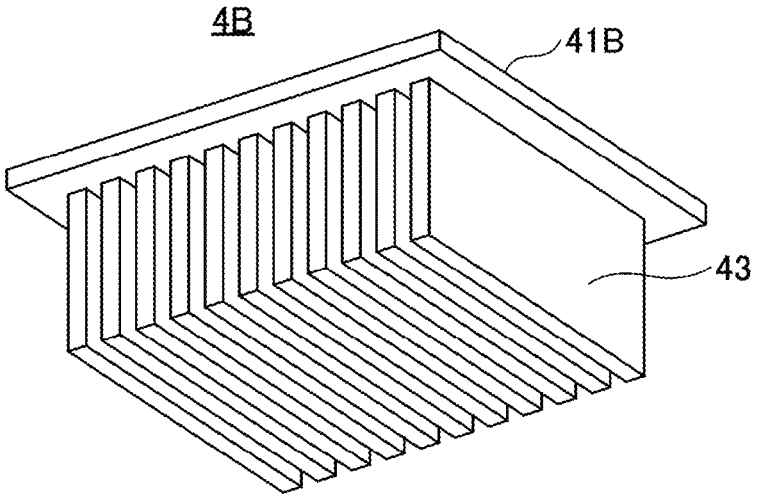
FIG. 5C is a view illustrating a heat sink according to the third configuration example.
Figure 6:
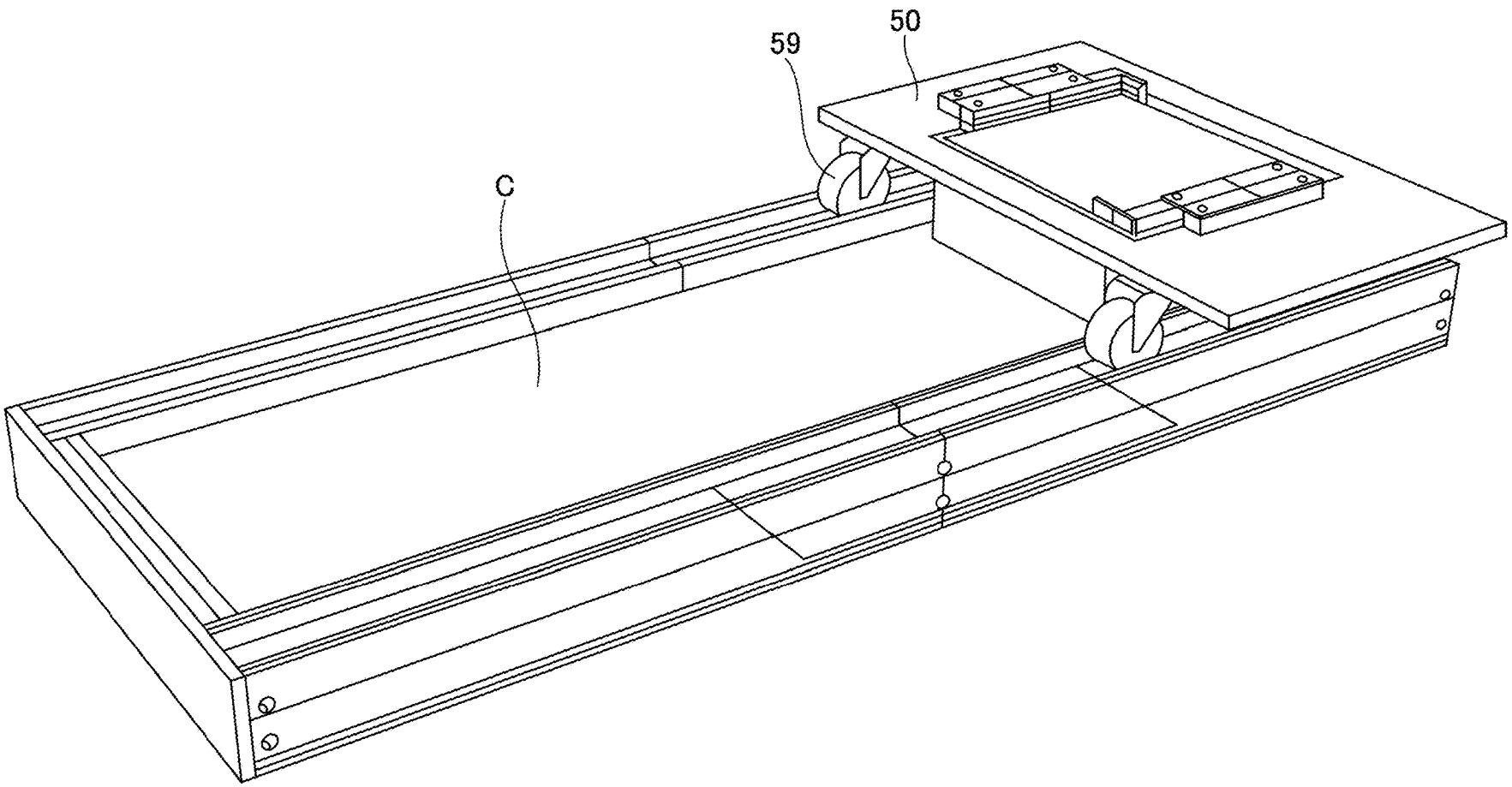
FIG. 6 is a view illustrating a substrate moving unit of the lipstick molding apparatus.
Figure 7:
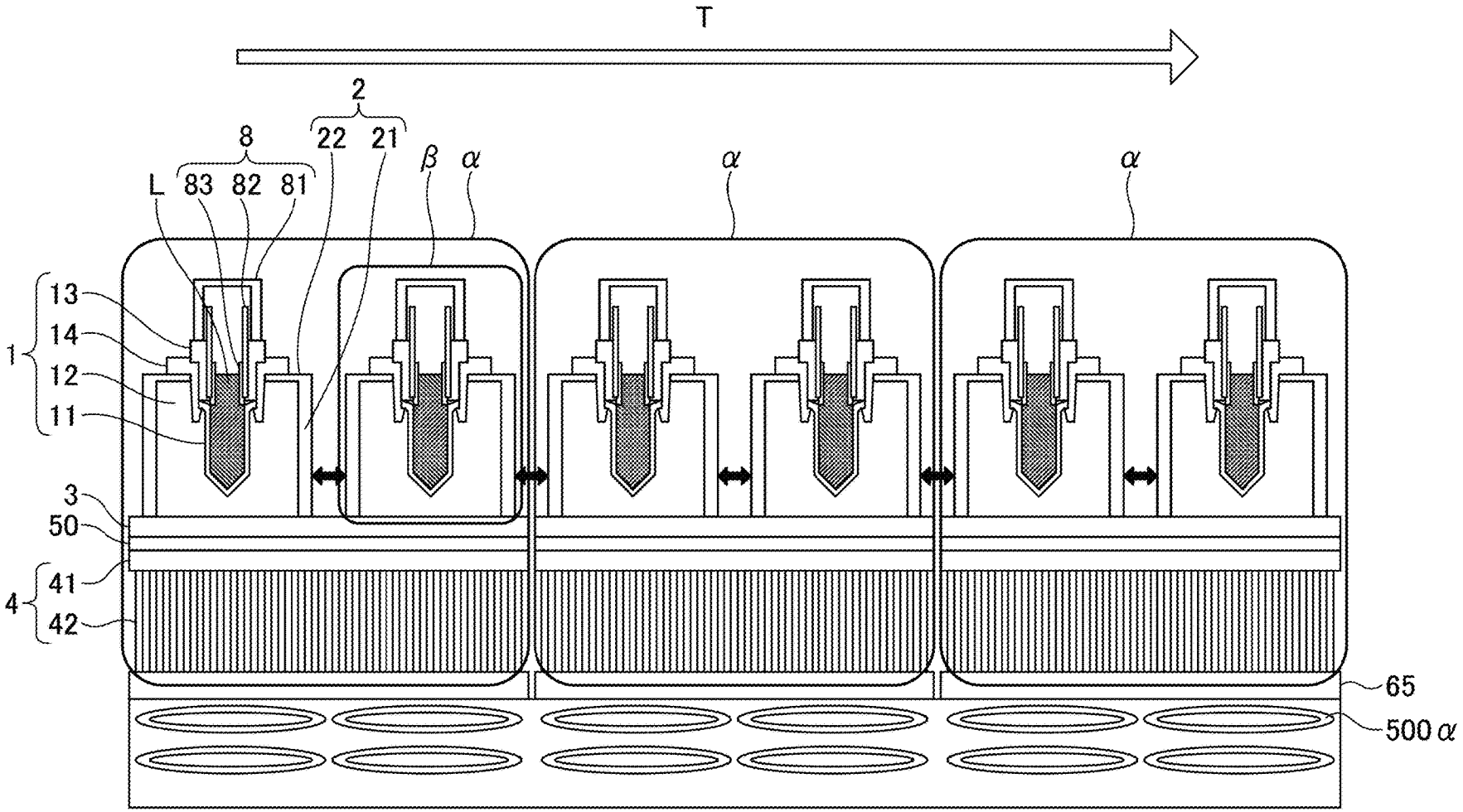
FIG. 7 is a cross-sectional view illustrating a state in which a plurality of independent molding units of the manufacturing apparatus of FIGS. 3A to 3E are arrayed in the conveyance direction.

FIG. 4 is a perspective view of a temperature adjustment device of the lipstick molding apparatus according to the first embodiment of the disclosure. FIGS. 5A to 5C are views illustrating specific examples of heat sinks. FIG. 6 is a view illustrating the periphery of a substrate moving unit of a refrigerant tank. FIG. 7 is a cross-sectional view illustrating a state in which a plurality of independent molding units of the manufacturing apparatus illustrated in FIGS. 3A to 3E are arrayed in a conveyance direction. FIG. 7 illustrates the cross section of a temperature adjustment device that employs a different cooling method from the temperature adjustment device of FIG. 4.

A temperature adjustment device 102 of a lipstick molding apparatus 100 illustrated in FIG. 4 includes the plurality of molds 1, the plurality of outer cylinders 2, the Peltier element 3, a heat sink 4, a controller 5, a refrigerant tank 6, and a cooling unit 7. The heat sink 4 is a member for cooling the Peltier element. The refrigerant tank 6 uses a first refrigerant C to cool the heat sink 4. The cooling unit 7 uses a second refrigerant W contained in its refrigerant tank to cool the first refrigerant C. Furthermore, a substrate 50 on which the controller 5 is disposed may be provided.

The lipstick molding apparatus of FIG. 4 illustrates a cooling configuration in which the plurality of molds 1 (1-1, 1-2, 1-3, and 1-4), the plurality of outer cylinders 2 (2-1, 2-2, 2-3, and 2-4), and the Peltier element 3 are cooled by the heat sink 4 that is cooled by two types of refrigerants.

The first refrigerant C may be, for example, an oil-based refrigerant such as thermal grease with high thermal conductivity. The second refrigerant W that is circulated may preferably be, for example, a refrigerant that has high specific heat and fluidity such as water (cooling water), alcohol, ethylene glycol, polyhydric alcohol, or an aqueous solution thereof.

Each mold 1 is a cylindrical mold with a bottom, and includes a cylindrical recessed portion that is to be filled with the cosmetic composition for the rod-shaped cosmetic product. A plurality of molds 1 are provided in a number that is at least equal to or more than the number of lipsticks to be filled at once.

Each outer cylinder 2 is a holder portion that surrounds at least the side surface of each mold of the plurality of molds 1. The outer cylinder 2 is provided to prevent the plurality of molds 1 from affecting the respective temperatures of the fillings of one another.

In this embodiment, the outer cylinder 2 is a thermally insulated cylinder. The outer cylinders 2 are provided spaced apart from each other to prevent temperature interference from occurring between neighboring molds 1. This example describes a case where outer cylinders 2 are equal in number to the molds 1 such that one outer cylinder 2 is provided for one corresponding mold 1. However, the outer cylinders 2 need not always be equal in number to the molds 1, and one outer cylinder 2 may be provided for a plurality of molds 1 as long as temperature interference between the molds is prevented (the tenth embodiment and the eleventh embodiment).

The Peltier element 3 contacts at least a portion of the lower surface of each mold 1 and the lower surface of each outer cylinder 2, and can heat or cool each mold 1. In this embodiment, one Peltier element 3 is provided with respect to four sets of the mold 1 and the outer cylinder 2.

The controller 5 is an example of a controller. The controller 5 electrically connects with the Peltier element 3 and controls the value and the direction of the supplied current to adjust the temperature of each molding 1 via the corresponding Peltier element 3. The controller 5 is disposed on the upper surface of the substrate 50. The substrate 50 is provided because the controller 5 is used per cooling unit.

The heat sink 4 is provided beneath the Peltier element 3, and cools the Peltier element 3 from below. The Peltier element 3 is directly in contact with the heat sink 4.

FIGS. 5A to 5C are enlarged views of heat sinks. FIG. 5A is a top perspective view of the heat sink 4 according to the first configuration example. FIG. 5B is a top perspective view of a heat sink 4A according to the second configuration example. FIG. 5C is a perspective view of a heat sink 4B according to the third configuration example.

As illustrated in FIG. 5A, the heat sink 4 includes an upper pad 41 on its upper side and rod-shaped protrusions (rod-shaped suspended members) 42 that are a plurality of prism-shaped fins extending downward from the lower surface of the upper pad 41. The upper pad 41 (41A) that serves as the base portion of the heat sink 4 may be square shaped as illustrated in FIG. 5A or may be circular shaped. The protrusions may be cylindrical rod-shaped protrusions 42A as illustrated in FIG. 5B or may be planar protrusions (plate-shaped protrusions) 43 as illustrated in FIG. 5C.

Since the heat sink 4 that has such a shape serves to cool the Peltier element 3, it is preferable for the heat sink 4 to be in direct contact with the Peltier element 3 or to be in contact with the Peltier element through the substrate 50.

In the example illustrated in FIG. 4, the heat sink 4 is positioned under the Peltier element 3 to cool the Peltier element 3. The substrate 50 functions as a base that allows the Peltier element 3, the heat sink, and the controller to be formed together as one conveyable unit.

Note that in the temperature adjustment device 102, four upper molds 1, four outer cylinders 2, one Peltier element 3, the substrate 50, the controller 5, and the heat sink 4 form together an independent temperature control unit α.

The refrigerant tank 6 stores the first refrigerant C for cooling the heat sink 4. In the case of the cooling method that employs the cooling unit 7, it is preferable for a thermal grease that has good thermal conductivity to be used as the first refrigerant C. However, water, alcohol, ethylene glycol, polyhydric alcohol, or an aqueous solution thereof may be used. In the refrigerant tank 6, all or a portion of the lower end peripheral portions of the protrusions 42, 42A, or 43 forming the finned portion of the heat sink 4 is immersed in the first refrigerant C.

The refrigerant tank 6 is composed of the side walls 61 and the bottom wall 62. As illustrated in FIG. 6, the independent temperature control unit α can be moved for conveyance in the refrigerant tank 6 through casters 59 or the like installed on the substrate 50 on both sides of the refrigerant tank 6. Note that the conveyance method illustrated in FIG. 6 is merely an example, and the conveyance method of the independent temperature control unit α of the disclosure is not limited to this. The conveyance method may include conveyance by an electric actuator or the like.

This structure allows the heat sink 4 to be cooled stably when the independent temperature control unit α is moved for conveyance. Even in a case where the lower portion of the heat sink 4 becomes worn by the conveyance, the heat sink 4 can be cooled without a problem.

The cooling unit 7 is formed under the refrigerant tank 6. The cooling unit 7 includes a cooling passage 71 and a housing 72. A water intake passage 73 and a water discharge passage 74 are provided on the front side of the housing 72 and are connected to the cooling passage 71. The second refrigerant W that is to be used for cooling flows in the cooling passage 71. The cooling passage 71 is provided so as to meander in a snake-like manner within the cooling unit. The cooling unit 7 is preferably made of a metal plate with good thermal conductivity, and is stably and uniformly cooled by the circulating second refrigerant W.

In a case where the cooling unit 7 is included, the cooling unit 7 that is cooled by the second refrigerant W can cool the refrigerant tank 6 to cool the first refrigerant C in the refrigerant tank 6, thereby cooling the heat sink 4 provided below the Peltier element 3.

Note that an example that includes the cooling unit 7 is illustrated in FIG. 4. However, the cooling unit 7 may not be included in a case where cooling is performed by circulating the first refrigerant C contained in the refrigerant tank 6. In a case where the cooling unit 7 is not included and the first refrigerant C in the refrigerant tank is to be circulated, a refrigerant that has high specific heat and fluidity such as water, alcohol, ethylene glycol, polyhydric alcohol, or an aqueous solution thereof may be preferably used for the sake of circulation.

The Peltier element 3 has a property that when a surface on one side radiates heat, a surface on the other side absorbs heat. Thus, it is preferable that the back surface of the Peltier element 3 is cooled when the upper surface of the Peltier element 3 is heated. Cooling the lower surface by the first refrigerant C can facilitate heat absorption during heating of the upper surface of the Peltier element 3 and suppress the heating of the back surface during cooling.

FIG. 7 is a cross-sectional view illustrating a state in which the independent molding units are arrayed in the conveyance direction. In FIG. 7, the plurality of the outer cylinders 2 surrounding the plurality of molds 1 are provided so as to be separated from each other in a non-contacting manner. An example in which one Peltier element 3 is provided with respect to four molds 1 is illustrated in this embodiment.

As the Peltier element 3 are also provided spaced apart from each other, the independent temperature control unit α are provided spaced apart from each other to prevent temperature interference from occurring between neighboring Peltier elements 3. Although this will be described later, the set temperature of each Peltier element 3 is changed in accordance with the elapse of time after the filling process. Hence, the three Peltier element 3 illustrated in FIG. 7 can be set to different temperatures from each other.

A cooling method in which the temperature adjustment device of the lipstick molding apparatus uses two refrigerants is described in FIG. 4. However, in the temperature adjustment device illustrated in FIG. 7, as the heat sink 4 employs an air cooling mechanism. Hence, refrigerants are not used.

Further, in the example of the temperature adjustment device of the lipstick molding apparatus illustrated in FIG. 4, the controller 5 on the substrate includes a power supply device 500 for transmitting heat via electrical power to the Peltier element. However, in the temperature adjustment device illustrated in FIG. 7, a wireless power supply device 500*a* that supplies power to (the element controller of) the Peltier element 3 may be provided below the heat sink 4 and a conveyance belt 65.

In the independent temperature control unit according to the embodiment, one molding portion, excluding the Peltier element 3 and the heat sink 4, used for molding one lipstick will be referred to as an independent molding unit β. These molding units β are also provided spaced apart from each other to prevent temperature interference between them.

Figure 8A:
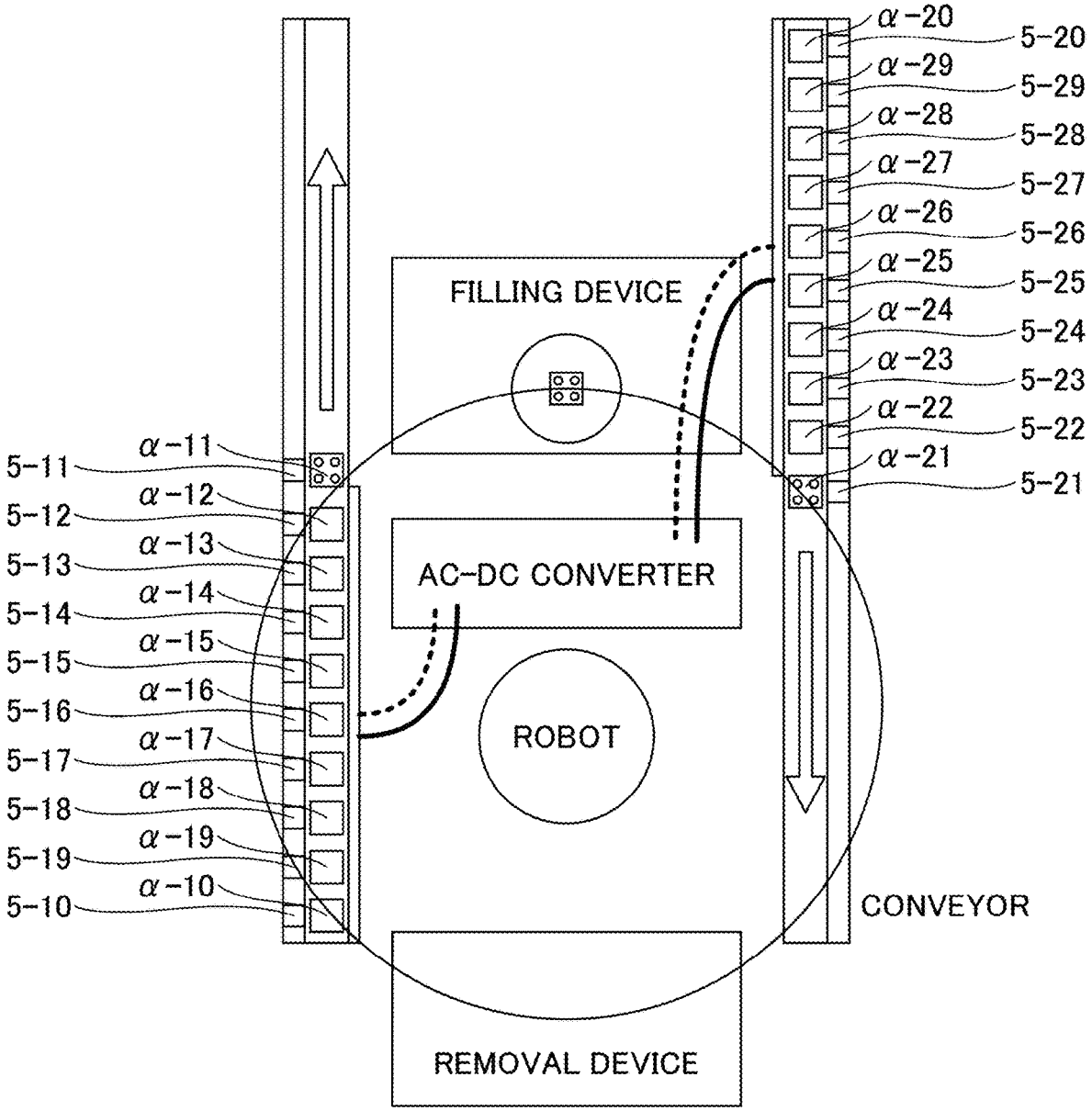
FIG. 8A is a top view for explaining the wired power transmission to independent temperature control units.
Figure 8B:
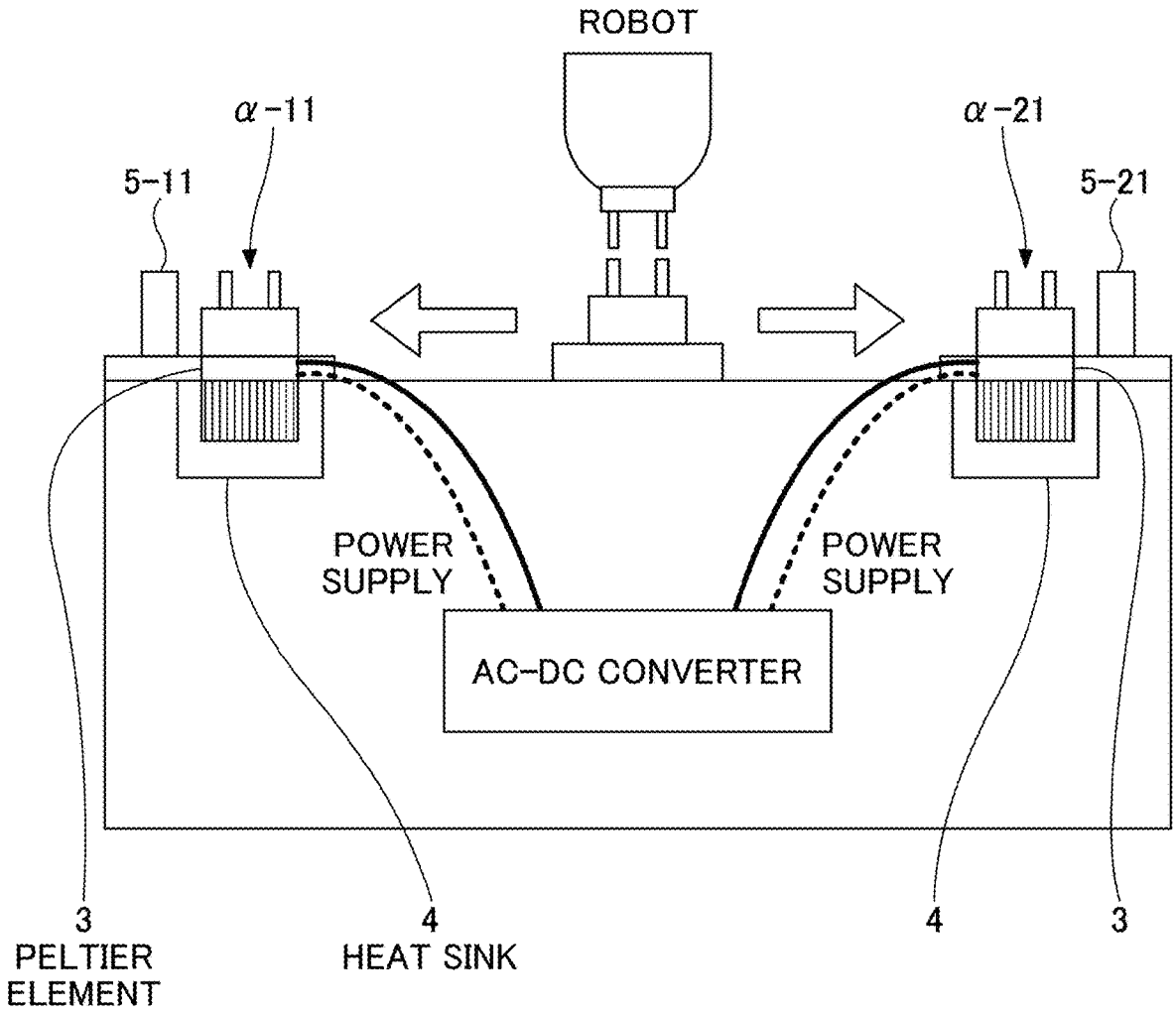
FIG. 8B is a side view for explaining the wired power transmission to the independent temperature control units.

FIGS. 8A and 8B are views for explaining the wired power transmission to the independent temperature control units α. FIG. 8A is a top view, and FIG. 8B is a side view. To execute a programmed operation through the Peltier element 3, the power needs to be supplied to the Peltier element 3 and the controller 5. In the examples illustrated in FIGS. 8A and 8B, two rows of the independent temperature control units α (α-11 to α-10 and α-21 to α-20), which are provided side by side and each including 10 units, and the corresponding controllers (5-11 to 5-10 and 5-21 to 5-20) are conveyed freely and safely while power is supplied via wires below for power supply.

Although FIGS. 8A and 8B illustrate examples of wired power transmission, a program capable of setting a cooling profile optimal for the cosmetic composition to be applied may be wirelessly transmitted to each controller 5. In such a case, each independent temperature control unit α can be operated based on a program. For example, a wireless power transmission device is provided in the front-lateral side of the controller 5 in FIG. 4, and a wireless power transmission device is provided below the controller 5 in FIG. 7.

Further in the embodiment, each of the four molds 1 provided in each independent temperature control unit α includes the rubber mold 11, the metal mold 12, and rubber holders 13 and 14.

The rubber mold 11 includes a cylindrical recessed portion and is an elastic mold made of silicone rubber, fluorosilicone rubber, or the like. The recessed portion is directly filled with the lipstick composition (cosmetic composition) L for a lipstick (rod-shaped cosmetic product).

The metal mold 12 is an example of a thermally conductive mold that has a bottomed cylindrical shape, and surrounds the side surfaces and the bottom surface of the rubber mold 11. The thermally conductive mold may be a mold made of graphite or a metal with good conductivity such as copper, aluminum, or the like.

In addition, to allow the lipstick to be molded while being tightly adhered to a part of an extendable container 8 during the filling process of the mold with the cosmetic composition L, the elevating cylinder 83, the outer spiral cylinder 82, and an outer cylinder 81, which are part of the extendable container 8, can be set on the upper portion of the independent temperature control unit α.

The inner holder 13 of the mold 1 surrounds and holds the elevating cylinder 83, which tightly holds the molded cosmetic composition L, and the spiral cylinder 82, which is engaged with the exterior of the elevating cylinder 83. The rubber holder 13 also clamps and holds the rubber mold 11 with the rubber holder 14.

The rubber holder 14 surrounds and holds the outer side surface of the inner holder 13 and connects with the metal mold 12 and the outer cylinder 2.

In the example of FIG. 7, the outer holder 14 is bent to have a substantially L-shaped cross section. The positions of the elevating cylinder 83 and the spiral cylinder 82 are fixed by providing a part of the outer holder 14 and the rubber mold 11 to be in contact with the metal mold 12.

Further, in the embodiment, the outer cylinder 2, which serves as the holder portion surrounding the mold 1, includes an outer side wall 21 and an upper surface 22.

In FIGS. 4 and 7, each of the plurality of Peltier elements 3 is provided to be wider in a horizontal direction than in a height direction, and the lower ends of the four molds 1 contact the upper surface of one Peltier element 3. Hence, in this embodiment, one Peltier element 3 of the plurality of Peltier elements 3 can heat or cool a set of four molds 1.

In the embodiment, in a state where the elevating cylinder 83 and the spiral cylinder 82 are held by the rubber holders 13 and 14 and the outer cylinder 81 is provided on the top, the recessed portion of the mold 1 and the interior of the elevating cylinder 83 are filled with the lipstick composition L. Subsequently, the temperature of the lipstick composition L in the rubber mold 11 and the elevating cylinder 83 is adjusted by the Peltier element 3. Adjusting the Peltier element 3 to a predetermined temperature causes the metal mold 12 to be heated or cooled from the bottom (bottom heating or bottom cooling). The lipstick composition L is heated or cooled from the bottom or heated or cooled laterally in accordance with the shape of the metal mold 12.

Note that the ratio of the number of molds 1 to the number of Peltier elements 3 is not limited to 4:1, and the Peltier element 3 may be provided with respect to the plurality of molds 1 at a ratio that ranges from 1:n (n being a natural number larger than or equal to 2) to 1:1. In this case, 1 to n molds 1 and the lower ends of 1 to n outer cylinders 2 can be in contact with the upper surface of one Peltier element 3. Each Peltier element of the plurality of Peltier elements can heat or cool 1 to n corresponding molds.

In the embodiment illustrated in FIGS. 4 and 7, each outer cylinder 2 functions as a thermally insulated cylinder that maintains the heat of the mold as well as prevents the heat from being transferred to other molds. Since this conversely causes each outer cylinder 2 to function as a heat insulator that prevents heat from the other molds from affecting the mold therein, temperature interference between the neighboring molds 1 can be prevented by providing the outer cylinders 2 away from one another. Note that in this example, one outer cylinder 2 is provided for one corresponding mold 1 such that the outer cylinders 2 are equal in number to the molds 1. That said, however, one outer cylinder 2 need not always be provided for one corresponding mold 1. One outer cylinder may be provided for a plurality of molds 1 as long as temperature interference does not occur between the molds (the tenth embodiment and the eleventh embodiment).

(Manufacturing Process)

Figure 9:
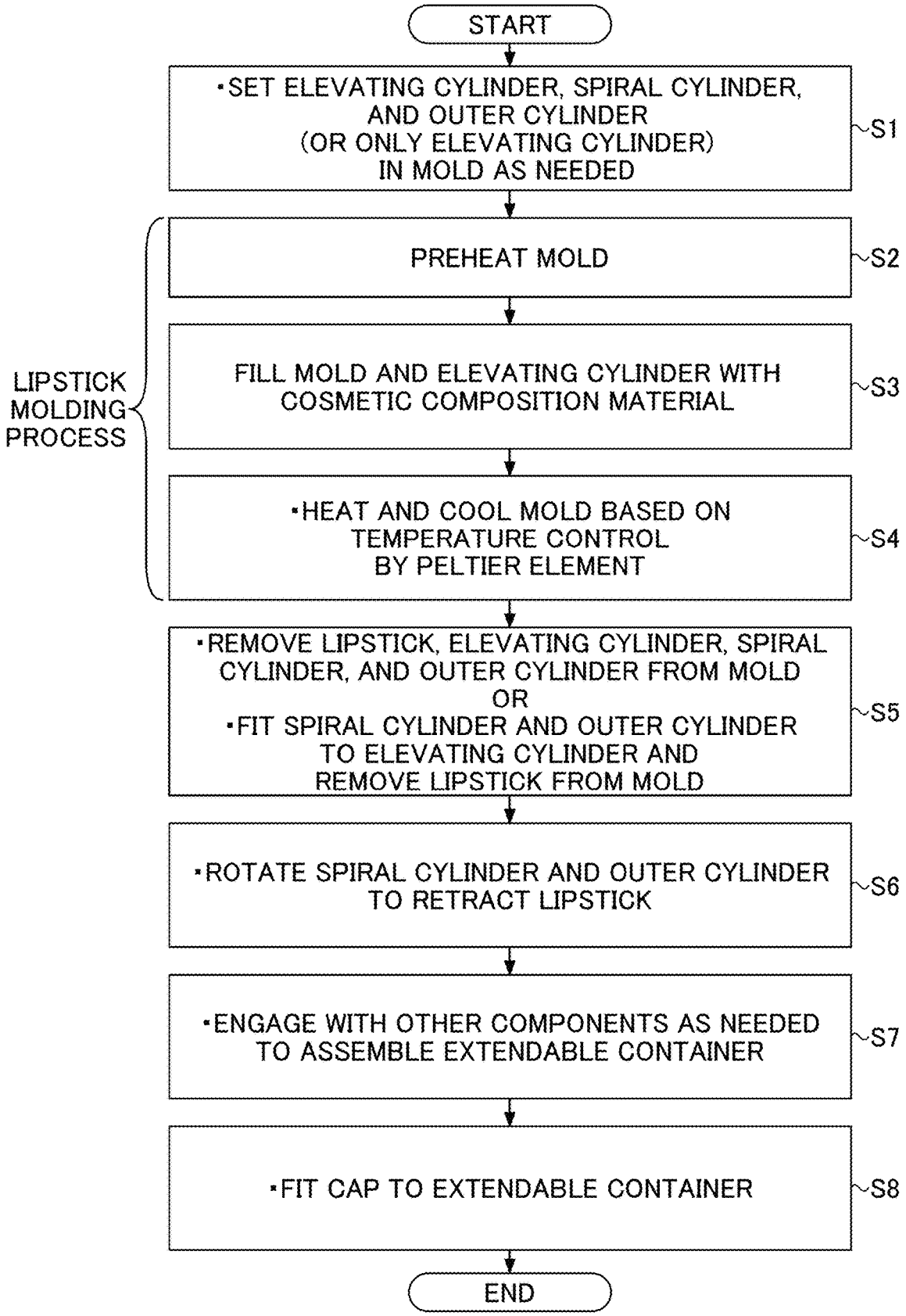
FIG. 9 is a flowchart illustrating the process for manufacturing an extendable-container-filled molded product by the back filling method of the disclosure.
Figure 10A:
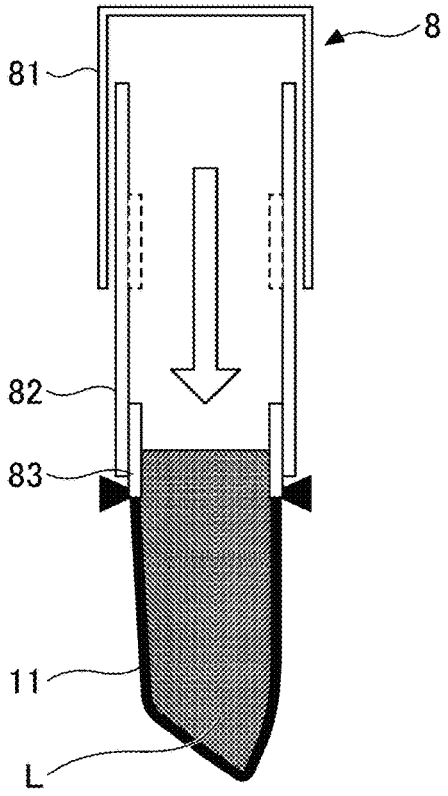
FIG. 10A is a cross-sectional view illustrating the position of an extendable cylinder in an extendable container at the time of molding in a back filling process.
Figure 10B:
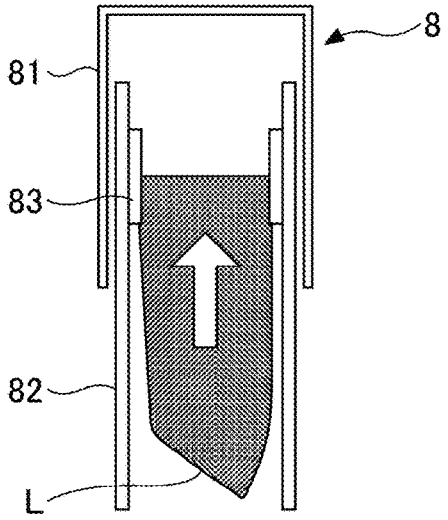
FIG. 10B is a cross-sectional view illustrating the position of the extendable cylinder in the extendable container when the extendable cylinder has been retracted in the back filling process.
Figure 10C:
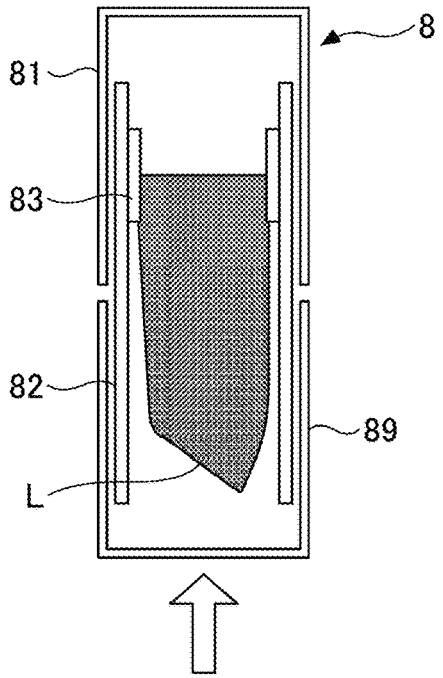
FIG. 10C is a cross-sectional view illustrating the position at which a cap is fitted to the extendable container in the back filling process.

FIG. 9 is a flowchart illustrating the procedure of the manufacturing process of a lipstick-containing extendable container of the disclosure. The manufacturing process here illustrates the procedure of the back filling method. FIGS. 10A to 10C are cross-sectional views each illustrating the position of an extendable cylinder in the extendable container during the back filling process. FIG. 10A is a view illustrating the position of the extendable cylinder in the extendable container during molding. FIG. 10B is a view illustrating the position when the extendable cylinder has been retracted. FIG. 10C is a view illustrating the position when a cap has been fitted.

The procedure of the back filling method of the disclosure will be described with reference to FIGS. 3A to 3E, FIG. 9, and FIGS. 10A to 10C.

In step S1, the elevating cylinder (middle tray cylinder) 83, the spiral cylinder 82, and the outer cylinder (skirt cylinder) 81 are set in the mold 1 (that is, the state illustrated in FIG. 3A is created). Alternatively, only the elevating cylinder 83 is set in the mold.

In step S2, the mold 1 is preheated (see FIG. 3A).

In step S3, the mold 1 and the elevating cylinder 83 are filled with the lipstick composition (cosmetic composition) (see FIG. 3B).

In step S4, temperature adjustment by the Peltier element 3 is performed to heat and cool the mold (see FIG. 3C and FIG. 3D).

Steps S3 and S4 are the lipstick molding processes performed in the lipstick molding apparatus 100.

In step S5, the molded lipstick L, the elevating cylinder 83, the spiral cylinder 82, and the outer cylinder 81 are removed from the mold 1. That is, mold removal is performed. Alternatively, in a case where only the elevating cylinder 83 has been set in the mold 1, the spiral cylinder 82 and the outer cylinder 81 are fitted to the elevating cylinder 83 at this step, and the molded lipstick L and the elevating cylinder 83 are removed from the mold. After step S5, an inspection process for inspecting the molded lipstick may also be provided.

That is, as illustrated in FIG. 10A, in step S1 to S5, the lipstick is molded in a state where the elevating cylinder 83 of the spiral cylinder 82 is extended in the extendable container 8.

In step S6, the spiral cylinder (sleeve) 82 and the outer cylinder 81 are rotated relative to each other to retract the lipstick, together with the elevating cylinder 83, to a position where at least the tip of the molded lipstick does not protrude from the upper end of the spiral cylinder 82 (see FIG. 10B).

In step S7, the elevating cylinder 83, the spiral cylinder 82, and the outer cylinder 81 are engaged with other components to assemble the extendable container 8. In the back filling method, this process can be omitted in a case where the cosmetic composition L is poured in a state where all of the components of the extendable container 8 has been assembled.

In step S8, a cap 89 is fitted to the extendable container 8, thus ending the manufacturing process (see FIG. 10C).

As illustrated in FIG. 9 and FIGS. 10A to 10C, in this embodiment employing the back filling method, the lipstick can be molded by connecting a portion of the extendable container and the molds. Hence, the lipstick can be manufactured without much change from a general method of manufacturing a lipstick-containing extendable container other than the process of temperature control after the lipstick filling process.

First Configuration Example of Metal Mold of First Embodiment

Figure 11A:
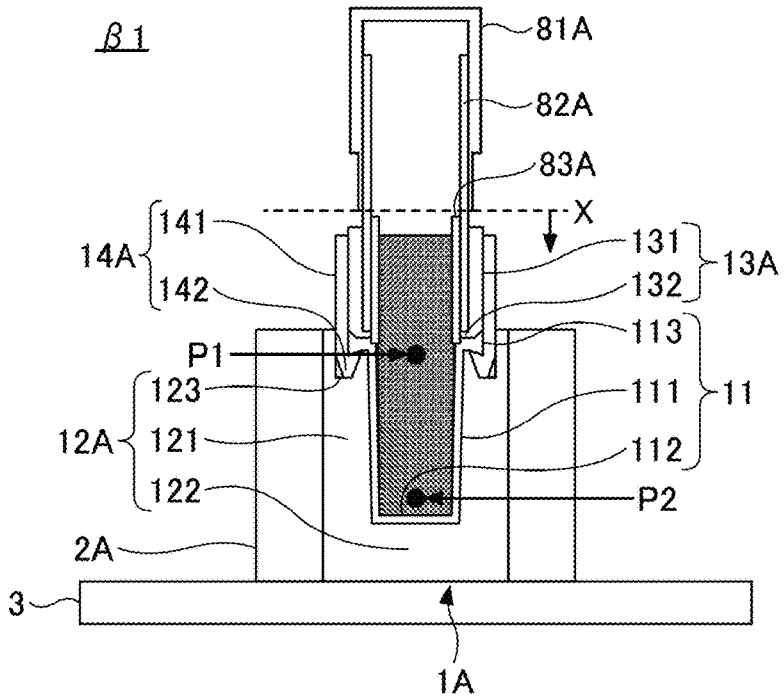
FIG. 11A is a cross-sectional view illustrating an independent molding unit that includes a metal mold according to the first configuration example of the first embodiment.
Figure 11B:
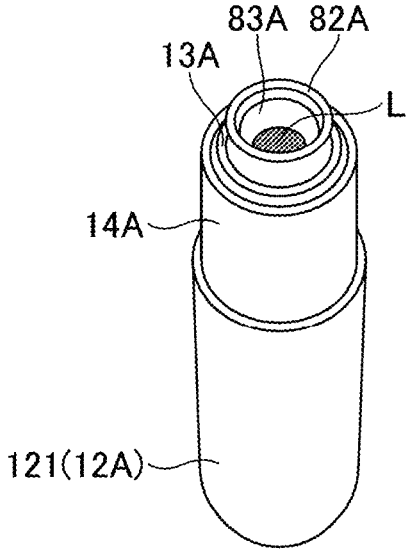
FIG. 11B is a top perspective view illustrating the independent molding unit 1 of FIG. 11A without an outer cylinder 2A and a Peltier element 3.
Figure 11C:
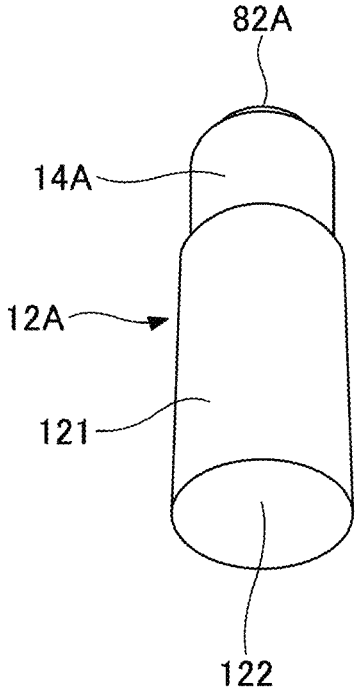
FIG. 11C is a bottom perspective view of FIG. 11B.

FIGS. 11A to 11C are views for explaining an independent molding unit β1 that includes a metal mold according to the first configuration example of the first embodiment. FIG. 11A is a cross-sectional view of the independent molding unit β1 according to the first configuration example. FIG. 11B is a top perspective view illustrating the independent molding unit β1 of FIG. 11A without an outer cylinder 2A and the Peltier element 3. FIG. 11C is a bottom perspective view of FIG. 11B.

In the embodiment, each mold 1A is composed of the rubber mold 11, a metal mold 12A, and holders 13A and 14A as in FIG. 7.

In this configuration example, linear portions 131 and 141, which form the upper sides of the holders 13A and 14A, respectively, do not contact the outer cylinder 2A. Retaining portions 132 and 142, which bend inward so as to have a hook-shaped cross section, are formed at the lower ends of the holders 13A and 14A, respectively. In the embodiment, the shapes of the outer cylinder 2A and the holders 13A and 14A are different from those illustrated in FIG. 7.

Note that the examples illustrated in FIGS. 11A to 11C and in subsequent FIGS. 12A to 12C and FIGS. 13A to 13C have a common configuration with respect to the outer cylinder 2A and the holders 13A and 14A other than the shapes of the metal molds 12A and 12B. However, these configurations may be combined with the configurations of the outer cylinder 2 and the holders 13 and 14 illustrated in FIG. 7.

The rubber mold 11 includes a side surface 111, a bottom surface 112, a flange 113, and an annular raised protrusion 114. The side surface 111 and the bottom surface 112 form, as a bottomed cylinder, a portion in which the lipstick cosmetic composition is directly filled. The flange 113 extends outward from the upper end of the side surface 111. The annular raised protrusion 114 extends upward or downward from the outer end portion of the flange 113. Note that the configuration of the inner rubber mold 11 is the same in FIG. 7, FIGS. 11A to 11C, FIGS. 12A to 12C, and FIGS. 13A to 13C.

In this configuration example, the metal mold 12A includes a side surface 121, a bottom surface 122, and an upper annular groove 123. In this configuration, since the lower surface of the bottom surface 122 of the metal mold 12A contacts the Peltier element 3, the heat is directly transferred between the Peltier element 3 and the bottom surface 122 when heating or cooling is performed. Further, the side surface 121 of the metal mold 12A surrounds the side surface 111 of the rubber mold 11. Hence, in this configuration example, the lipstick composition L is heated and cooled (bottom heating and bottom cooling) from bottom to top by the transfer of heat from the Peltier element 3 below to heat and cool the rubber mold 11 whose bottom surface is in contact with the Peltier element 3 from the bottom.

Note that in FIGS. 11A and 12A, P1 and P2 indicate an upper end position and a lower end position, respectively, of the lipstick when temperature measurement is performed as described later in FIGS. 23A and 23B.

Second Configuration Example of Metal Mold of First Embodiment

Figure 12A:
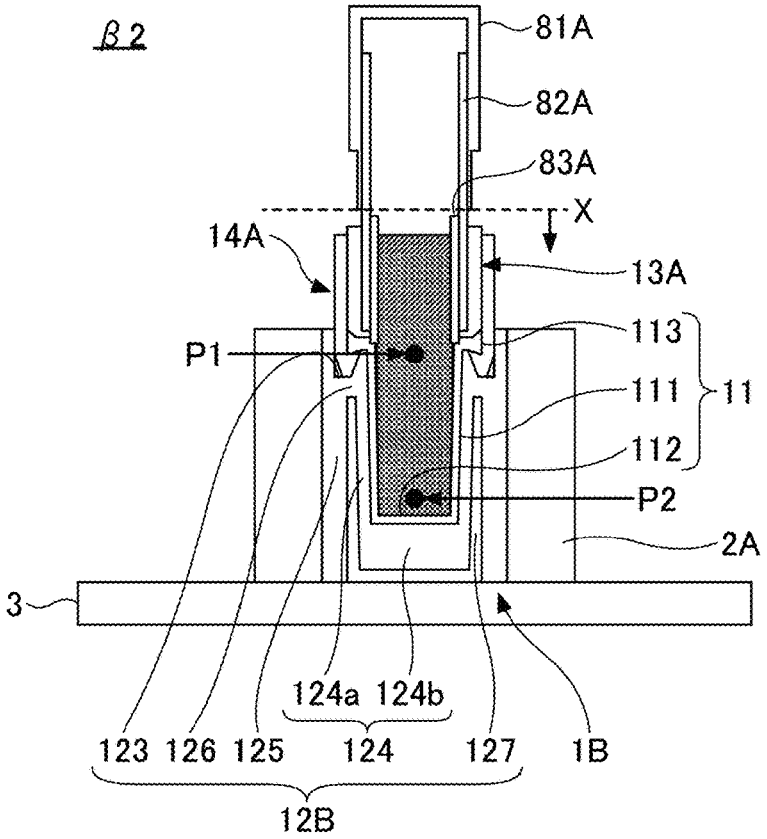
FIG. 12A is a cross-sectional view of an independent molding unit that includes a metal mold according to the second configuration example of the first embodiment.
Figure 12B:
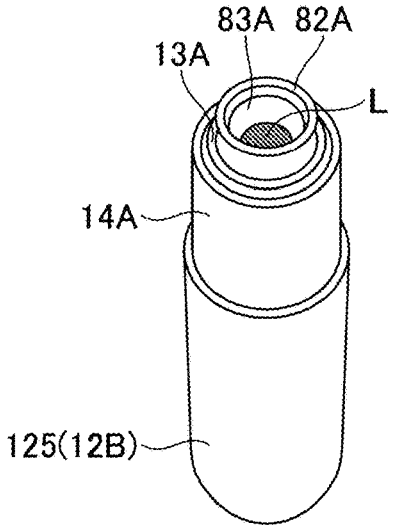
FIG. 12B is a top perspective view of the independent molding unit β1 of FIG. 12A without the outer cylinder 2A and the Peltier element 3.
Figure 12C:
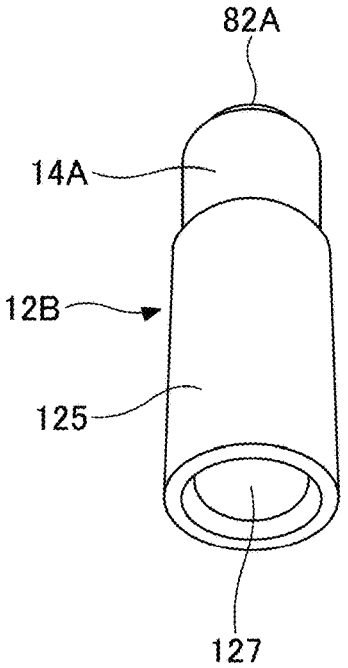
FIG. 12C is a bottom perspective view of FIG. 12B.

FIGS. 12A to 12C are views for explaining an independent molding unit β2 including a metal mold according to the second configuration example of the first embodiment. FIG. 12A is a cross-sectional view of the independent molding unit β2 according to the second configuration example. FIG. 12B is a top perspective view illustrating the independent molding unit β2 of FIG. 12A without the outer cylinder 2A and the Peltier element 3. FIG. 12C is a bottom perspective view of FIG. 12B.

In this configuration example, the metal mold 12B has a double cylinder configuration including a holder cylinder 124, an outer heat-transfer cylinder 125, and a connecting portion 126.

The holder cylinder 124 is a bottomed cylinder including a side surface 124*a* and a bottom surface 124*b*, and surrounds the side surface 111 and the bottom surface 112 of the rubber mold 11. The holder cylinder 124 is shorter than the outer heat-transfer cylinder 125 such that the lower surface of the bottom surface 124*b* is not contact with the Peltier element 3, thus providing a configuration in which the bottom surface 124*b* of the holder cylinder 124 does not directly contact the Peltier element 3. That is, the center of the lower portion of the metal mold 12B does not directly contact the Peltier element 3 due to the formation of a lower bottomed-cylindrical space 127, which rises from the bottom, between the holder cylinder 124 and the outer heat-transfer cylinder 125.

In this configuration, since the side surface 124*a* of the holder cylinder 124 of the metal mold 12B surrounds the side surface 111 of the rubber mold 11, heat transfer for the heating and the cooling also occurs from the peripheral surface direction of the lipstick, thus causing lateral heating and lateral cooling to be performed.

The outer heat-transfer cylinder 125 is a cylinder portion provided spaced part from the outer surface of the holder cylinder 124, and surrounds holder cylinder 124. The lower end of the outer heat-transfer cylinder 125 contacts the Peltier element 3. The outer circumference of the outer heat-transfer cylinder 125 contacts the inner circumference of the outer cylinder 2A.

The connecting portion 126 connects the vicinity of the upper end of the holder cylinder 124 with the vicinity of the upper end of the outer heat-transfer cylinder 125.

In this configuration, the lower end of the holder cylinder 124 for holding the lipstick does not contact the Peltier element 3. Hence, the heat from the Peltier element 3 is propagated through the lower space provided by the lower bottomed-cylindrical space 127 to indirectly cool the lower end of the holder cylinder 124. Further, the heat transferred from the Peltier element 3 is transferred from top to bottom of the holder cylinder 124 through the outer heat-transfer cylinder 125 and the upper end of the connecting portion 126. Hence, the portion of the elevating cylinder 83 that holds the lipstick can be rapidly cooled before the tip of the lipstick. Therefore, in this configuration example, the heat from the Peltier element 3 below is transferred to heat and cool the side surface 111 of the rubber mold 11 from top to bottom based on the side surface 124*a* of the holder cylinder 124 surrounding the peripheral surface of the mold, without the center of the bottom surface of the rubber mold being in contact with the Peltier element 3. As a result, the lipstick composition L is heated and cooled from the side surface (lateral heating and lateral heating).

Third Configuration Example of Metal Mold of First Embodiment

Figure 13A:
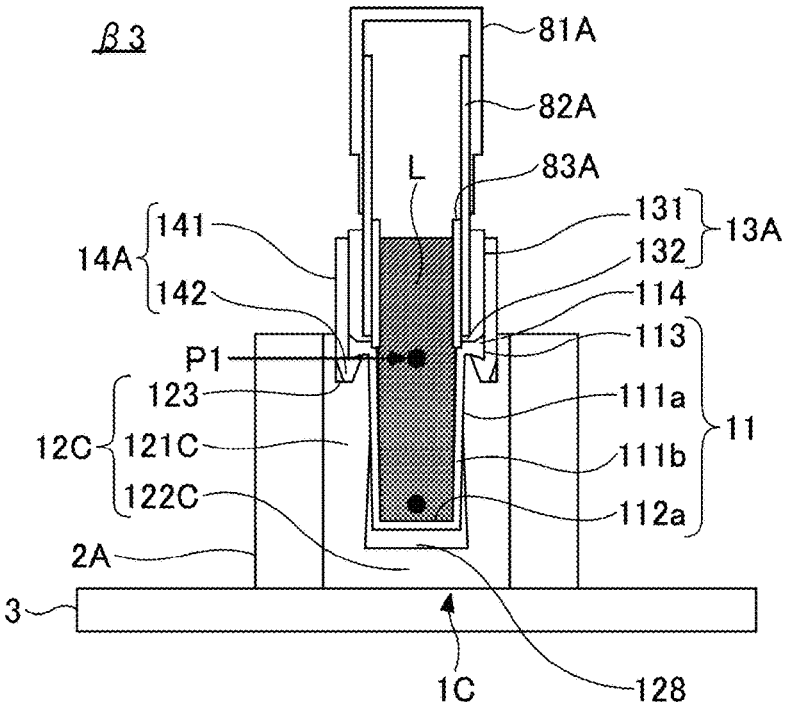
FIG. 13A is a cross-sectional view of an independent molding unit that includes a metal mold according to the third configuration example of the first embodiment.
Figure 13B:
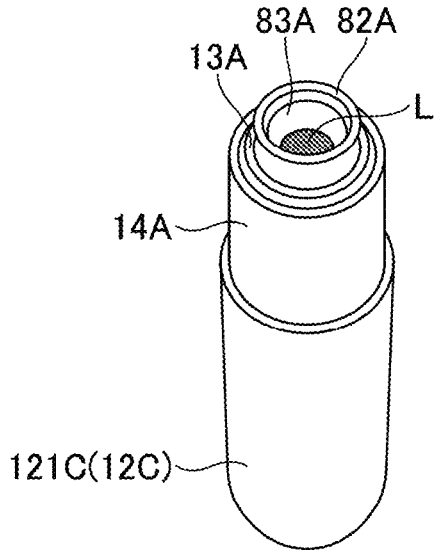
FIG. 13B is a top perspective view of the independent molding unit β1 of FIG. 13A without the outer cylinder 2A and the Peltier element 3.
Figure 13C:
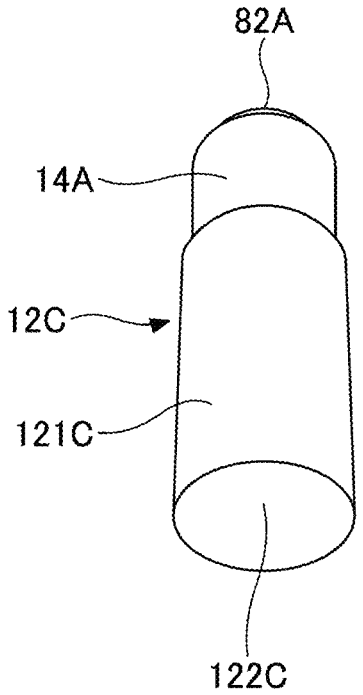
FIG. 13C is a bottom perspective view of FIG. 13B.

FIG. 13A is a view for explaining an independent molding unit β3 including a metal mold according to the third configuration example of the first embodiment. FIG. 13A is a cross-sectional view of the independent molding unit β3 according to the third configuration example. FIG. 13B is a top perspective view illustrating the independent molding unit β3 of FIG. 13A without the outer cylinder 2A and the Peltier element 3. FIG. 13C is a bottom perspective view of FIG. 13B.

In this configuration example, a metal mold 12C has a cylindrical shape with a bottom portion, and includes a side surface 121C, a bottom surface 122C, and the upper annular groove 123 in a similar manner to the metal mold 12A. However, in this configuration example, the bottom surface 122C is thinner than the corresponding bottom surface in FIG. 11A, and thickness of the lower portion of the inner surface of the side surface 121C has been reduced such that the lower portion extends more relative to the corresponding portion in FIG. 11A. As a result, an upper bottomed-cylindrical space 128 that serves as a gap between the bottom surface 122C and the rubber mold 11 is formed above the bottom surface 122C. Hence, the side surface 121C of the metal mold 12C contacts a side-surface upper portion 111*a* of the side surface of the rubber mold 11, but does not contact a side-surface lower portion 111*b*. Furthermore, the bottom surface 122C does not contact the bottom surface 112 of the rubber mold 11.

Since the contact area of the bottom surface 122C of the metal mold 12C and the Peltier element 3 is larger relative to the metal mold 12B, this configuration has superior heat transfer efficiency. Also, since the bottom surface 112 of the rubber mold 11 does not contact a metal mold 1C, lateral heating and lateral cooling are performed by heating and cooling the side-surface upper portion 111*a* of the rubber mold 11 that is in contact with the metal mold 12C.

In this configuration, as the lower end of the rubber mold 11 that holds the lipstick does not contact the bottom surface 122C of the metal mold 12C, heating and cooling are not performed directly from below. Instead, the heat from the Peltier element 3 is propagated through the metal mold 12C and the upper bottomed-cylindrical space 128 to indirectly heat and cool from the lower end of the rubber mold 11.

Since the thermal conductivity of air is very poor, in this configuration, rapid cooling can be performed by using heat transfer from the side-surface upper portion 111*a*, which is in contact with the side surface 121C, instead of heat transfer from the lower end portion to cool the portion of an elevating cylinder 83A, which holds the side surface of the lipstick, ahead of the tip of the lipstick on the lower side. Thus, in this configuration example, temperature is transferred from the Peltier element 3 from below to perform heating and cooling from the side-surface upper portion 111*a* of the rubber mold 11 without the bottom surface 112 and the side-surface lower portion 111*b* of the rubber mold 11 being in contact with the metal mold 12C. As a result, the lipstick composition L is heated and cooled from the side surface (lateral heating and lateral heating).

<Temperature Distribution of Lateral Cooling>

Figure 14A:
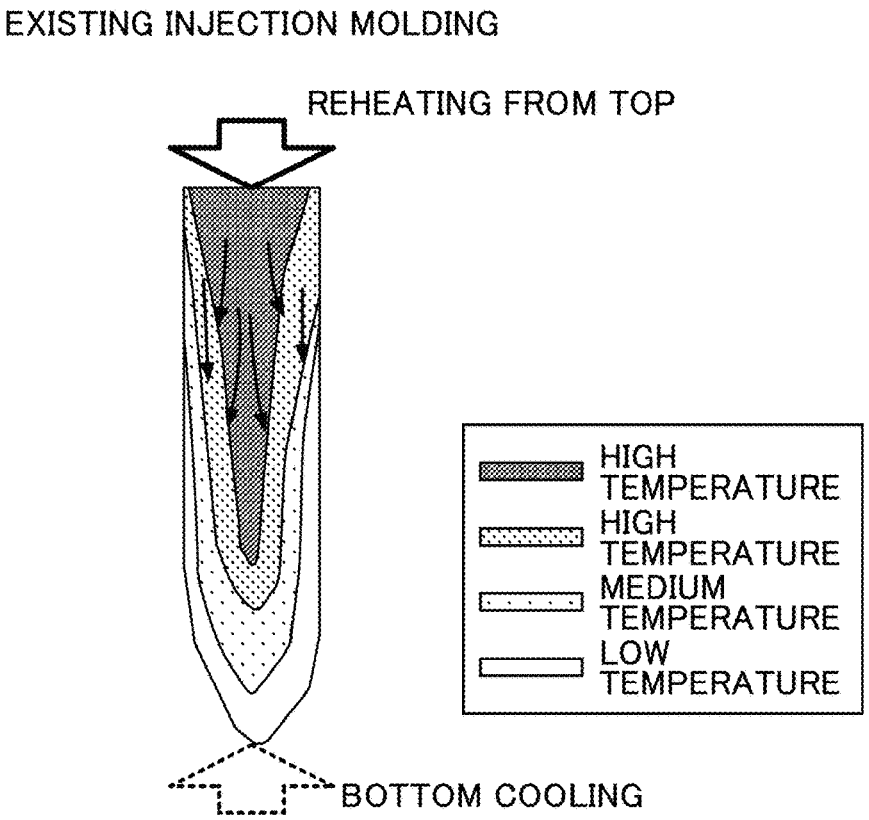
FIG. 14A is a view illustrating the temperature distribution of heat during bottom cooling.
Figure 14B:
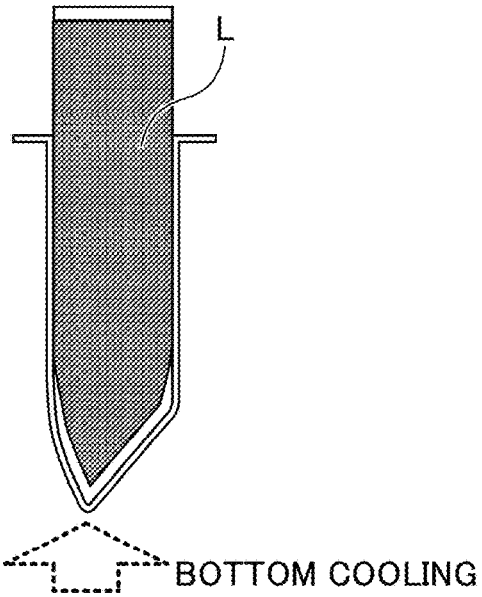
FIG. 14B is a schematic view illustrating the state of a lipstick formed by bottom cooling in a metal mold.
Figure 14C:
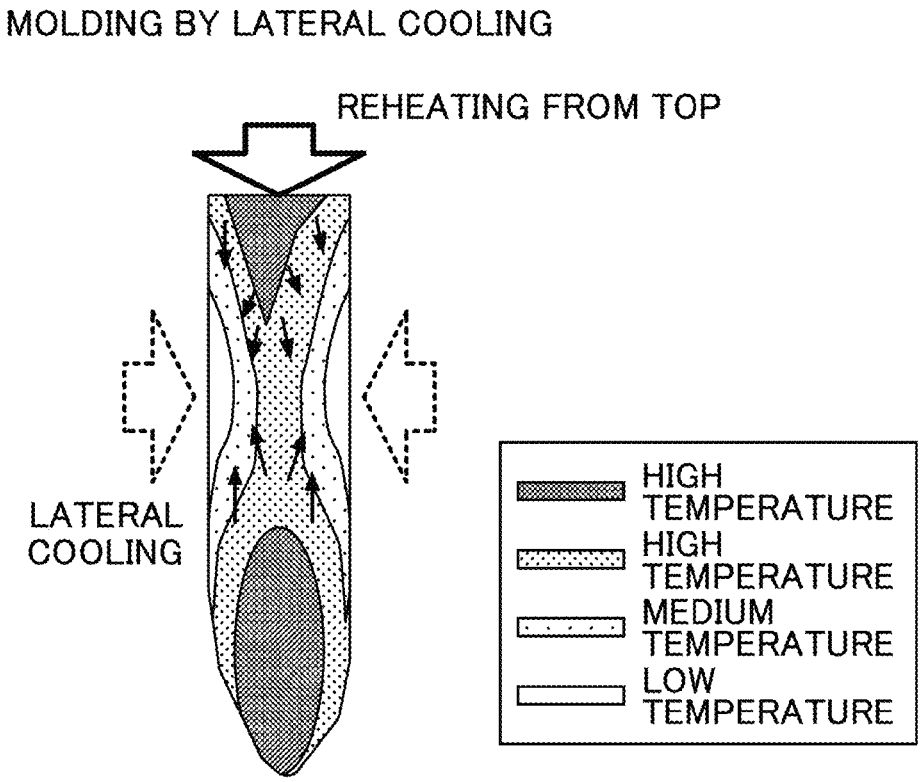
FIG. 14C is a view illustrating the temperature distribution of heat during lateral cooling.
Figure 14D:
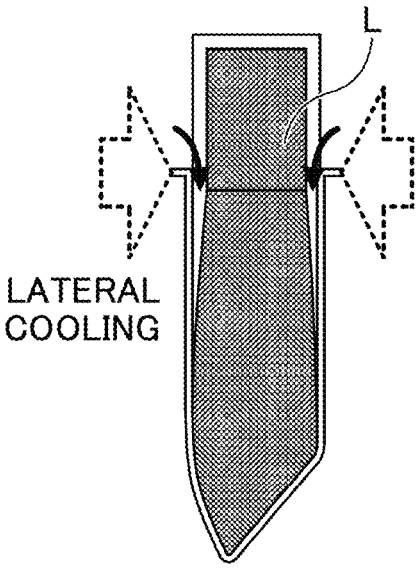
FIG. 14D is a schematic view illustrating the state of a lipstick formed by lateral cooling in a metal mold.

The temperature distribution and the direction of shrinkage regarding bottom cooling and lateral cooling will be described with reference to FIGS. 14A to 14D. FIG. 14A is a view illustrating the temperature distribution of the lipstick composition in a case where heating is performed using warm air from above and cooling is performed from the bottom in a general molding process procedure of FIG. 1. FIG. 14B is a view illustrating the direction of shrinkage of the lipstick molded in FIG. 14A. FIG. 14C is a view illustrating the temperature distribution of the lipstick composition in a case where heating is performed from above using warm air and heating is performed from the side. FIG. 14D is a view illustrating the direction of shrinkage of the lipstick molded in FIG. 14C.

Each dotted arrow in FIGS. 14B and 14D indicate the direction in which the lipstick L shrinks due to cooling. In a case where cooling is performed from below as illustrated in FIG. 14A, a shrink hole is generated on the upper end portion due to the lipstick composition shrinking in a downward direction as illustrated in FIG. 14B.

In contrast, in a case where cooling is performed from the side as illustrated in FIG. 14C, the lipstick composition is first cooled and solidified from the side. Hence, the internal strain in the vertical direction is reduced, and the shrink hole on the upper end portion can be reduced. Also, since the horizontal direction is shorter than the vertical direction, the temperature difference in the upper and lower temperature directions of the lipstick is reduced, and the internal strain in the horizontal direction can be reduced.

The elevating cylinder, which serves as a middle tray that secures the lipstick to the container is present on the side portion. Rapidly cooling the side portion allows the crystal structure of the wax to be made finer. Thus, compared to FIG. 14A, the overall strength of the lipstick can be increased by reducing the temperature difference in the vertical direction of the lipstick composition. Therefore, it is less likely for shrink holes to occur.

Furthermore, since solidification occurs from the side in lateral cooling, air enters more easily after the molding process as illustrated in FIG. 14D. Therefore, during the mold removal process after the molding process, it is possible to expect an effect that reduces stress on the solidified molded product when air is injected during mold removal, thus enabling the solidified molded product to be removed more easily.

(Experiment Examples)

The inventors of this application performed experiments on molding by bottom cooling and lateral cooling to demonstrate the temperature distribution and the tendency of shrinkage as illustrated in FIGS. 14A to 14D.

FIG. 15 is a table illustrating the results of experiments on shrink holes in lipstick molding with bottom cooling and lateral cooling by air blowing according to the comparative example. Six lipsticks denoted as No. 1 to No. 6 were filled at the same filling temperature and cooling temperature but cooled by different cooling methods.

In FIG. 15, three lipsticks No. 1 to No. 3 are examples in which temperature control was performed by applying warm air and cold air from the bottom, and three lipsticks No. 4 to No. 6 are examples in which temperature control was performed by applying warm air and cold air from the side as examples simulating the temperature control of the disclosure.

In FIG. 15, "HIGH" to "LOW" in "REHEATING TEMPERATURE" indicate where the temperature of warm air falls on a scale of high to low. Further, in "DEGREE OF SHRINK HOLE" of FIG. 15, ○ indicates the absence of a hole, Δ indicates the presence of an unproblematic hole with a diameter of 2 to 3 mm, and x indicates the presence of a large hole with a diameter of 4 mm or more.

In general, a shrink hole forms more easily as the reheating temperature decreases. As indicated by lipstick No. 6, as the reheating temperature (temperature for heating of the lipstick base) decreases, there is more apparent reduction in the shrink hole when side cooling is performed compared to when bottom cooling is performed as in the case of lipstick No. 3.

FIG. 16 is a table illustrating the results of experiments on the hardness and breakage resistance in lipstick molding with bottom cooling and lateral cooling by air blowing according to the comparative example. Three lipsticks No. 7 to No. 9 are examples in which temperature control was performed by applying warm air and cold air from the bottom, and three lipsticks No. 10 to No. 12 are examples in which temperature control was performed by applying warm air and cold air from the side as examples simulating the temperature control of the disclosure.

In FIG. 16, breakage resistance was determined by performing a contact friction test to evaluate the breakage resistance of the molded lipstick. ○ indicates a lipstick that did not break under common conditions, and x indicates a lipstick that broke under common conditions. In addition, variation in hardness is indicated by a rate obtained by dividing the value of the hardness of the tip portion by the value of the hardness of the base portion.

As illustrated in FIG. 16, lipsticks were filled under the same filling and cooling temperatures, but underwent cooling by different cooling methods. Lipsticks (No. 10 to No. 12) that underwent lateral cooling resulted in less variation in hardness overall than lipstick that underwent bottom cooling.

In particular, when compared with lipstick No. 9 that has been molded under the same conditions other than the cooling method, it can be observed that the breakage resistance of lipstick No. 12, in which variation was reduced in particular, has improved remarkably.

The experiments of FIGS. 15 and 16 illustrate that, as assumed in FIGS. 14A to 14D, the expected effects of lateral cooling include (1) shrink hole reduction and (2) good breakage resistance. The good breakage resistance is due to a reduction in variation in hardness as a result of solidification occurring from the base portion of the lipstick, which contrasts with the conventional method of bottom cooling in which solidification occurs from the lipstick tip portion.

<About Cooling Temperature>

FIG. 17 illustrates a table indicating the characteristics of lipsticks when rapid cooling and slow cooling are performed. As illustrated in FIG. 17, in general, hardness decreases in a case where the strain is large and the size of crystals is large. In contrast, hardness increases in a case where the strain is small and the size of crystals is small.

Hence, in terms of the process, the strain increases if rapid cooling is performed to minimize the size of the crystals, and the size of crystals increases if slow cooling is performed to reduce to minimize the strain.

Therefore, a key aspect of temperature control concerns how these opposing phenomena can be optimized. That is, it is preferable to optimize the temperature control process by determining which temperature range should be rapidly cooled and which temperature range should be slowly cooled.

In this disclosure, since temperature control is performed using a Peltier element, temperature control can be performed more freely, without having to add devices or change the arrangement of the devices, than in a case where the temperature control is performed using warm air and cold air.

<Optimization of Cooling Temperature>

Therefore, the inventors of the application performed experiments to compare crystals under two types of temperature transition to optimize the temperature control process.

Figure 18:
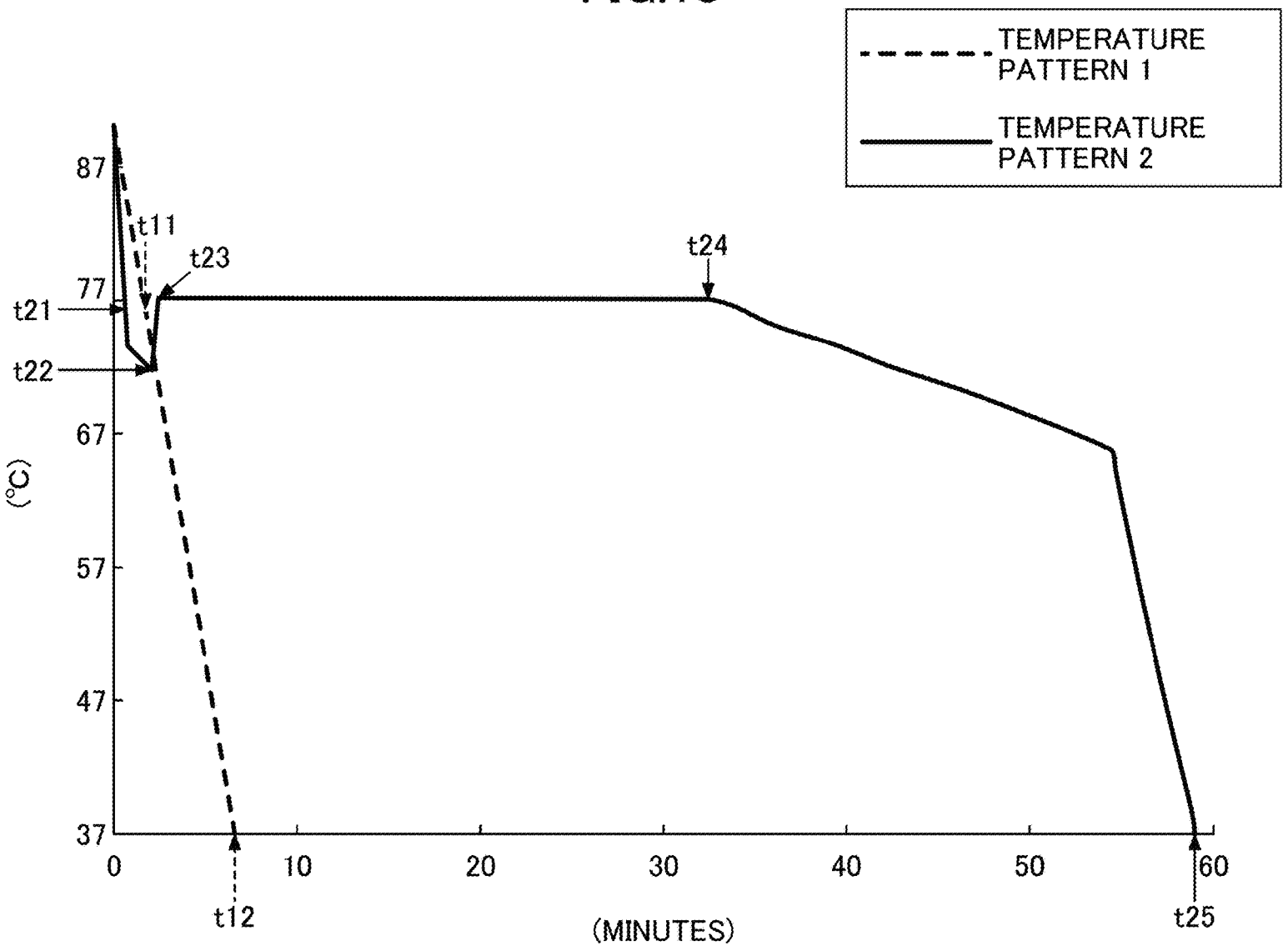
FIG. 18 is a graph illustrating the temperature transition in the experiment of temperature pattern 1 in which rapid cooling is performed and in the experiment of temperature pattern 2 in which slow cooling is performed.

FIG. 18 is a graph illustrating the temperature transition in the experiment of temperature pattern 1 in which rapid cooling is performed and in the experiment of temperature pattern 2 in which slow cooling is performed. In FIG. 18, temperature pattern 1 is a temperature pattern in which rapid cooling is performed from the start till the end of the cooling process, and temperature pattern 2 is a temperature pattern in which rapid cooling is performed from the start to the middle of the cooling process, then slow cooling is performed after heating is performed temporarily, and rapid cooling is subsequently performed again.

Figure 19:
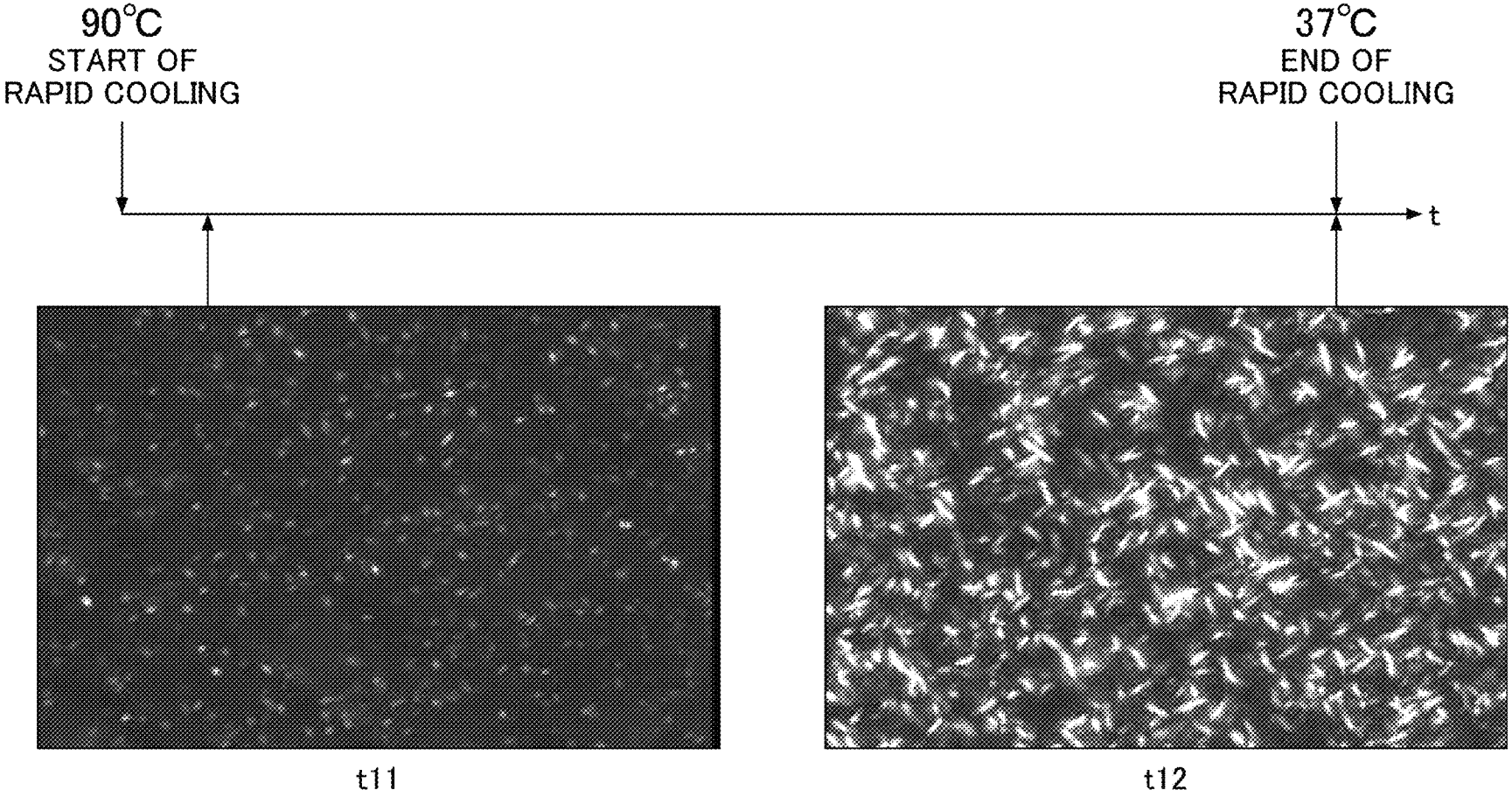
FIG. 19 is a view illustrating micrographs of lipstick crystals obtained in temperature pattern 1 of rapid cooling in FIG. 18.

FIG. 19 is a view illustrating micrographs of lipstick crystals obtained in temperature pattern 1 of rapid cooling in FIG. 18. In FIG. 19, the image at t11 illustrates the state of crystals at 76° C. during rapid cooling, and the image at t12 illustrates the state of crystals at 37° C. at the completion of rapid cooling. In the cooling pattern by uniform rapid cooling of temperature pattern 1, many crystal nuclei are formed by rapidly reducing the crystallization temperature as illustrated in the image at t12 of FIG. 19. Further, at the end of cooling as illustrated in the image at t12 of FIG. 19, since the crystals have grown based on the crystal nuclei formed immediately after the start of cooling illustrated in the image at t11 of FIG. 19, it can be understood that the size of the crystals are determined in accordance with the number of crystal nuclei.

Figure 20:
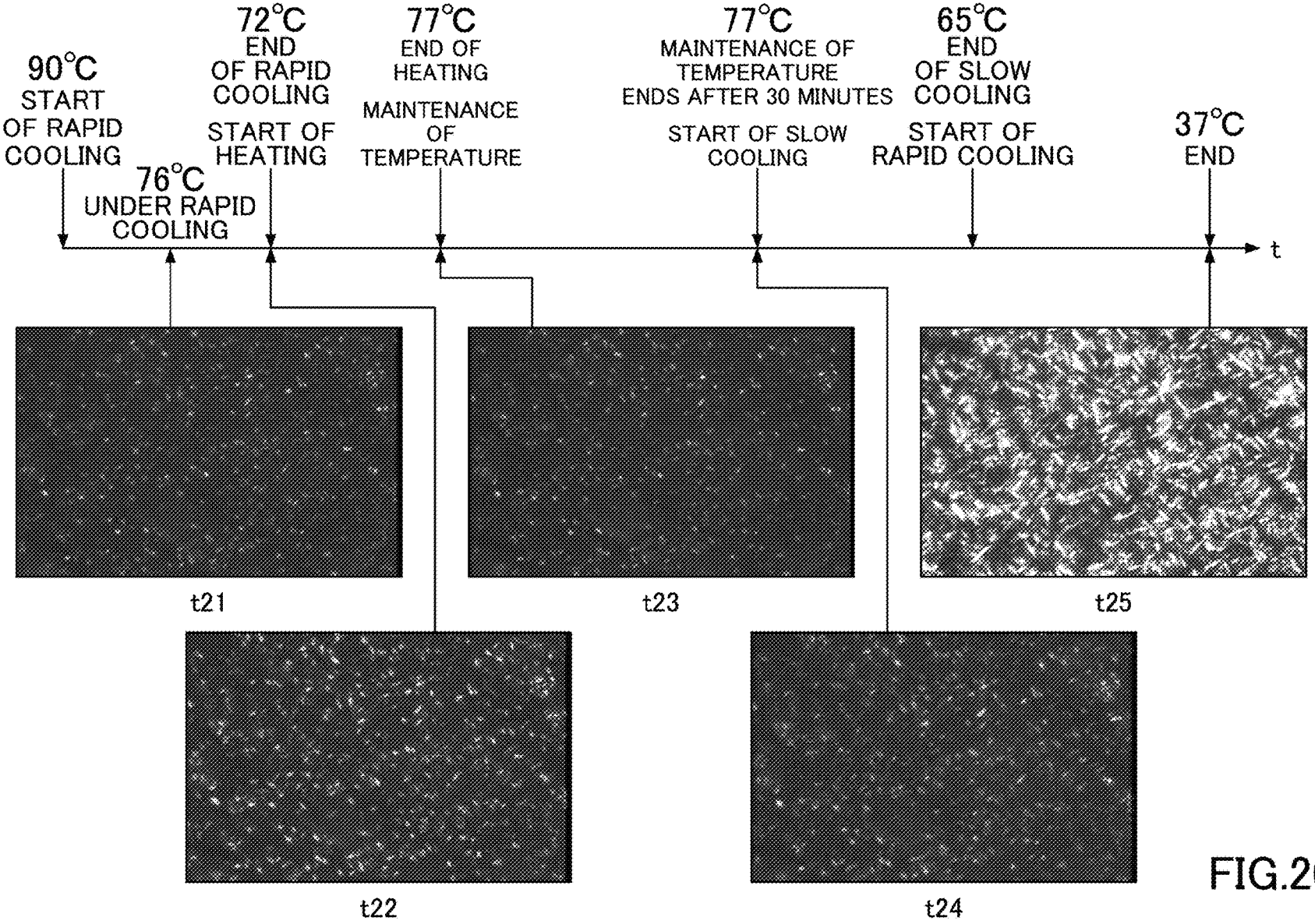
FIG. 20 is a view illustrating micrographs of lipstick crystals obtained in temperature pattern 2 of rapid cooling in FIG. 18.

FIG. 20 is a view illustrating micrographs of lipstick crystals obtained in the temperature pattern 2 of rapid cooling in FIG. 18. In temperature pattern 2 indicated in FIG. 18, the rapid cooling (first cooling) is performed to cool the lipstick from 90° C. to 72° C., the lipstick is heated up to 77° C. and maintained at 77° C. for minutes, then the lipstick is gradually cooled (slow cooling) to 60° C., and the lipstick is subsequently cooled (second rapid cooling) to 37° C. with the same temperature gradient as temperature pattern 1.

In FIG. 20, the image at t21 illustrates the state of crystals at 76° C. during rapid cooling, the image at t22 illustrates the state of crystals at 72° C. at the end of rapid cooling, the image at t23 illustrates the state of crystals at 77° C. immediately after heating, the image at t24 illustrates the state of crystals after the temperature has been maintained at 77° C. for 30 minutes after the heating process, and the image at t25 illustrate the state of crystals at 37° C. at the completion of slow cooling.

In the rapid cooling by temperature pattern 2, the crystallization region is rapidly cooled from t21 to t22 in FIGS. 18 and 20 to reduce the size of the crystals once to maintain the number of crystal nuclei. Subsequently, from t22 to t23, the temperature is raised to a temperature short of the complete melting temperature.

Next, from t23 to t24, the temperature is maintained at the temperature short of the complete melting temperature to make the temperature of the tip portion and the temperature of the base portion of the lipstick uniform without changing the crystal nuclei.

Furthermore, by performing rapid cooling again from t24 to t25 after slow cooling and uniform solidification have been performed, it can be seen that crystal growth occurs while the size of precipitated crystals remains small.

Comparing the image at t12 of FIG. 19 and the image at t25 of FIG. 20, it can be seen that, in cyclic cooling control based on temperature pattern 2, performing rapid cooling in the temperature range in which the crystal structures are formed allows the size of the crystals to remain unchanged even under the conditions in which uniform solidification is performed to minimize the strain. As a result, a rod-shaped cosmetic product that is difficult to break can be formed.

In this manner, in temperature pattern 2, the size of crystals can be reduced by performing rapid cooling in the temperature range in which the crystal structures are formed, and the strain can be eliminated by performing slow cooling after returning the lipstick to a temperature short of the complete melting temperature.

(Example of Temperature Control of Disclosure)

The temperature control of the disclosure that optimizes the temperature control process will be described next with reference to temperature pattern 2 of FIG. 18 and by using FIGS. 21 and 22.

Figure 21:
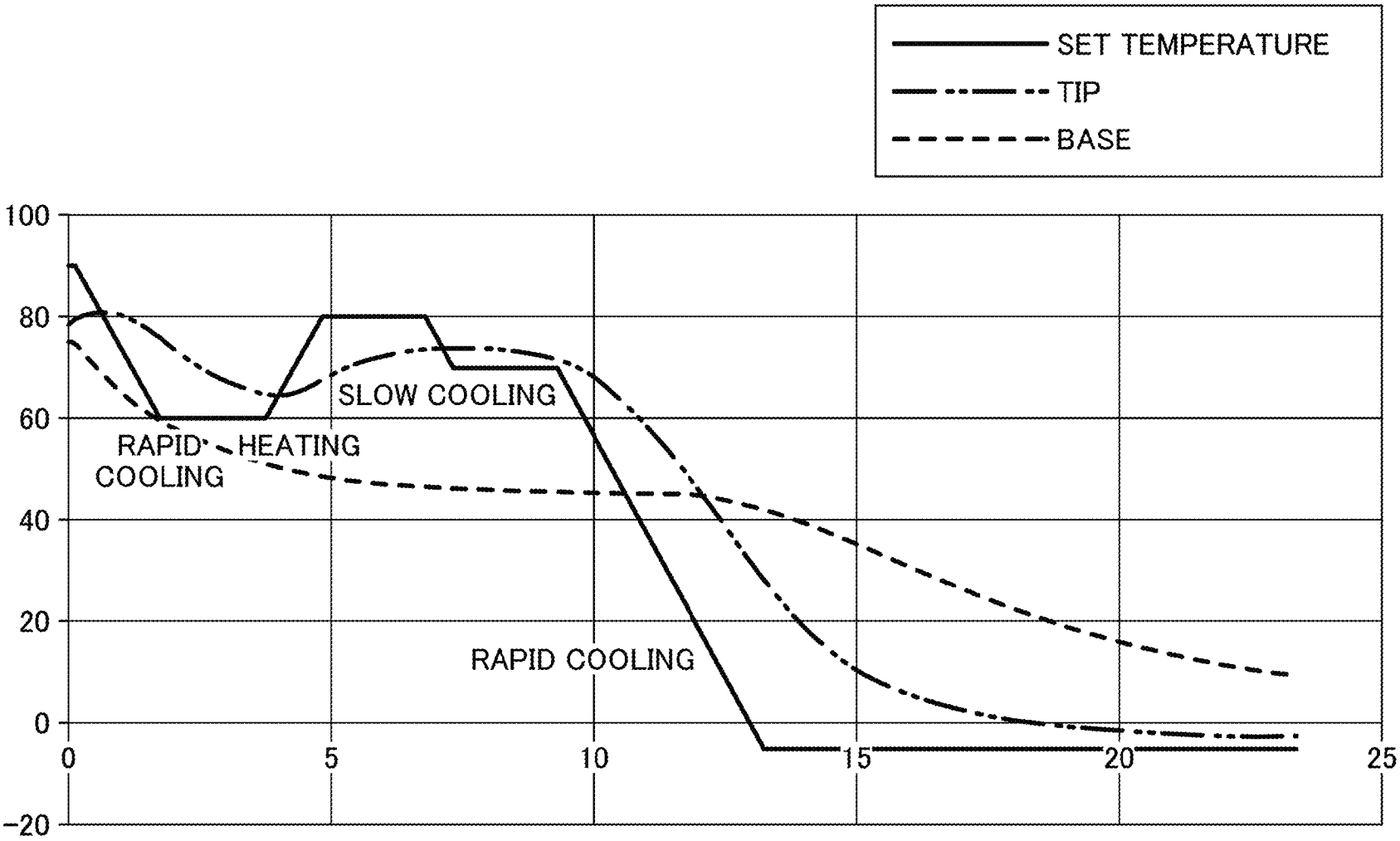
FIG. 21 is a graph illustrating the temperature transition observed at the tip and the base of a lipstick composition and the temperature setting example in cyclic cooling using the Peltier element of the disclosure.
Figure 22:
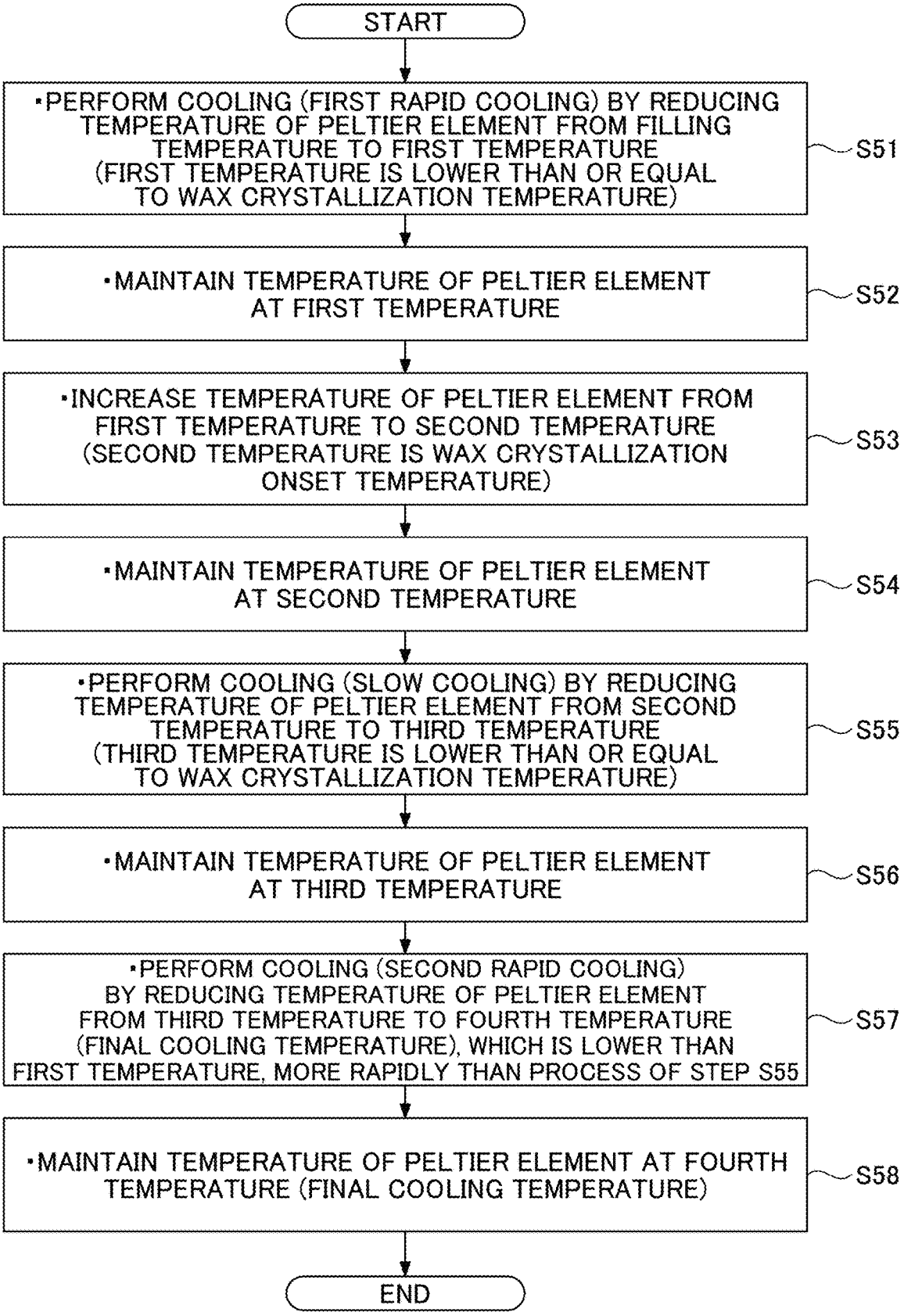
FIG. 22 is a flowchart illustrating the temperature control process during lipstick molding using the Peltier element of the disclosure.

FIG. 21 is a graph illustrating the temperature transition observed at the tip and the base of a lipstick composition and an example of the temperature setting of the cosmetic product in a case where temperature control by cyclic cooling is performed using the independent molding unit β1 according to the first configuration example of FIG. 11A. FIG. 22 is a flowchart illustrating the temperature control process during lipstick molding of the disclosure.

The procedure of the temperature control process for solidifying the cosmetic composition of the disclosure will be described with reference to FIGS. 21 and 22.

In step S51, the temperature of the Peltier element 3 is reduced from the filling temperature to the first temperature (first rapid cooling). The first temperature is set to a temperature lower than or equal to the wax crystallization temperature, that is, the temperature short of the complete melting temperature.

In step S52, the temperature of the Peltier element 3 is maintained at the first temperature for a predetermined period. The cooling performed in steps S51 and S52 is a process for temporarily cooling the melted material in the mold to the first temperature, which is a predetermined solidification temperature.

In step S53, the temperature of the Peltier element 3 is raised to a second temperature that is lower than the filling temperature.

In step S54, the temperature of the Peltier element 3 is maintained at the second temperature for a predetermined period. Steps S53 and S54 form a reheating process, and the second temperature is set to a temperature that will not cause the raw material to melt again, that is, the second temperature is set a wax crystallization onset temperature.

In step S55, the temperature of the Peltier element 3 is gradually reduced from the second temperature to a third temperature (slow cooling). The third temperature is set to a temperature lower than or equal to the wax crystallization temperature.

In step S56, the temperature of the Peltier element 3 is maintained at the third temperature for a predetermined period.

In step S57, the temperature of the Peltier element 3 is reduced from the third temperature to a final cooling temperature (second rapid cooling). The final cooling temperature is set to a temperature that can completely solidify the material for solidification.

In step S58, after the temperature of the Peltier element 3 is maintained at the final cooling temperature for a predetermined period, the process is ended.

Here, fine crystal nuclei can be generated by setting the first temperature to be lower than the crystallization temperature and performing rapid cooling.

In steps S55 to S57, cyclic cooling is performed by lowering the temperature from the second temperature to the final cooling temperature in a stepwise manner by interposing a period in which the third temperature, which is close to the second temperature, is maintained.

In the disclosure, since the temperature of the Peltier element that adjusts the temperature of the mold is directly adjusted, the heating and cooling processes can be increased without requiring additional special devices for heating and cooling.

The slow cooling time can be adjusted by performing cyclic cooling in such a stepwise manner.

Furthermore, as illustrated in the graph of the drawings, temperature adjustment of the lipstick composition by the Peltier element of the disclosure can be controlled according to the programmed operation, and the temperature of the tip portion and the temperature of the base portion of the lipstick can be changed in accordance with the set temperature of the Peltier element.

<Temperature Transition at Each Portion>

Figure 23A:
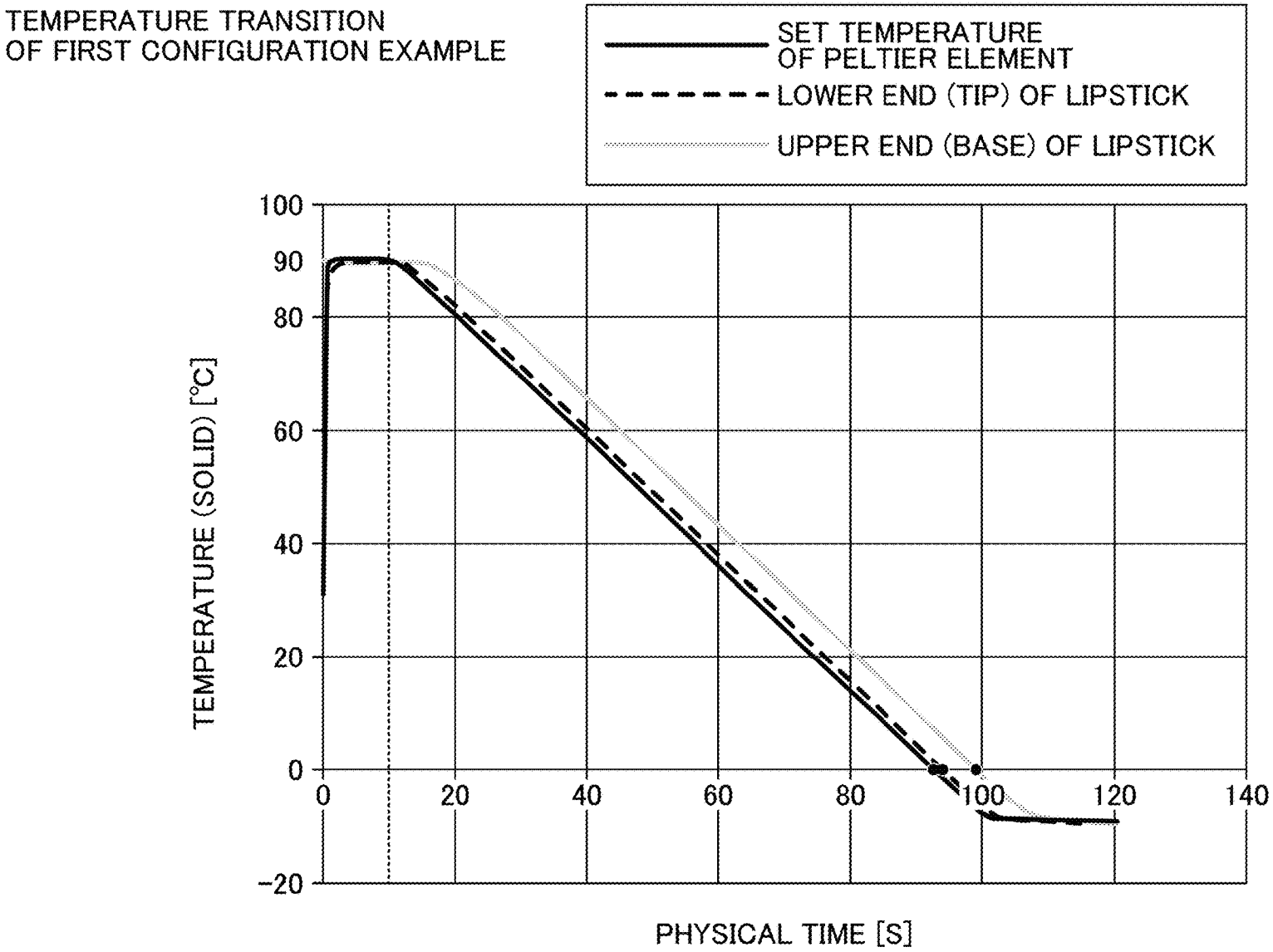
FIG. 23A is a graph illustrating changes in the temperature of a lipstick filled in the metal mold of the first configuration example of FIG. 11A.
Figure 23B:
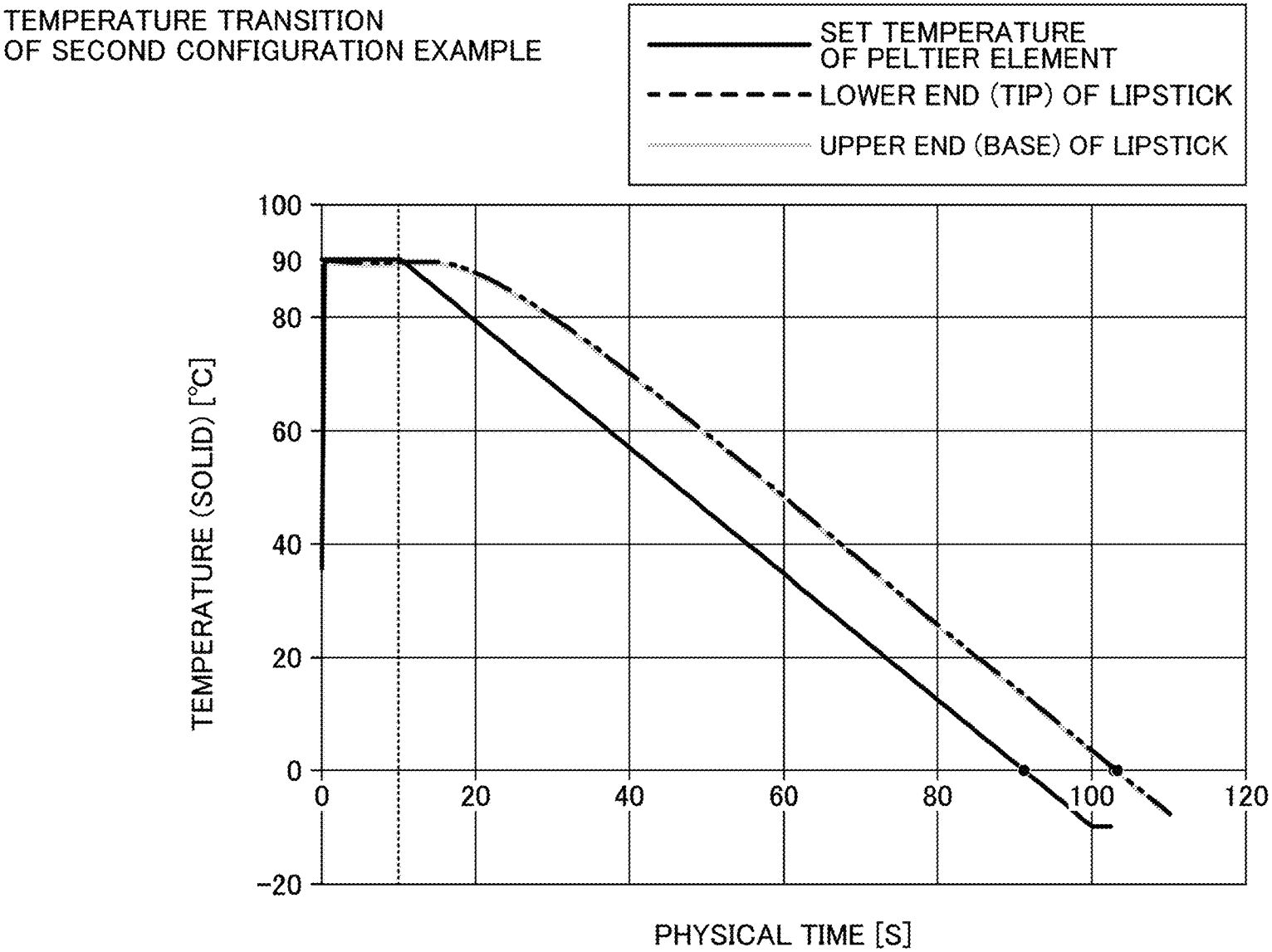
FIG. 23B is a graph illustrating changes in the temperature of a lipstick filled in the metal mold according to the second configuration example of FIG. 12A.

FIGS. 23A and 23B are graphs illustrating the temperature transition at each portion of the rod-shaped cosmetic product when temperature control is performed based on Peltier control according the first configuration example illustrated in FIG. 11 and the second configuration example illustrated in FIG. 12.

FIG. 23A is a graph illustrating the temperature transition in the first configuration example of FIG. 11, and FIG. 23B is a graph illustrating the temperature transition in the second configuration example of FIG. 12.

As the initial condition, the Peltier element 3 was set to 90° C. to heat the cosmetic composition L, the elevating cylinder 83, and the rubber mold 11 in advance so that their respective temperatures would reach 90° C. After 10 seconds have elapsed from the start, the temperature of the Peltier element 3 was dropped from 90° C. to −10° C. in 90 seconds. The solid line in FIGS. 23A and 23B indicate the transition of the set temperature of the Peltier element 3.

Here, the temperature of a position (position P1 in FIGS. 11A and 12A) that is 2 mm from the upper-end of the lipstick composition was measured as the upper end temperature of the lipstick composition, and the temperature of a position (position P2 in FIGS. 11A and 12A) that is 2 mm from the lower end of the lipstick composition was measured as the lower-end temperature of the lipstick composition. The gray line indicates the upper-end temperature of the lipstick composition, and the dotted line indicates the lower-end temperature of the lipstick composition in FIGS. 23A and 23B.

Comparing the graphs of FIGS. 23A and 23B, it can be seen that, in either of the graphs, the upper-end temperature and the lower-end temperature of the lipstick composition drop so as to be in accordance with the set temperature of the Peltier element 3. Thus, it can be seen that temperature control by the Peltier element 3 can be performed when either of the metal molds 12A and 12B is used.

In the graph of the second configuration example of FIG. 12 illustrated in FIG. 23B, there is hardly any difference between the upper-end temperature and the lower-end temperature, and the upper-end temperature and the lower-end temperature each decrease with a slight lag from the set temperature. Hence, the periphery of the middle tray of the lipstick can be rapidly cooled ahead to further minimize the degree of the strain (such as the shrink hole) in the periphery of the middle tray and to minimize the size of the crystals in the base portion. As a result, the strength of the lipstick is increased.

As illustrated in the graphs of FIGS. 23A and 23B, the temperature of the Peltier element 3 is controlled to reach 0° C. at approximately 82 seconds after 10 seconds have elapsed from the start of the process. However, while the lower end of the lipstick reaches 0° C. at approximately 83 seconds and the upper end of the lipstick reaches 0° C. at approximately 89 seconds in FIG. 23A, the lower end and the upper end of the lipstick both reach 0° C. at approximately 93 seconds in FIG. 23B.

Thus, it can be seen that there is less lag in the transfer of heat from the Peltier element 3 to cosmetic composition L in the first configuration example of FIG. 11 used in FIG. 23A than the configuration example of FIG. 12 used in FIG. 23B. This may be because the metal mold 12A illustrated in FIG. 11 has good transfer efficiency as it covers the entire interior of the outer cylinder 2 and has a large contact surface with respect to the Peltier element 3 compared to the metal mold 12B that partially covers the interior of the outer cylinder 2.

Therefore, in the disclosure, the metal mold 12A of the first configuration example that has less transfer lag may be selected in a case where the lipstick is to be molded in a shorter time and with less electric energy, and the metal mold 12B of the second configuration example may be selected in a case where the strain on the upper and lower positions of the lipstick is to be eliminated as much as possible.

Note that in the disclosure, in both the first configuration example illustrated in FIG. 11A and the second configuration example illustrated in FIG. 12A, temperature control is directly performed by the Peltier element 3. Hence, the heating and cooling time becomes shorter than in a case where temperature control using air of the comparative experiments illustrated in FIGS. 14A to 16 is performed. Therefore, the differences in the generated strain and in characteristics between the first configuration example, which employs the bottom cooling method, and the second configuration example, which employs the lateral cooling method, are smaller than the differences in the characteristics between bottom cooling and lateral cooling when temperature control using air is performed.

Figure 24A:
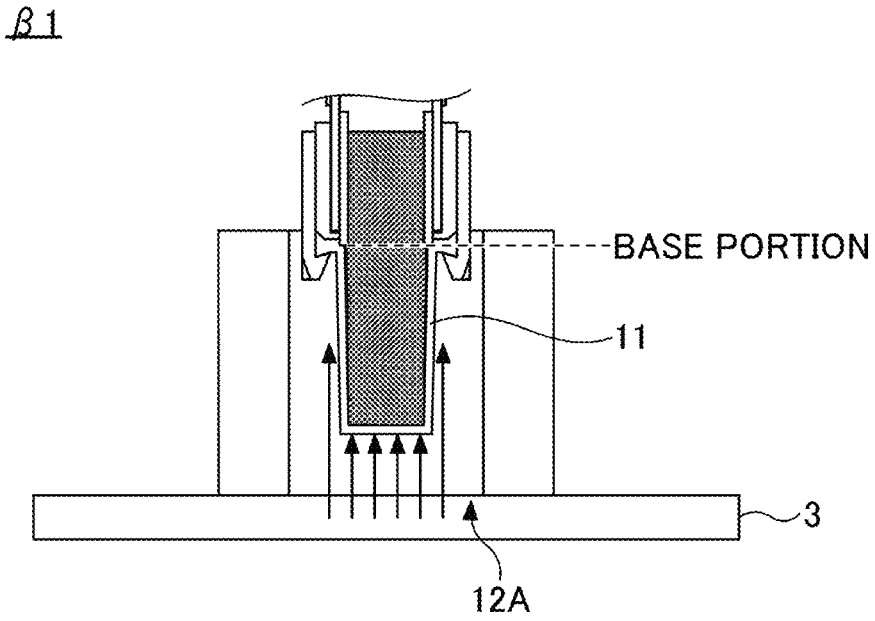
FIG. 24A is a view illustrating the flow of heat in the independent molding unit according to the first configuration example of FIG. 11A.
Figure 24B:
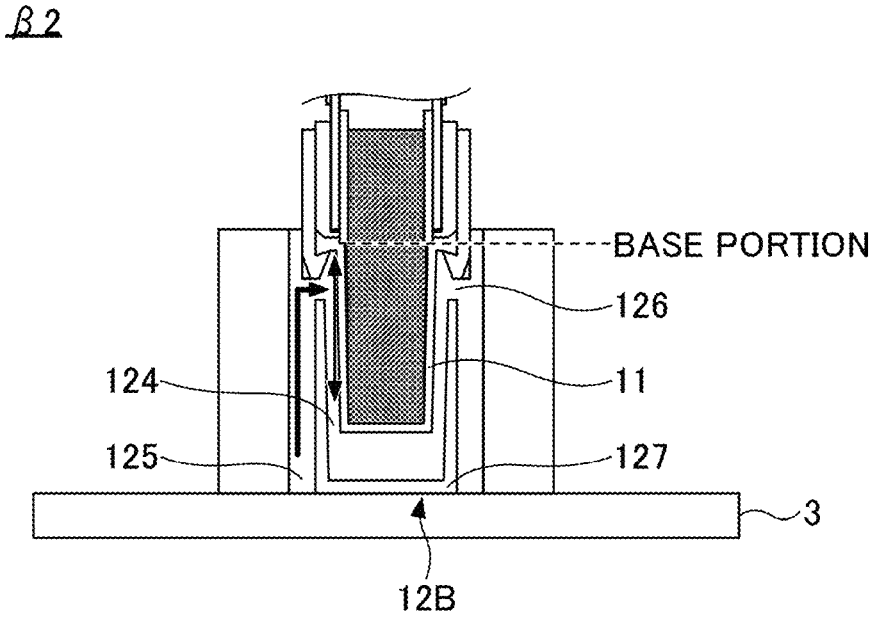
FIG. 24B is a view illustrating the flow of heat in the independent molding unit according to the second configuration example of FIG. 12A.
Figure 24C:
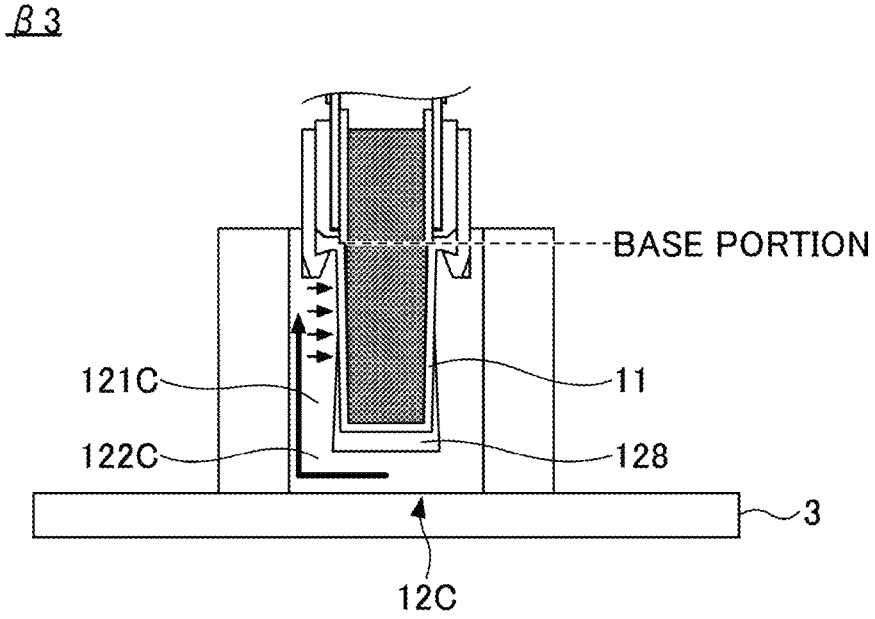
FIG. 24C is a view illustrating the flow of heat in the independent molding unit according to the third configuration example of FIG. 13A.

FIGS. 24A to 24C illustrate the flow of heat in the respective metal molds of independent molding units β1 to β3 according to the first embodiment.

As illustrated in FIG. 24A, in the independent molding unit β1 of the first configuration example, heat is transferred directly from bottom to top because the metal mold 12A is in close contact with the Peltier element 3 and the rubber mold 11.

As illustrated in FIG. 24B, in the independent molding unit β2 of the second configuration example, the center of the bottom portion of the metal mold 12B is not in contact with the Peltier element 3 because the lower bottomed-cylindrical space 127 is formed in the metal mold 12B. As a result, heat once rises up the exterior portion of the metal mold 12B and subsequently spreads vertically in the interior portion, thus allowing the heat to be transferred to the rubber mold 11.

In the independent molding unit β3 of the third configuration example, the entire lower surface of the metal mold 12C is in contact with the Peltier element 3. However, the upper surface of the bottom of the metal mold 12C is not in contact with the rubber mold 11 due to the formation of the upper bottomed-cylindrical space 128. Hence, as illustrated in FIG. 24C, heat is transferred from the metal mold 12C to the rubber mold 11 from bottom to top as well from the side. Since air is present between the metal mold 12C and the rubber mold 11 in the lower side of this configuration, heat is also transferred gently from below in addition to the directions indicated by the arrows in FIG. 24C.

FIG. 25 is a table illustrating the results of experiments on shrink hole size and breakage resistance of respective lipsticks molded by the independent molding units β1, β2, and β3 according to the first configuration example, the second configuration example, and the third configuration example. As illustrated in the table of FIG. 25, there are no problems with respect to shrink holes in any of the independent molding units β1, β2, and β3.

Further, the hardness of the base portion and the breakage resistance as a numerical value of breakability are illustrated in the table of FIG. 25. The hardness of the base portion illustrated in FIG. 25 indicates the hardness (unit: Newtons [N]) that was measured by cutting the base portion, which is indicated by broken lines in each of FIGS. 24A, 24B, and 24C, and inserting a hardness meter in the center of the cut section of the root portion. The breakage resistance indicates the numerical value (unit: N) measured at the breakage of the lipstick when force is applied to the lipstick, which is lying sideways in a space, in a direction perpendicular to the stretching direction of the lipstick.

As illustrated in FIG. 25, the hardness of the base portion of the lipstick formed by the third configuration example β3 is higher relative to the hardness of the first configuration example β1 and the hardness of the second configuration example β2. Both the independent molding units β2 and β3 illustrate configuration examples employing lateral cooling that causes heat to propagate from the side. However, as illustrated in FIG. 24B, the heat absorption effect is small in the independent molding unit β2 because the contact area of the metal mold 12B and the Peltier element 3 is the lower end of the outer heat-transfer cylinder 25, and thus the contact area is small. In contrast, the heat absorption effect is large in the metal mold 12C of the independent molding unit β3 because the entire bottom surface 122C is in contact with the Peltier element 3. In addition, in the metal mold 12B of the independent molding unit β2, the heat transferred from the outer heat-transfer cylinder 25 is transferred vertically to the holder cylinder 124 and the rubber mold 11 through the connecting portion 126 on the upper end. In contrast, as illustrated in FIG. 24C, in the independent molding unit β3, the contact area of the side surface 121C where heat is transferred from below is large, thus allowing heat to be transferred from the side to the rubber mold 11 uniformly in a wider range. A lipstick molded by the configuration of independent molding unit β3 is considered to have higher hardness due to these characteristics.

Furthermore, even though the hardness of the base portion of the lipstick molded by the independent molding unit β1 and the hardness of the base portion of the lipstick molded by the independent molding unit β2 are the same, the breakage resistance increases in the following order: β1<β2<β3. Here, as illustrated by the arrows in FIGS. 24A, 24B, and 24C, the independent molding units β2 and β3 employ lateral cooling in which heat is propagated from the side, and the independent molding unit β1 employs bottom cooling in which heat is propagated from below. Therefore, it can be said that lateral cooling is a molding method that has robustness in regard to breakage resistance even in a case where control using a Peltier element is performed.

<Configuration of Controllers>

Figure 26:
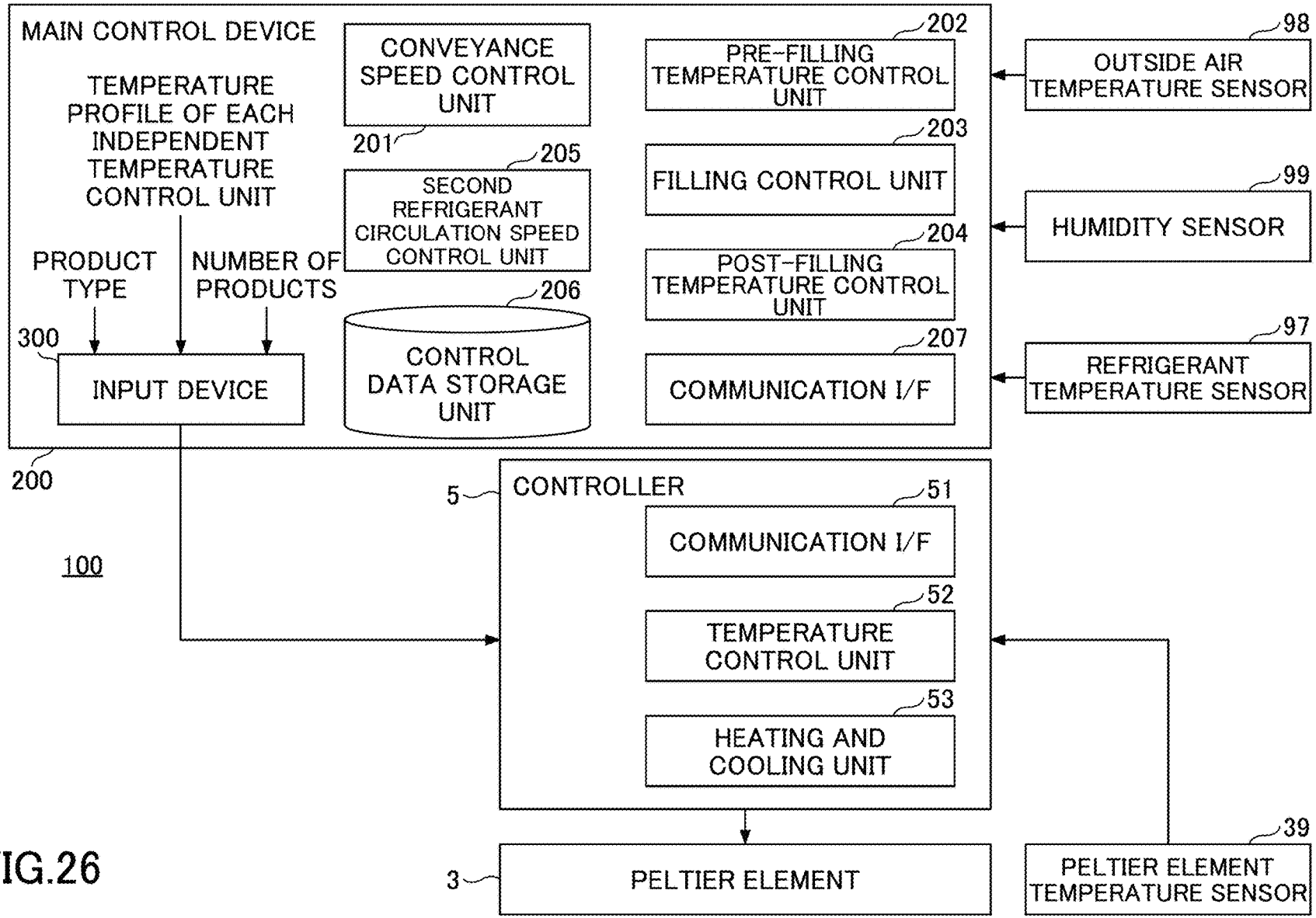
FIG. 26 is a control block diagram of the lipstick molding apparatus of the disclosure.

The control block of the lipstick molding apparatus 100 of the disclosure will be described with reference to FIG. 26. The controller 5 illustrated in FIG. 26 is an element controller and can communicate with a main control device 200 of the lipstick molding apparatus 100.

The main control device 200 can communicate with the controller 5 through wireless communication or is connected through wired connection. Information such as the product type (the color, the brand, etc.) of the lipstick to be manufactured, the number of products to be manufactured, the temperature profile for each independent temperature control unit of each product is input to an input device 300 in the main control device 200.

The main control device 200 as the main controller includes a conveyance speed control unit 201, a pre-filling temperature control unit 202, a filling control unit 203, a post-filling temperature control unit 204, a second refrigerant circulation speed control unit 205, a control data storage unit 206, a communication interface (I/F) 207, and the like in an executable manner.

The conveyance speed control unit 201 adjusts the speed of movement of the independent temperature control unit α by the conveyance belt 65.

The pre-filling temperature control unit 202 adjusts the temperature of the lipstick composition in a lipstick composition filling device 101 before the filling process. That is, the pre-filling temperature control unit 202 adjusts the temperature at which the lipstick composition is heated and melted, and the melted lipstick composition is poured into the mold.

The filling control unit 203 adjusts the filling amount, the filling speed, the filling position, and the like of the cosmetic composition L from the lipstick composition filling device 101 to the mold 1.

The post-filling temperature control unit 204 adjusts the temperature of the lipstick composition in the mold 1 after the filling process. That is, the temperature of molding conditions other than the temperature profile of the Peltier element, such as the molding conditions regarding reheating and the like, are adjusted by the post-filling temperature control unit 204 after the mold has been filled with the lipstick composition.

The control data storage unit 206 stores, for example, a table of a plurality of setting conditions such as conveyance speed, product type, number of products on the production line, outside air temperature, humidity, refrigerant temperature, filling temperature, and molding temperature.

An outside air temperature sensor 98 for measuring the outside air temperature and a humidity sensor 99 for measuring humidity may be provided in a container-filled molded product manufacturing apparatus 9. The outside air temperature sensor 98 and the humidity sensor 99 are environment sensors.

The post-filling temperature control unit 204 of the main control device 200 reads the table of the setting conditions corresponding to the outside air temperature and the humidity, which are measured by the environment sensors 98 and 99, from the control data storage unit 206, and instructs the temperature transition of the Peltier element 3 to be performed after the filling process.

In addition, the second refrigerant circulation speed control unit 205 adjusts the circulation speed of the second refrigerant W in the cooling passage 71. A refrigerant temperature sensor 97 that measures the temperature of the first refrigerant C in the refrigerant tank 6 may be provided here. In such a case, the second refrigerant circulation speed control unit 205 may adjust the circulation speed of the second refrigerant W in accordance with the temperature of the first refrigerant C in the refrigerant tank 6 that is detected by the refrigerant temperature sensor 97.

The communication I/F 207 transmits and receives data and instructions to and from the controller 5 as an element controller.

The controller 5 as an element controller includes a communication I/F 51, a temperature control unit 52, and a heating and cooling unit 53 in an executable manner. The communication I/F 51 transmits and receives data to and from the main control device 200.

Although not mentioned above, a Peltier element temperature sensor 39 that detects the temperature of the Peltier element 3 or a portion of the metal mold 12 in real time may be provided near the Peltier element 3.

The temperature control unit 52 of the controller 5 can finely adjust the temperature of the Peltier element 3 based on a temperature instruction from the main control device 200 and in accordance with the temperature detection result from the Peltier element temperature sensor 39.

The heating and cooling unit 53 controls the temperature of the Peltier element 3 by applying a current (in the direction and the value) corresponding to the set temperature to the Peltier element 3.

Such a configuration allows the main control device 200 to execute post-filling-process temperature control based on the outside air temperature, the humidity, the conveyance speed, and the number of products on the production line. Since precise temperature control can be executed with consideration to the factors that affect the lipstick molding process, fewer defective products are manufactured and productivity is high. Therefore, stable, high-quality molding can be implemented without being affected by the formulation or the environment.

Further, as illustrated in FIG. 4 above, temperature interference between the components is less likely to occur by using each mold 1 and each outer cylinder 2 that are temperature-controlled by an independent Peltier element and surround the lipstick composition L. Thus, the problem in which molds are cooled easily during trial production due to a small number of products being produced for trial, but are harder to cool during mass production due to a large number of products being produced hardly occurs. In other words, there is almost no temperature difference between trial production and mass production. Therefore, by employing such precise temperature control, it is possible to minimize the difference between trial production and mass production, thus allowing trial production conditions to be directly applied to mass production conditions.

Further, since the controller 5 is provided for each Peltier element, an abnormality or the like can be detected immediately, and only the products that were molded by the independent temperature control unit α in which the abnormality has occurred can be excluded as defective products. As a result, the defect rate can be reduced to improve productivity. Furthermore, since temperature control is performed individually, the production line can be configured efficiently in accordance with the number of products to be produced.

Utilizing sensing and IoT technologies in this manner allows for a departure from manufacturing that depends on instinct, skill, and experience.

Also, in this embodiment, since the molds and the outer cylinders are spaced apart from other molds and outer cylinders as illustrated in FIG. 4, uniform temperature adjustment can be performed on each of the plurality of metal molds. Note that although the above-example described a configuration that reduces thermal interference between metal molds by keeping the metal molds apart from each other for thermal insulation, thermal interference may be reduced by employing a thermally insulated configuration on each outer cylinder as in the ninth and tenth embodiments.

Furthermore, since it is essential, in terms of quality assurance, for a lipstick to not break, a lipstick that has a low wax amount but does not break (has a high breakage resistance) needs to be realized. By performing temperature control for each lipstick in accordance with the surrounding environment in this manner, it becomes possible to control the strain and the size of the crystals to mold a lipstick that is less likely to break.

In this manner, in the cosmetic molding apparatus of the disclosure, the temperature of each mold to be filled with a cosmetic composition can be independently controlled. Hence, it is possible to control each of the plurality of molds and control the strain on the cosmetic composition and the size of crystals in the cosmetic composition within one mold, regardless of the number of cosmetic products are to be molded. As a result, the wax amount can be reduced to produce lipstick that is less likely to break while maintaining good spreadability, moisture, color retention, and the like.

Second Embodiment

Figure 27:
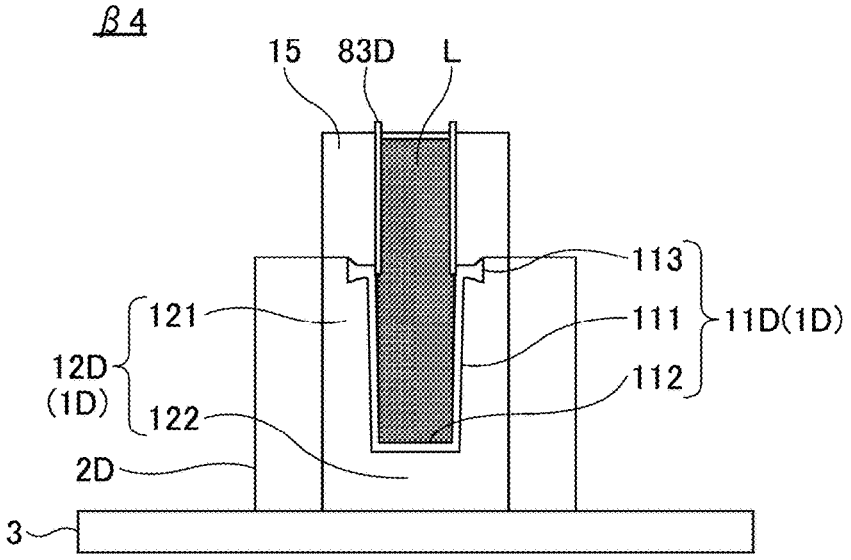
FIG. 27 is a cross-sectional view of the independent molding unit according to the second embodiment.

FIG. 27 is a cross-sectional view of an independent molding unit β4 according to the second embodiment. The independent molding unit β4 according to this embodiment is used in molding by the back filling method.

In the independent molding units β1 to β3 according to the first embodiment described above, the outer cylinder 81 and the spiral cylinder 82 of the lipstick container are set on the upper part to integrally mold the outer cylinder 81 and the spiral cylinder 82 with the lipstick. However, only an elevating cylinder (middle tray cylinder) 83D that is an elevating tray that fixes the lipstick and moves up and down with the lipstick may be used for molding.

In a state where the elevating cylinder (middle tray cylinder) 83D is installed in the upper part, the recessed portion of a mold 1D and the interior of the elevating cylinder 83D are filled with the lipstick composition L.

In the configuration of this embodiment, only the elevating cylinder 83D that is shorter and thinner than the spiral cylinder 82 is present on the upper side of a metal mold 12D. Hence, heat can be conducted from the periphery to the lipstick composition L in the elevating cylinder 83D from the thermally conductive holder 15 through the elevating cylinder 83D and a rubber mold 11D.

The molded lipstick L and the elevating cylinder 83D are subsequently engaged with the spiral cylinder 82 and the outer cylinder 81.

Third Embodiment

Figure 28:
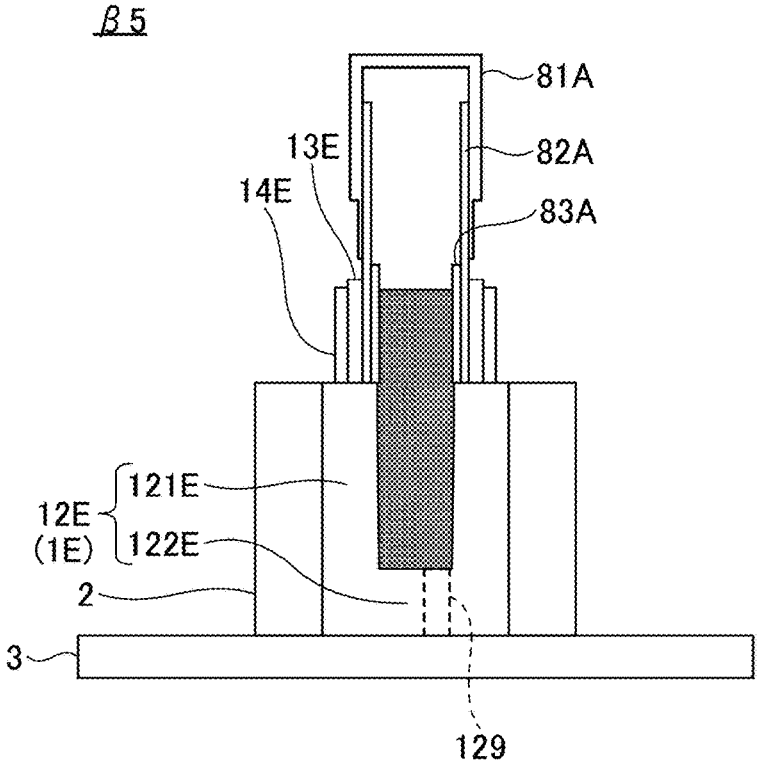
FIG. 28 is a cross-sectional view of the independent molding unit according to the third embodiment.

FIG. 28 is a cross-sectional view of an independent molding unit β5 according to the third embodiment. The independent molding unit β5 according to this embodiment is used in molding by the back filling method.

In the first and second embodiments described above, an example in which the rubber mold 11 is provided inside the thermally conductive metal mold 12. However, the rubber mold as a molding cylinder may not be provided.

In this embodiment, the mold 1 is formed by only a metal mold 12E that is a bottomed, cylindrical, thermally conductive mold with a cylindrical recessed portion that is directly filled with the cosmetic composition of the rod-shaped cosmetic product. In this embodiment, the inner circumferential surface of the metal mold 12E has undergone surface treatment to prevent the adherence of the cosmetic composition.

Providing the rubber mold 11 as in the first embodiment can increase the degree of freedom in the shape of the lipstick. The rubber mold can be shaped to form protruding and recessed patterns, such as logos and designs, on the upper surface or the side surface of the lipstick. The rubber mold can be shaped to form the outer shape of the lipstick into a shape that is different from the cylindrical metal mold such that the lipstick can have a polygonal heart-shaped cross-sectional shape.

In contrast, since the rubber mold is not provided in this embodiment, the degree of freedom in the shape of the lipstick decreases. However, in a case where patterns or the like are unnecessary and the shape of the lipstick to be molded can be the same as the shape of the inner circumferential surface of the metal mold, the number of components can be reduced by this configuration. Furthermore, since this configuration allows the heat to be directly transferred between the metal mold 12E and the cosmetic composition L without going through the rubber mold that has a low thermal conductivity, the responsiveness of the Peltier element to the heat can be accelerated and the molding time can be shortened.

Note that since the rubber mold is not provided in this embodiment, an air hole 129 through which air is injected is formed in a bottom surface 122E on the lower end of the metal mold 12E so as to run vertically through the bottom surface 122E. When the molded lipstick is to be removed from the mold, the lipstick can be removed by injecting air into the air hole 129.

Therefore, it is preferable to select whether to use the rubber mold in accordance with the characteristic of or the necessity of design of the lipstick to be molded.

Note that in this example, the elevating cylinder 83A, a spiral cylinder 82A, and an outer cylinder 81A are set and integrally formed on the upper side of the mold that does not include the rubber mold. However, the mold composed of only the metal mold of this embodiment may be applied to a configuration in which only the elevating cylinder 83A is set and integrally formed on the upper side of the mold as in the second embodiment.

Figure 29A:
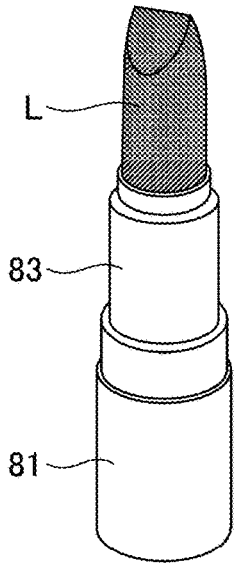
FIG. 29A is a view illustrating an example of a bullet-type lipstick shape.
Figure 29B:
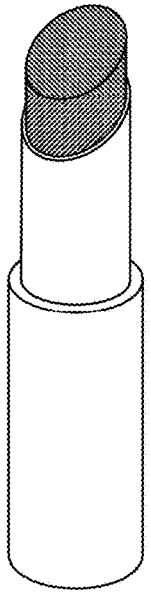
FIG. 29B is a view illustrating an example of a slim-type lipstick shape.
Figure 29C:
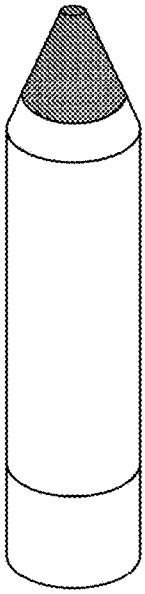
FIG. 29C is a view illustrating an example of a crayon-type lipstick shape.
Figure 29D:
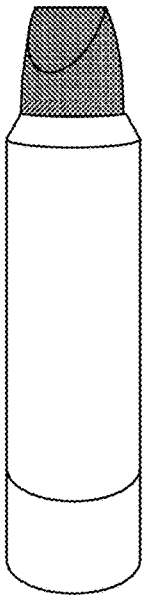
FIG. 29D is a view illustrating an example of a spatula-tip-type lipstick shape.

FIGS. 29A to 29D are views for explaining the examples of the shape of a general lipstick. FIG. 29A illustrates a bullet-type lipstick shape, FIG. 29B illustrates a slim-type lipstick shape, FIG. 29C illustrates a crayon-type lipstick shape, and FIG. 29D illustrates a spatula-tip-type lipstick shape.

In general, in a case where no special processing is required on the side surface or the tip of the lipstick such as in the case of the slim-type (inner cylinder type) lipstick illustrated in FIG. 29B or the crayon-type lipstick illustrated in FIG. 29C, the molding process can be performed by the third embodiment illustrated in FIG. 28 without using the rubber mold.

A rubber mold can be used in a case where a logo or a pattern is to be formed on the body portion or the tip of the lipstick, such as in the case of the bullet-type lipstick illustrated in FIG. 29A or the spatula-tip-type lipstick as illustrated in FIG. 29D. Furthermore, a rubber mold may also be used in a case where a similar decoration is to be formed on the tip portion of a slim-type lipstick as illustrated in FIG. 29B.

Therefore, a configuration in which a rubber mold is provided on only the tip portion will be described below as the fourth embodiment.

Fourth Embodiment

Figure 30:
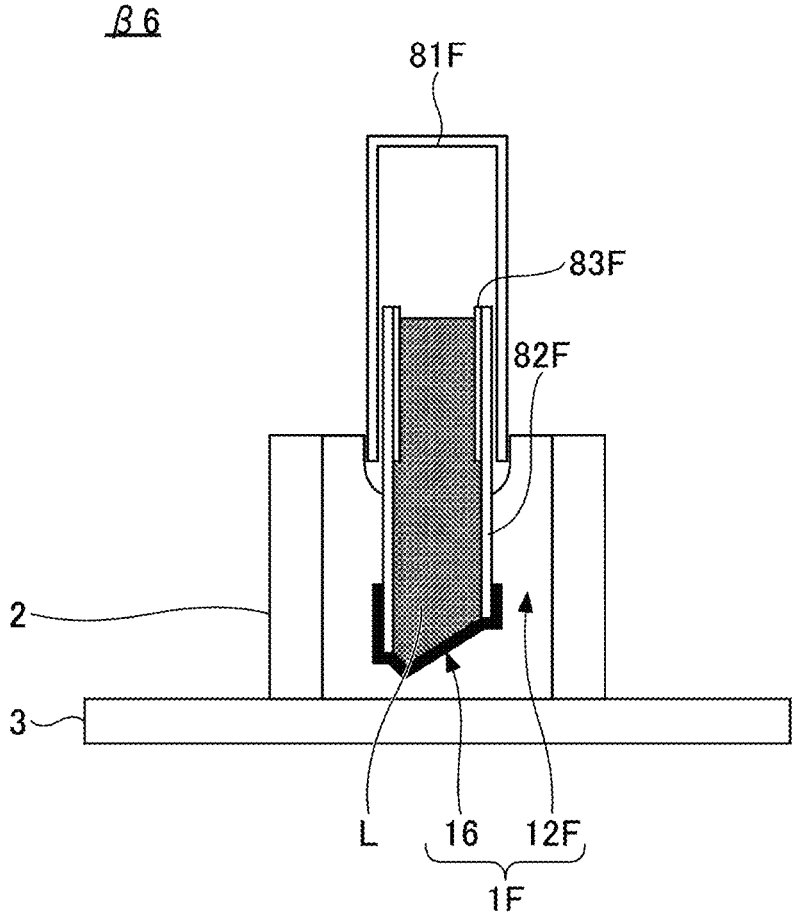
FIG. 30 is a cross-sectional view of the independent molding unit according to the fourth embodiment.

FIG. 30 is a cross-sectional view of an independent molding unit β6 according to the fourth embodiment. The independent molding unit β6 according to this embodiment is used in molding by the back filling method.

In this embodiment, the filling and molding of the lipstick composition is performed in a state where a sleeve (spiral cylinder 82F) has been deeply inserted in the extendable container. That is, in the configuration, since the lipstick composition is heated and cooled in the sleeve during filling and during temperature adjustment, a tip rubber mold 16 is provided only at the lower end of the recessed portion and the periphery thereof in the independent molding unit.

<<Insertion Filling>>

FIGS. 31A to 31F are views for explaining the rod-shaped cosmetic product molding process based on the insertion filling method of the disclosure. FIG. 32 is an overall view of the lipstick molding apparatus that employs the insertion filling method and is included in an apparatus for manufacturing a molded product in an extendable lipstick container.

The insertion filling method illustrated in FIGS. 31A to 31F differs from the back filling method illustrated in FIGS. 3A to 3E in that the molding of the lipstick is performed without attaching the outer cylinder 81 and the spiral cylinder 82 to the cosmetic material. In the insertion filling method, an insert portion 94 is inserted instead of the elevating cylinder 83 in the upper part of the mold 1.

Figure 31A:
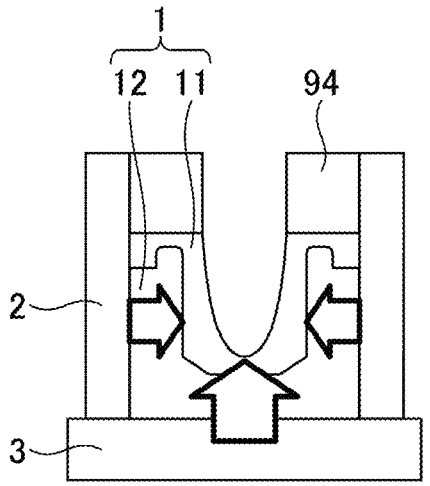
FIG. 31A is a view for explaining the rod-shaped cosmetic product molding process by an insertion filling method of the disclosure, and is a view illustrating a preheating state.
Figure 31B:
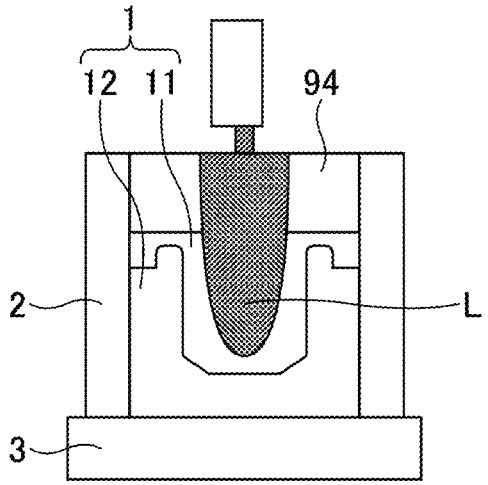
FIG. 31B is a view illustrating a state during filling by the insertion filling method.
Figure 31C:
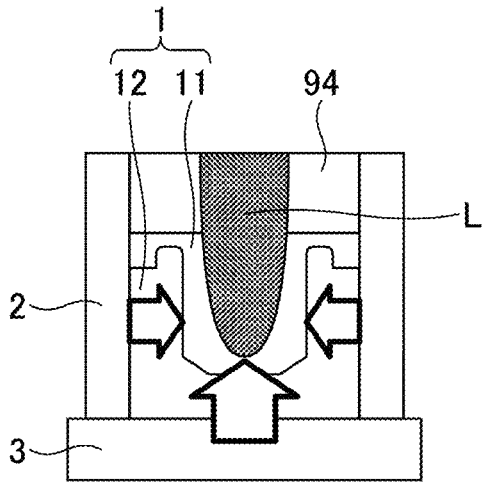
FIG. 31C is a view illustrating a state in which reheating is performed by the Peltier element in the insertion filling method.
Figure 31D:
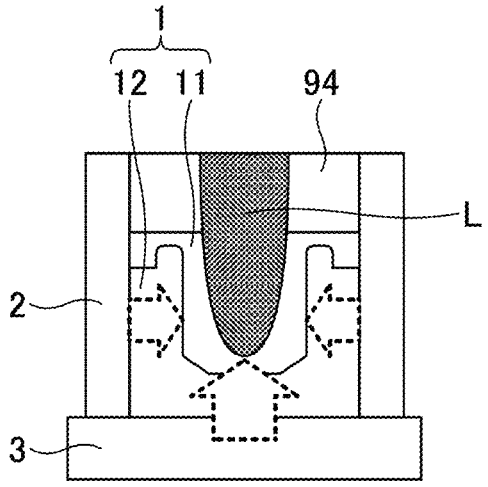
FIG. 31D is a view illustrating a state in which solidification by cooling by the Peltier element is performed in the insertion filling method.
Figure 31E:
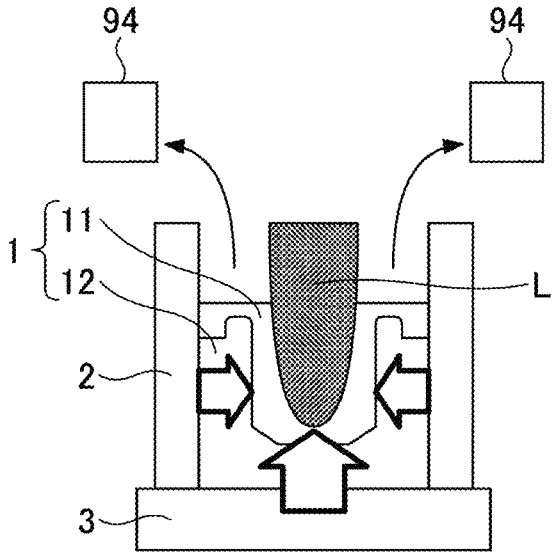
FIG. 31E is a view illustrating the removal of insert portions in the insertion filling method.
Figure 31F:
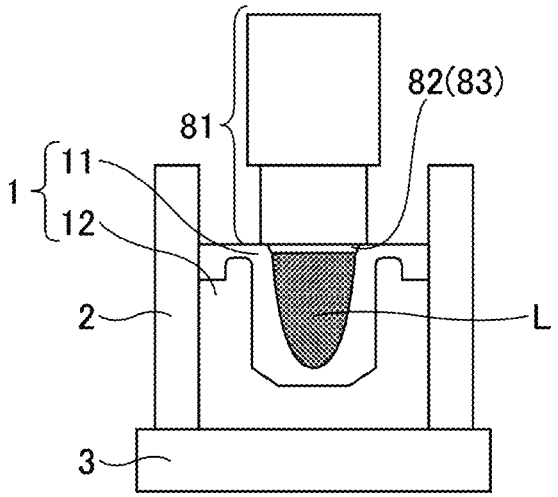
FIG. 31F is a view illustrating a state in which an outer cylinder, a spiral cylinder, and an elevating cylinder are attached in a protracted state in the insertion filling method.
Figure 31G:
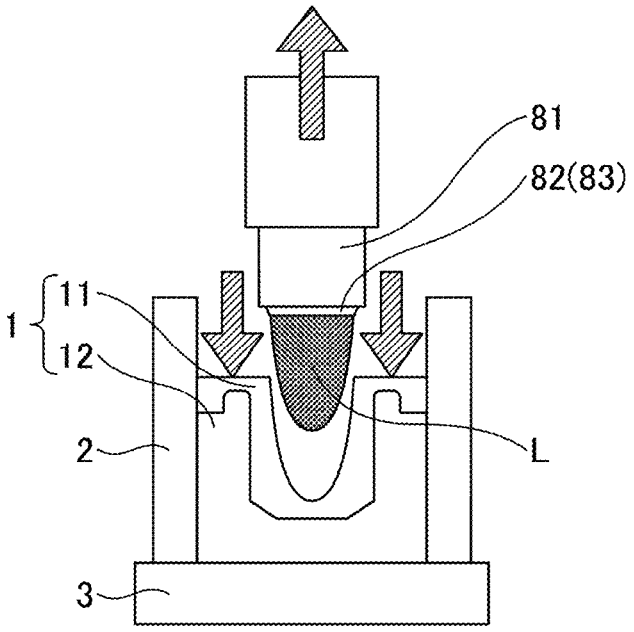
FIG. 31G is a view illustrating a state in which the molded rod-shaped cosmetic product is removed from the mold 1.
Figure 32:
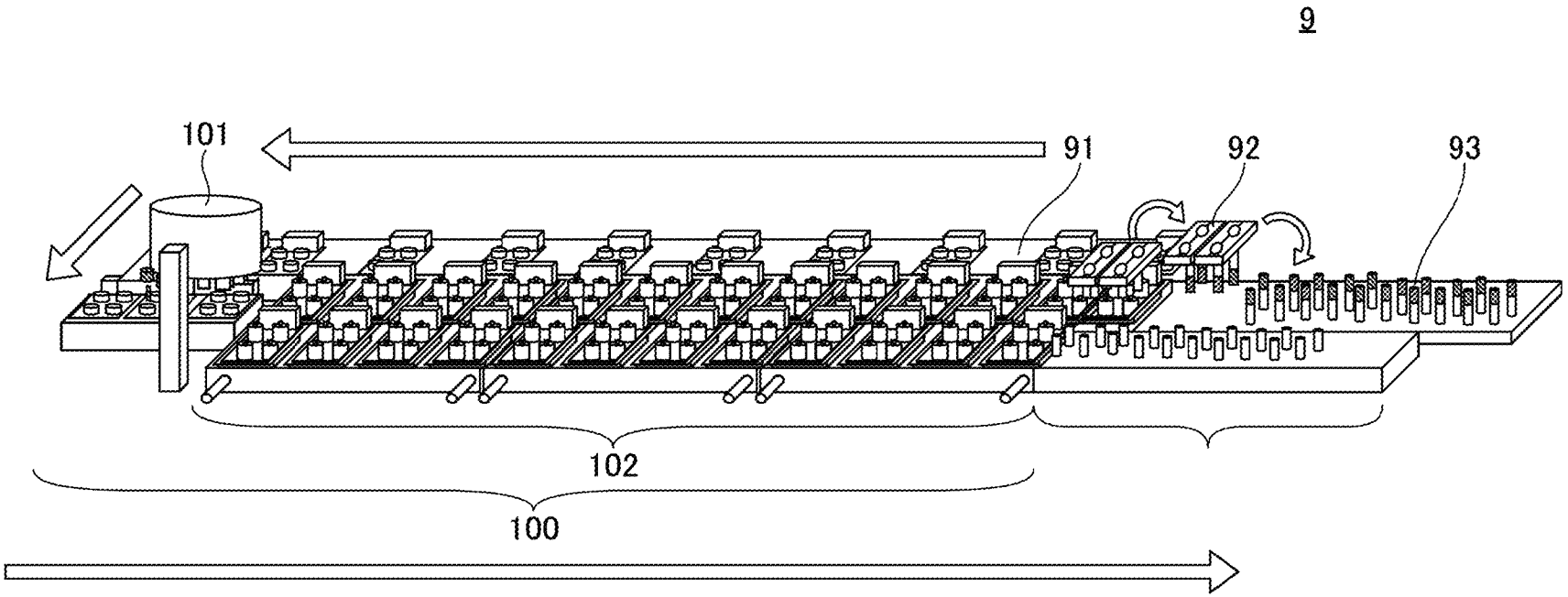
FIG. 32 is an overall view of the lipstick molding apparatus that employs the insertion filling method and is included in an apparatus for manufacturing a molded product to be filled in an extendable lipstick container.

In the rod-shaped cosmetic product manufacturing process based on the insertion filling method of the disclosure, the materials are heated and melted (preheated) (FIG. 31A), the cosmetic composition is poured into the mold (FIG. 31B), and the Peltier element 3 is used to reheat the cosmetic composition (FIG. 31C) and to cool and solidify the cosmetic composition (FIG. 31D). Subsequently, after the insert portion 94 is removed while heating is performed (FIG. 31E), the outer cylinder 81, the spiral cylinder 82, and the elevating cylinder 83 are attached in an extended state (FIG. 31F), and the molded rod-shaped cosmetic is removed from the mold 1 (FIG. 31G).

The insertion filling method illustrated in FIGS. 31A to 31F also differs from the related-art example illustrated in FIG. 1 in that the Peltier element 3 is used instead of airflow to freely set the temperature profile such as cyclic cooling, rapid cooling, or slow cooling when the cooling and solidification process is to be performed.

Also, as illustrated in FIG. 32, the lipstick molding apparatus 100 of the disclosure is an example of a cosmetic product molding device, and is part of the extendable-container-filled molded product manufacturing apparatus 9.

The molding process executed by the lipstick molding apparatus 100 includes the filling process and the temperature adjustment process. Hence, the lipstick molding apparatus 100 includes the lipstick composition filling device 101 and the temperature adjustment device 102.

In the filling process, the lipstick composition filling device 101 fills a mold 1G (see FIG. 33) with liquid-based lipstick composition (insertion filling). Subsequently, the temperature adjustment device 102 adjusts the temperature of the lipstick in the mold 1 to solidify the lipstick composition and mold the lipstick composition into a lipstick.

In insertion filling, in the first section of the lipstick molding apparatus 100, a pre-filling conveyance mechanism 91 conveys a set of molds without containers inserted therein.

A lipstick mold-release mechanism 92 and a post-filling conveyance mechanism 93 are provided in the second section of the lipstick molding apparatus 100. In the lipstick mold-release mechanism 92, the lipstick molded by the lipstick molding apparatus 100 is removed from the mold 1 (mold removal).

Subsequently, the post-filling conveyance mechanism 93 inserts the removed lipstick into the extendable container and conveys the lipstick to the assembly process at the rear end.

Fifth Embodiment

Figure 33:
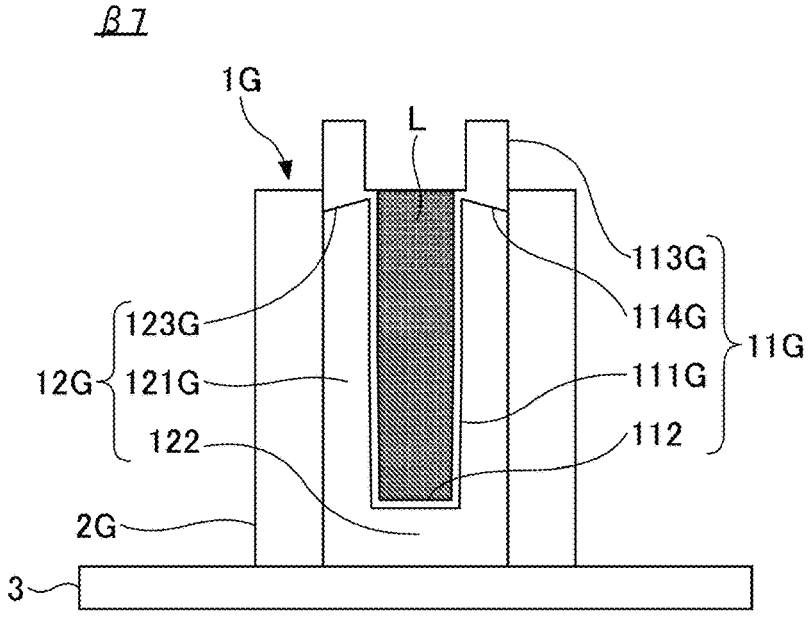
FIG. 33 is a cross-sectional view of the independent molding unit according to the fifth embodiment.

FIG. 33 is a cross-sectional view of an independent molding unit β7 according to the fifth embodiment. The independent molding unit β7 according to this embodiment is used in the insertion-filling-type molding method described in FIGS. 31A to 32.

In this embodiment, only the lipstick content itself is formed separately from the outer cylinder 81, the spiral cylinder 82, and the elevating cylinder 83.

In the configuration of this embodiment, a metal mold 12G and a rubber mold 11G are present up to the upper side of the lipstick L. Hence, the recessed portion of a mold 1G is filled with an amount of lipstick composition L corresponding to the entire amount of the lipstick to be molded.

Hence, in this embodiment, heat can be conducted through the metal mold 12G to the entire area of the lipstick composition (cosmetic composition) in the mold 1G from the upper surface and the side surface of lipstick composition. In a case where a metal mold that has good, uniform thermal conductivity throughout its entire area is used for molding by insertion filling, there is no difference in thermal conductivity between the mold 1G, which is a lipstick molding portion, and the elevating cylinder 83 and the spiral cylinder 82, which are to be fitted later as illustrated in FIG. 31F, when the mold 1G and the elevating cylinder 83 and the spiral cylinder 82 are made of different materials. As a result, the generation of a strain can be reduced.

The molded lipstick L is subsequently fitted into the elevating cylinder 83.

Sixth Embodiment

Figure 34:
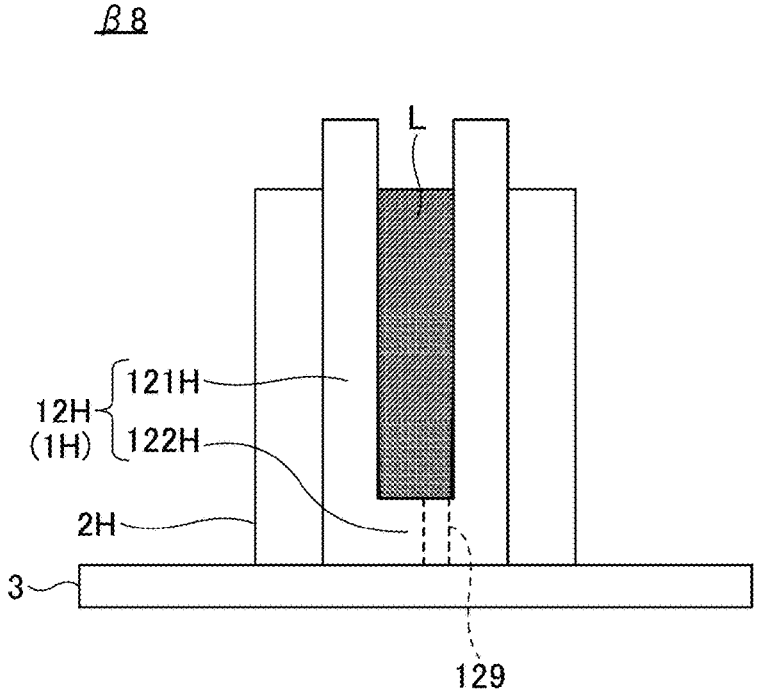
FIG. 34 is a cross-sectional view of the independent molding unit according to the sixth embodiment.

FIG. 34 is a cross-sectional view of an independent molding unit β8 according to the sixth embodiment. Although an example in which the rubber mold 11G is provided in the insertion filling method is described in the fifth embodiment, a configuration without a rubber mold such as the configuration of the second embodiment may also be used in the insertion filling method.

In a case where a metal mold 12H that has good uniform thermal conductivity throughout its entire area is used for molding without using a rubber mold, there is no difference in thermal conductivity between a mold 1H and the elevating cylinder 83 and the spiral cylinder 82 when the mold 1G and the elevating cylinder 83 and the spiral cylinder 82 are made of different materials. As a result, the generation of a strain can be reduced.

Independent Peltier Molding Unit

Seventh Embodiment

Figure 35:
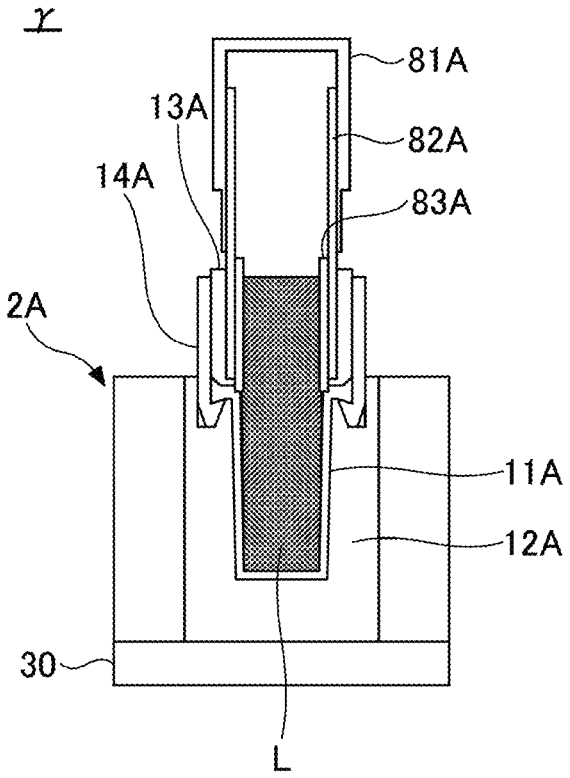
FIG. 35 is a cross-sectional view of the independent molding unit according to the seventh embodiment.

FIG. 35 is a cross-sectional view of an independent molding unit γ according to the seventh embodiment. The above example described cases where one Peltier element is provided with respect to a plurality of metal molds. However, one Peltier element may be provided with respect to one metal mold. The seventh embodiment includes a configuration (independent-Peltier-type independent molding unit γ) in which one Peltier element is provided with respect to one metal mold.

For example, a Peltier element 30 may be provided on the lower surface with respect to one mold as illustrated in FIG. 35. In this case, uniform heating and cooling can be achieved when the size of the Peltier element 30 is at least larger than or equal to the size of the metal mold 12. Furthermore, in a case where Peltier elements are to be individually provided, the upper limit of each Peltier element may be larger than that of the upper cylinder. However, it is preferable for the Peltier element to be separated from a neighboring Peltier element to such an extent that the Peltier element does not collide with or interfere with the neighboring Peltier element.

Eighth Embodiment

Figure 36:
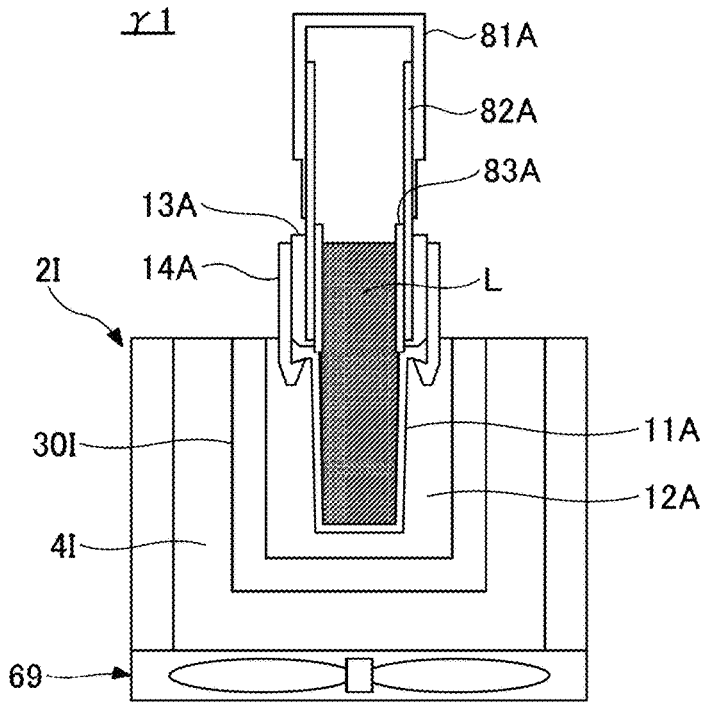
FIG. 36 is a cross-sectional view of the independent molding unit according to the eighth embodiment.

In the eighth embodiment, an independent molding unit γ1 illustrated in FIG. 36 is an example in which the Peltier element and the cooling mechanism have been modified in the independent-Peltier-type independent molding unit γ of FIG. 35.

In this embodiment, in a similar manner to the seventh embodiment, the independent-Peltier-type independent molding unit γ1 is an independent molding unit in which one Peltier element is provided with respect to one mold. In the configuration of FIG. 36, a Peltier element 30I has a bottomed cylindrical shape having a cylindrical side surface and a bottom surface.

Although not illustrated in FIG. 36, the attachment of a heat sink 4I for cooling the Peltier element is needed for each Peltier element in the independent-Peltier-type independent molding unit γ1. In the configuration example, the heat sink 41 has a bottomed cylindrical shape so as to surround the Peltier element 30I.

As a method of individually cooling the heat sink, for example, a cooling fan 69 may be rotated in the lower portion as illustrated in FIG. 36. Alternatively, the heat sink may be cooled by using one or more refrigerants as illustrated above in FIG. 4 or may be cooled by air.

Ninth Embodiment

Figure 37:
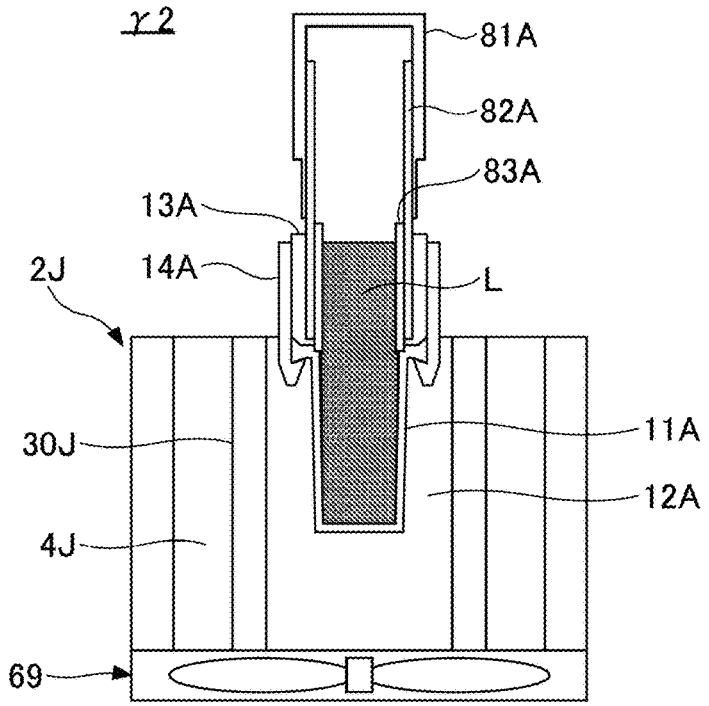
FIG. 37 is a cross-sectional view of the independent molding unit according to the ninth embodiment.

In the ninth embodiment, an independent molding unit γ2 illustrated in FIG. 37 is an example in which the Peltier element and the cooling mechanism have been modified in the independent-Peltier-type independent molding unit γ1 of FIG. 36.

In this embodiment, a Peltier element 30J may be installed only on the cylindrical side surface as illustrated in FIG. 37.

In this case, a heat sink 4J can be cylindrically shaped so as to cover the outer circumferential surface of the Peltier element 30J.

Although an example in which the rubber mold is provided in the independent-Peltier-type independent molding unit has been described here, a configuration that does not include the rubber mold may be adopted as well. Further, an independent-Peltier-type configuration in which the elevating cylinder 83A, the spiral cylinder 82A, and the outer cylinder 81A are integrally formed for back filling is illustrated in FIGS. 36 and 37. However, even in the case of the independent-Peltier-type configuration, a configuration in which only the elevating cylinder 83 is integrally formed with the independent molding unit to allow molding by the back filling method or molding by the insertion filling method may be adopted.

In the example, the Peltier elements and the metal molds are provided at a ratio of 1:1. Hence, control can be performed more suitably with respect to each metal mold. Further, in FIGS. 36 and 37, the transfer distance is short because the Peltier element 30I and 30J each are in contact with the side surface of the metal mold 12A, thus allowing heat to be transferred more easily. As a result, temperature control of the lipstick can be performed more accurately.

Since a minimum of one lipstick can be molded in this embodiment, it is suitable for manufacturing in small batches such as, for example, a case in which a limited-edition product or a customized product such as a lipstick with a name engraved on it is to be manufactured.

<Integrated Molding Unit>

In the first to ninth embodiments described above, the respective outer cylinders surrounding the metal molds 12 are independent, thermally insulated cylinders provided spaced apart from each other as illustrated in FIG. 4. However, as long as the outer cylinder is made of a thermally insulating material, the outer cylinder may be formed integrally with the plurality of lipsticks.

Tenth Embodiment

Figure 38:
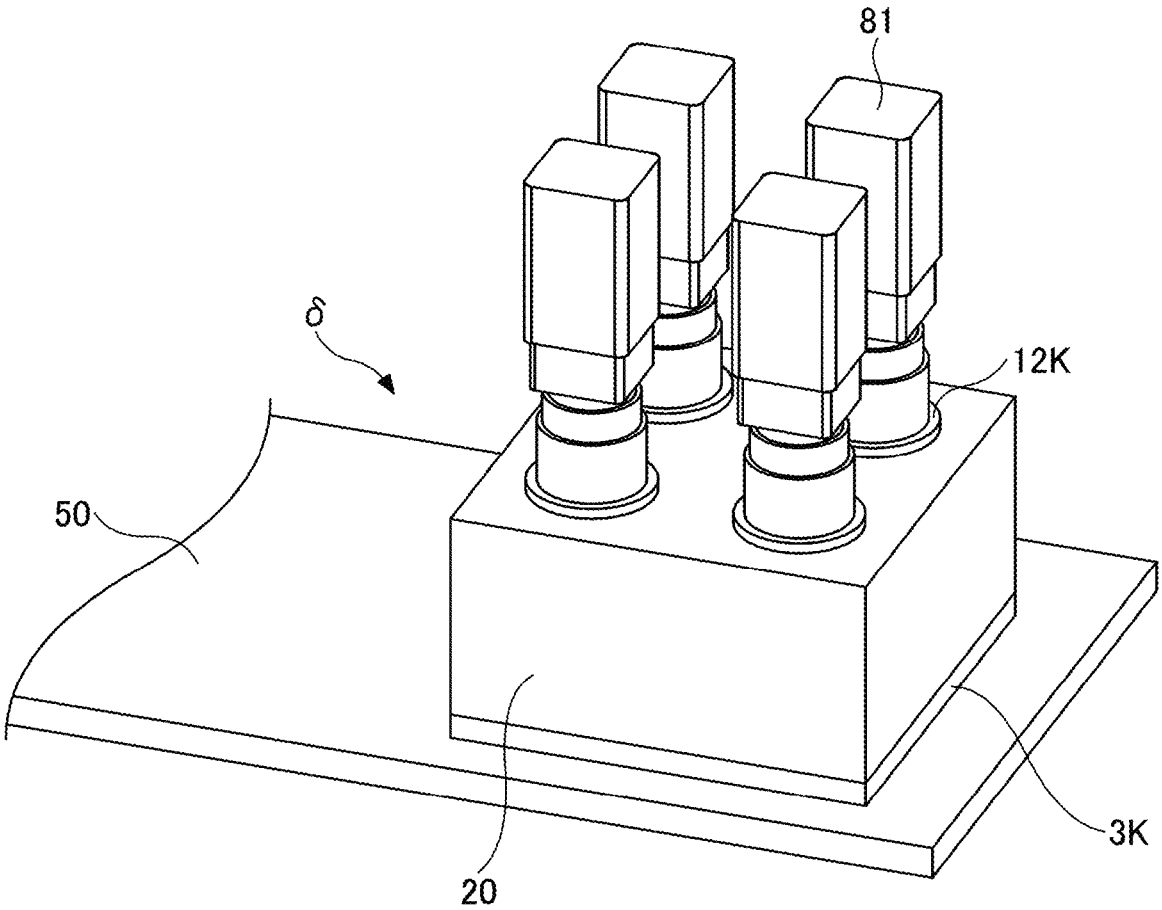
FIG. 38 is a perspective view of an integrated molding unit according to the tenth embodiment.

FIG. 38 is a perspective view illustrating an integrated molding unit δ according to the tenth embodiment. FIG. 391 is a cross-sectional view of the integrated molding unit δ according to the tenth embodiment of FIG. 38.

An outer cylinder 20 according to this embodiment is made of a thermally insulating material. Four recessed portion for inserting four molds 1K are formed in the integrally formed outer cylinder 20. The outer cylinder 20 as the thermally insulated cylinder according to the embodiment may be made by using, for example, rubber, glass, inorganic fiber, wood fiber, resin, wool, or the like as the thermally insulating material. It is preferable for the thermally insulating material to have a structure that can include a large amount of gas.

Figure 39:
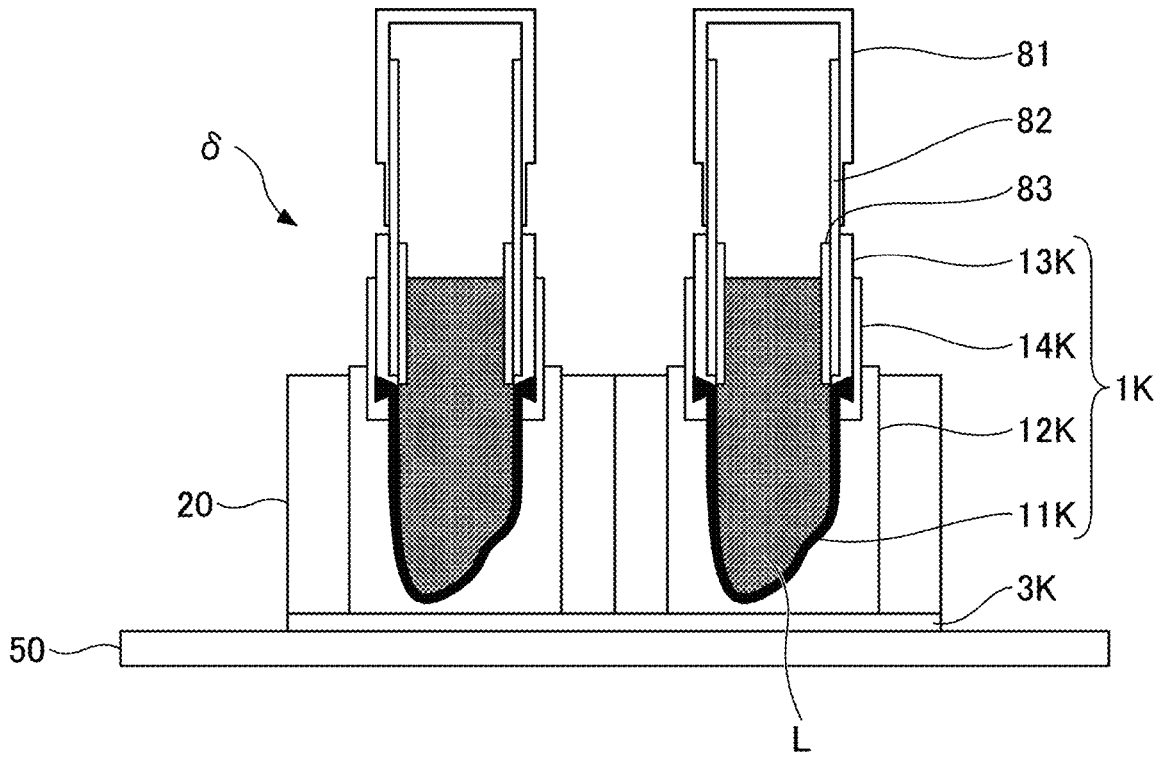
FIG. 39 is a cross-sectional view of the integrated molding unit according to the tenth embodiment illustrated in FIG. 38.

Also, as illustrated in FIG. 39, other aspects of this configuration are similar to the back-filling-method configuration of the first embodiment that includes the rubber mold. Each recessed portion of the outer cylinder 20 includes a rubber mold 11K, a metal mold 12K, an inner rubber holder 13K, and an outer rubber holder 14K, and the lipstick composition L is integrally formed in the recessed portion in a state in which the elevating cylinder 83, the spiral cylinder 82, and the outer cylinder 81 have been fitted on the upper part of the lipstick composition.

A single Peltier element 3K is provided on the lower portion of the outer cylinder 20. The respective lipstick compositions L in the four molds 1K are thermally insulated from each other while the respective temperatures of the lipstick compositions L are adjusted simultaneously.

Note that although a configuration that is used in the back filling method is illustrated as the integrated molding unit δ in FIG. 38, the integrated molding unit δ may be used in a configuration used in the insertion filling method. Further, the molding process may be performed by using a mold without a rubber mold or a mold that included a rubber mold at its tip as the mold in the integrated molding unit δ. Furthermore, the number of molds 1K that are to undergo temperature adjustment simultaneously, that is, the number of recessed portions, are not limited to four in the integrated molding unit δ. Two or three molds or five or more molds may be provided in the integrated molding unit δ.

Eleventh Embodiment

Figure 40:
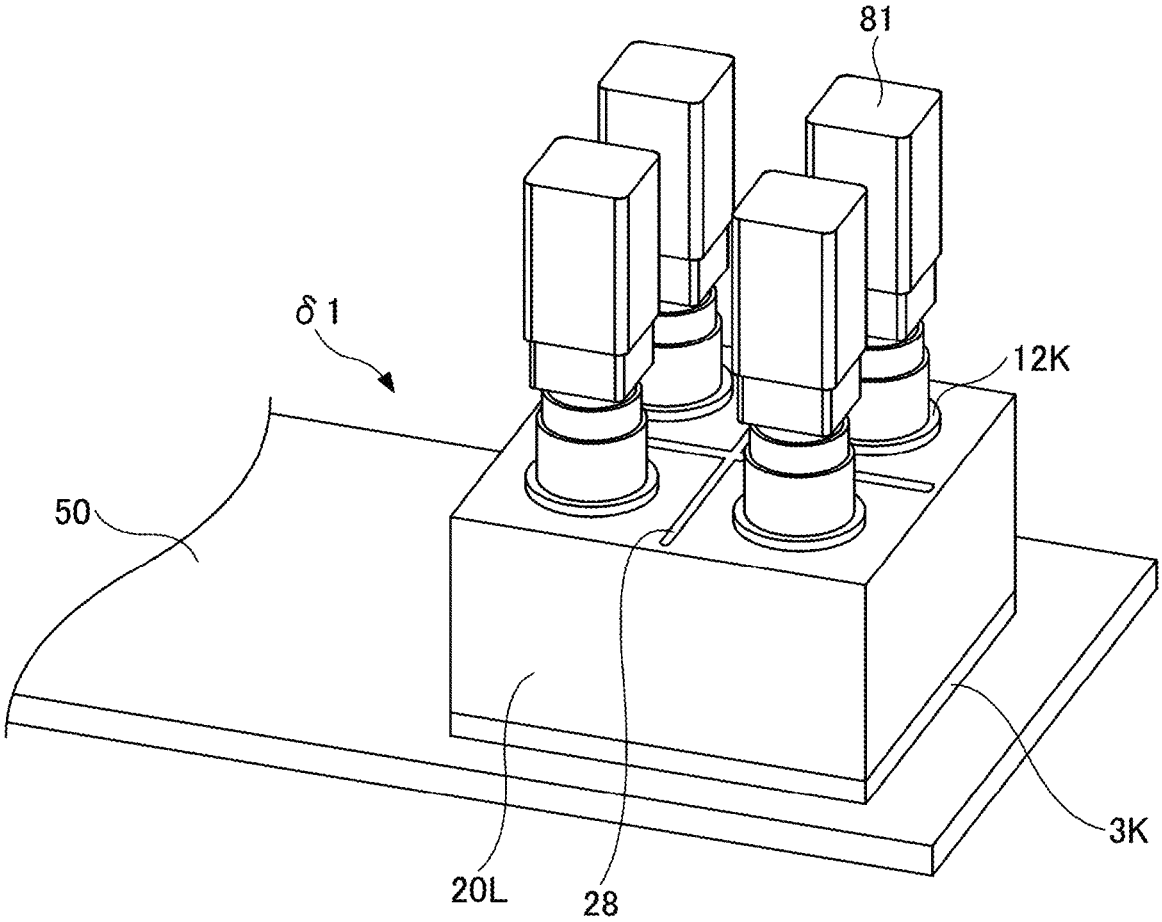
FIG. 40 is a perspective view of an integrated molding unit according to the eleventh embodiment.
Figure 41:
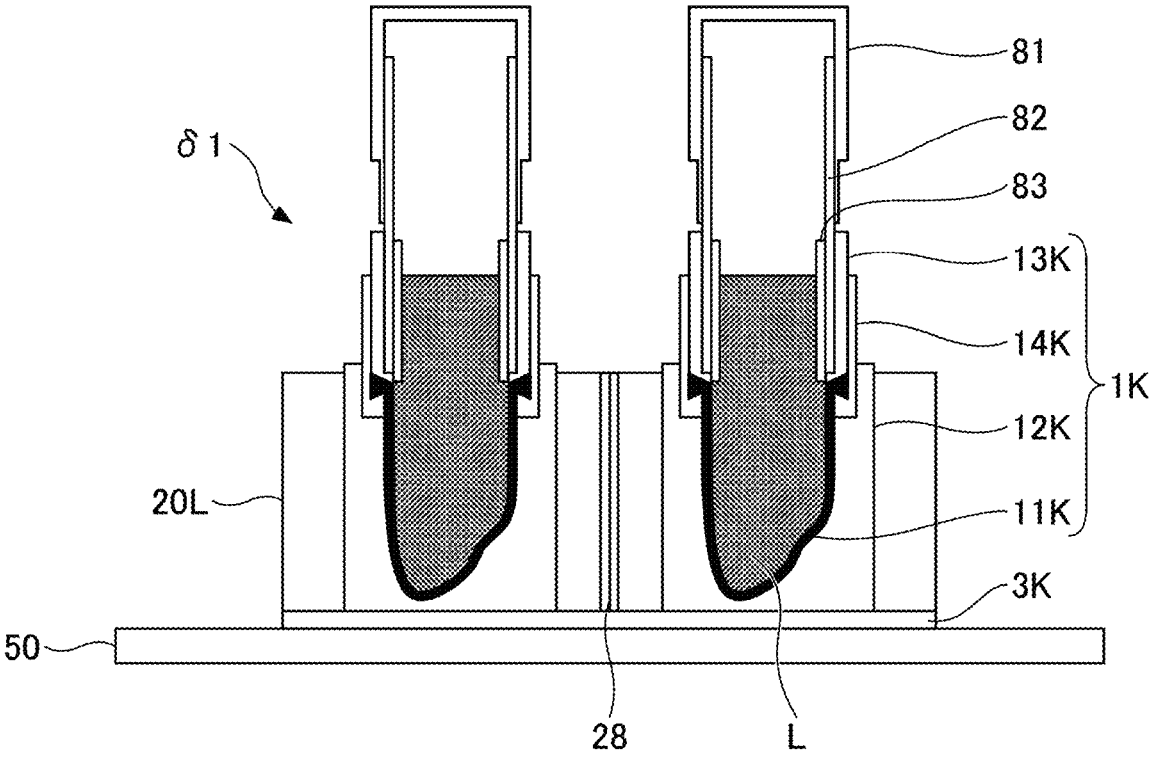
FIG. 41 is a cross-sectional view of the integrated molding unit according to the eleventh embodiment illustrated in FIG. 40.

FIG. 40 is a perspective view of an integrated molding unit δ1 according to the eleventh embodiment. FIG. 41 is a cross-sectional view of the integrated molding unit δ1 according to the eleventh embodiment of FIG. 40.

Four metal molds are integrally formed without any partition in the tenth embodiment. However, this embodiment differs from the tenth embodiment in that slits 28 that serve as partitions are provided in the outer cylinder 20L. Other aspects of the configuration are the same as those of the tenth embodiment.

In the integrated molding units illustrated in FIGS. 37 to 41, the outer cylinder 20 (20L) is provided such that the plurality of molds do not affect the respective temperatures of the fillings of one another. Hence, even in an integrated molding unit, the temperature of each mold to be filled with the cosmetic composition can be controlled independently. Therefore, temperature unevenness can be reduced with respect to each of the plurality of molds as well as with respect to within a single mold, regardless of the number of cosmetic products to be molded.

Although each of the embodiments described an example in which only the Peltier element is used for temperature control, reheating may be performed by a configuration combining the Peltier element and application of warm air from above.

Although embodiments have been described in detail above, the present disclosure is not limited to the specific embodiments described above, and various modifications and substitutions can be made without departing from the scope of the claims.

This international application claims priority based on Japanese Patent Application No. 2020-213983 filed on Dec. 23, 2020. The entire contents of Japanese Patent Application No. 2020-213983 are incorporated herein by reference.

REFERENCE SYMBOLS LIST

1, 1A, 1B, 1K mold
2, 2A, 2G, 2H, 2I, 2J outer cylinder (thermally insulated cylinder)
3, 3G, 3H, 3I, 30, 30I, 30J, 30K Peltier element
4, 4I, 4J heat sink
5 controller (element controller, control device)
6 refrigerant tank (tank)
7 cooling unit
8 extendable container
9 apparatus for manufacturing a molded product to be filled in an extendable lipstick container
11, 11A, 11E, 11G, 11K rubber mold

12, 12A, 12B, 12C, 12D, 12E, 12F, 12G, 12H, 12K metal mold (thermally conductive type)
13 inner rubber holder (rubber holder)
14 outer rubber holder (rubber holder)
15 thermally conductive holder
20A, 20K, 20L outer cylinder (thermally insulated cylinder)
21 annular upper-end surface
41 upper pad
42 finned portion
43 rod-shaped protrusions
67 cooling fan
71 cooling passage
81, 81A outer cylinder (skirt cylinder)
82, 82A spiral cylinder
83 elevating cylinder (middle tray cylinder, elevating tray)
98 outside air temperature sensor (environment sensor)
99 humidity sensor (environment sensor)
100 lipstick molding apparatus (cosmetic product molding apparatus)
101 lipstick composition filling device (filling device)
102 temperature adjustment device
200 main control device (main controller)
300 input device
C first refrigerant
L lipstick composition (cosmetic composition), lipstick (rod-shaped cosmetic product)
W second refrigerant
α independent temperature control unit
β1, β2, β3, β4, β5, β6, β7, β8, β9 independent molding unit
γ independent molding unit
δ, δ1 integrated molding unit

The invention claimed is:

1. A cosmetic product molding apparatus comprising:
a plurality of molds, each mold of the plurality of molds having a bottomed cylindrical shape and including a cylindrical recessed portion, the cylindrical recessed portion being configured to be filled with a cosmetic composition for a rod-shaped cosmetic product;
one or more outer cylinders surrounding side surfaces of the plurality of molds;
a plurality of Peltier elements configured to heat or cool the plurality of molds; and
a controller configured to control each Peltier element of the plurality of Peltier elements to adjust a temperature of each mold of the plurality of molds,
wherein the one or more outer cylinders are provided so as to prevent the plurality of molds from affecting respective temperatures of fillings of one another.

2. The cosmetic product molding apparatus according to claim 1, wherein the one or more outer cylinders include a plurality of thermally insulated cylinders surrounding respective side surfaces of the plurality of molds and provided such that the thermally insulated cylinders are equal in number to the plurality of molds, and
wherein the plurality of thermally insulated cylinders are provided so as not to contact one another.

3. The cosmetic product molding apparatus according to claim 1, wherein the one or more outer cylinders include one or more thermally insulated cylinders, the one or more thermally insulated cylinders being provided with respect to the plurality of molds at a ratio that ranges from 1:1 to 1:n (n being a natural number larger than or equal to 3), the thermally insulated cylinders also being equal in number to the plurality of Peltier elements or smaller in number than the plurality of Peltier elements, and
wherein the thermally insulated cylinder is configured to insulate heat so as to prevent neighboring molds of the plurality of molds from affecting respective temperatures of fillings of one another.

4. The cosmetic product molding apparatus according to claim 1, wherein the plurality of Peltier elements are provided with respect to the plurality of molds at a ratio that ranges from 1:n to n:1 (n being a natural number larger than or equal to 2), and
wherein each Peltier element of the plurality of Peltier elements is configured to heat or cool one to n molds.

5. The cosmetic product molding apparatus according to claim 4, wherein the plurality of Peltier elements are provided such that each Peltier element is wider in a horizontal direction than in a height direction, and
a lower end of the one to n molds contacts an upper surface of each Peltier element.

6. The cosmetic product molding apparatus according to claim 5, wherein a heat sink is attached to a lower surface of the Peltier element,
wherein a lower end of the heat sink is entirely or partially immersed in a refrigerant, and
wherein the refrigerant cools the lower surface of the Peltier element configured to generate heat during heating or cooling.

7. The cosmetic product molding apparatus according to claim 6, wherein the heat sink includes
an upper pad in contact with the lower surface of the Peltier element, and
a finned portion including a plurality of pin-shaped fins or a plurality of planar fins extending downward from a lower surface of the upper pad.

8. The cosmetic product molding apparatus according to claim 6, wherein the refrigerant is stored in a tank, and
wherein an underpart of the tank is filled with a second refrigerant for cooling the tank, or
wherein the refrigerant circulates within the tank.

9. The cosmetic product molding apparatus according to claim 5, wherein a heat sink is attached to a lower surface of the Peltier element, and
wherein a cooling fan is provided on a part of or an entirety of a lower end of the heat sink such that the lower surface of the Peltier element configured to generate heat during heating or cooling is cooled by outside air.

10. The cosmetic product molding apparatus according to claim 1, wherein each mold of the plurality of molds includes
an inner mold including the cylindrical recessed portion to be directly filled with the cosmetic composition for the rod-shaped cosmetic product, and
a thermally conductive mold that has a bottomed cylindrical shape and surrounds a side surface and a lower surface of the inner mold.

11. The cosmetic product molding apparatus according to claim 1, wherein each mold of the plurality of molds includes a thermally conductive mold that has a bottomed cylindrical shape and includes the cylindrical recessed portion, the cylindrical recessed portion being configured to be directly filled with the cosmetic composition for the rod-shaped cosmetic product.

12. The cosmetic product molding apparatus according to claim 10, wherein the thermally conductive mold has a bottomed cylindrical shape, and includes a side surface that contacts a side surface of the inner mold, and a bottom surface that is positioned below a bottom surface of the inner mold with a space therebetween so as not to contact the bottom surface of the inner mold.

13. The cosmetic product molding apparatus according to claim 1, further comprising holders that are equal in number to the plurality of molds, each holder standing upward from an upper end of a corresponding mold of the plurality of molds, and configured to surround and hold an elevating cylinder that is configured to tightly hold the molded rod-shaped cosmetic product and a spiral cylinder that is configured to engage with an exterior of the elevating cylinder, wherein in a state where each holder holds the elevating cylinder and the spiral cylinder, the recessed portion of the corresponding mold of the plurality of molds and an interior of the elevating cylinder are filled with the cosmetic composition, and wherein heat is conducted to the cosmetic composition in the elevating cylinder from an underside of the cosmetic composition.

14. The cosmetic product molding apparatus according to claim 1, further comprising thermally conductive holders that are equal in number to the molds, each thermally conductive holder standing upward from an upper end of a corresponding mold of the plurality of molds, and configured to surround and hold an elevating cylinder that is configured to tightly hold the molded rod-shaped cosmetic product, wherein in a state where each thermally conductive holder holds the elevating cylinder, the recessed portion of the corresponding mold of the plurality of molds and an interior of the elevating cylinder are filled with the cosmetic composition, and wherein heat is conducted to the cosmetic composition in the elevating cylinder through a side surface of the cosmetic composition from the thermally conductive holder.

15. The cosmetic product molding apparatus according to claim 1, wherein the recessed portion of each mold of the plurality of molds is filled with an entire amount of the cosmetic composition for the rod-shaped cosmetic product to be molded.

16. The cosmetic product molding apparatus according to claim 1, wherein each Peltier element of the plurality of Peltier elements has a bottomed cylindrical shape, and wherein an upper surface of each Peltier element and an inner surface of a peripheral wall of each Peltier element contact at least a portion of the side surface and a lower end of a corresponding mold of the plurality of molds.

17. The cosmetic product molding apparatus according to claim 1, wherein the controller includes element controllers that are equal in number to the plurality of Peltier elements, each element controller being provided near a corresponding Peltier element of the plurality of Peltier elements, and a main controller configured to communicate with each element controller, wherein a program for heating or cooling the cosmetic composition is transmitted from the main controller to each element controller to control a temperature of the corresponding Peltier element of the plurality of Peltier elements.

18. The cosmetic product molding apparatus according to claim 16, further comprising a power supply device configured to supply power to and receive power from each Peltier element and an element controller through wired power transmission or a wireless power transmission device.

19. The cosmetic product molding apparatus according to claim 1, wherein a temperature of each mold of the plurality of molds is respectively controlled by an independent Peltier element of the plurality of Peltier elements.

20. A cosmetic product molding apparatus comprising:

a plurality of molds, each mold of the plurality of molds having a bottomed cylindrical shape and including a cylindrical recessed portion, the cylindrical recessed portion being configured to be filled with a cosmetic composition for a rod-shaped cosmetic product;

one or more outer cylinders surrounding side surfaces of the plurality of molds;

a plurality of Peltier elements configured to heat or cool the plurality of molds; and a controller configured to control each Peltier element of the plurality of Peltier elements to adjust a temperature of each mold of the plurality of molds, wherein the one or more outer cylinders are provided so as to prevent the plurality of molds from affecting respective temperatures of fillings of one another, wherein each mold of the plurality of molds includes an inner mold including the cylindrical recessed portion to be directly filled with the cosmetic composition for the rod-shaped cosmetic product, and a thermally conductive mold that has a bottomed cylindrical shape and surrounds a side surface and a lower surface of the inner mold, wherein the thermally conductive mold includes a holder cylinder that surrounds the side surface and the lower surface of the inner mold, and includes a bottom surface that is not in contact with each Peltier element of the plurality of Peltier elements, a thermally conductive outer cylinder that surrounds the holder cylinder so as to be spaced apart from an outer side surface of the holder cylinder, and includes a lower end that contacts at least one Peltier element of the plurality of Peltier elements, and a connecting portion configured to connect a vicinity of an upper end of the holder cylinder to a vicinity of an upper end of the thermally conductive outer cylinder.

21. A cosmetic product molding apparatus comprising:

a plurality of molds, each mold of the plurality of molds having a bottomed cylindrical shape and including a cylindrical recessed portion, the cylindrical recessed portion being configured to be filled with a cosmetic composition for a rod-shaped cosmetic product;

one or more outer cylinders surrounding side surfaces of the plurality of molds;

a plurality of Peltier elements configured to heat or cool the plurality of molds;

a controller configured to control each Peltier element of the plurality of Peltier elements to adjust a temperature of each mold of the plurality of molds, wherein the one or more outer cylinders are provided so as to prevent the plurality of molds from affecting respective temperatures of fillings of one another; and an environment sensor configured to measure at least one of an outside air temperature or a humidity of an environment in which the cosmetic product molding apparatus is located, wherein the controller includes element controllers that are equal in number to the plurality of Peltier elements, each element controller being provided near a corresponding Peltier element of the plurality of Peltier elements, and a main controller configured to communicate with each element controller, wherein the main controller is configured to adjust and set, based on a detection result from the environment sensor, a temperature for a program for heating or cooling each Peltier element, and to transmit the set temperature to a corresponding element controller of the element controllers, and wherein each element controller controls a temperature of the corresponding Peltier element of the plurality of Peltier elements based on the transmitted set temperature.

22. A method of manufacturing a rod-shaped cosmetic product in a cosmetic product molding apparatus, the cosmetic product molding apparatus including a plurality of bottomed cylindrical-shaped molds, one or more outer cylinders surrounding side surfaces of the plurality of molds, a plurality of Peltier elements, and a controller connected to the plurality of Peltier elements, the method comprising:

filling a cylindrical recessed portion of each mold of the plurality of molds with a cosmetic composition for a rod-shaped cosmetic product; and solidifying the cosmetic composition via each mold by a corresponding Peltier element of the plurality of Peltier elements by causing the controller to control the corresponding Peltier element of the plurality of Peltier elements to adjust a temperature of each mold of the plurality of molds, wherein in the solidifying of the cosmetic composition, the one or more outer cylinders are provided so as to prevent the plurality of molds from affecting respective temperatures of fillings of one another.

23. The method of manufacturing a rod-shaped cosmetic product according to claim 22, wherein the solidifying of the cosmetic composition includes reducing a temperature of the corresponding Peltier element from a filling temperature to a first temperature, increasing the temperature of the corresponding Peltier element to a second temperature that is lower than the filling temperature, and reducing, in a stepwise manner, the temperature of the corresponding Peltier element from the second temperature to a final cooling temperature that is lower than the first temperature, with a temperature maintaining period interposed therebetween, wherein the first temperature is a temperature that is closer to the filling temperature than to the final cooling temperature.

* * * * *